US006367366B1

(12) United States Patent
Bloom et al.

(10) Patent No.: US 6,367,366 B1
(45) Date of Patent: Apr. 9, 2002

(54) SENSOR ASSEMBLY

(75) Inventors: Duane Bloom, Anaheim, CA (US); James W. Estep; Rudolph Ernst Krueger, both of Houston, TX (US); Bruce Norman Moore, Aliso Viejo, CA (US); Kwang M. Yoo, Houston, TX (US)

(73) Assignee: Western Well Tool, Inc., Anaheim, CA (US)

( * ) Notice: Subject to any disclaimer, the term of this patent is extended or adjusted under 35 U.S.C. 154(b) by 0 days.

(21) Appl. No.: 09/599,071

(22) Filed: Jun. 20, 2000

Related U.S. Application Data

(63) Continuation of application No. 09/453,996, filed on Dec. 3, 1999.

(60) Provisional application No. 60/168,790, filed on Dec. 2, 1999.

(51) Int. Cl.[7] ..... F01B 31/12

(52) U.S. Cl. ..... 92/5 R

(58) Field of Search ..... 91/1; 92/5 R

(56) References Cited

U.S. PATENT DOCUMENTS

| | | | | |
|---|---|---|---|---|
| 2,167,194 A | | 7/1939 | Anderson | |
| 2,271,005 A | | 1/1942 | Grebe | |
| 2,946,565 A | | 7/1960 | Williams | |
| 3,138,214 A | | 6/1964 | Bridwell | |
| 3,180,436 A | | 4/1965 | Kellner et al. | |
| 3,185,225 A | | 5/1965 | Ginies | |
| 3,224,513 A | | 12/1965 | Weeden, Jr. | |
| 3,225,843 A | | 12/1965 | Ortloff et al. | |
| 3,497,019 A | | 2/1970 | Ortloff | |
| 3,599,712 A | | 8/1971 | Magill | |
| 3,606,924 A | | 9/1971 | Malone | |
| 3,797,589 A | | 3/1974 | Kellner et al. | |
| 3,827,512 A | | 8/1974 | Edmond | |
| 3,839,944 A | * | 10/1974 | Swift | 92/5 R |
| RE28,449 E | | 6/1975 | Edmond | |
| 3,941,190 A | | 3/1976 | Conover, deceased | |
| 3,978,930 A | | 9/1976 | Schroeder | |
| 3,992,565 A | | 11/1976 | Gatfield | |
| 4,085,808 A | | 4/1978 | Kling | |
| 4,095,655 A | | 6/1978 | Still | |
| 4,121,504 A | * | 10/1978 | Nowak | 92/5 R |
| 4,141,414 A | | 2/1979 | Johansson | |
| 4,314,615 A | | 2/1982 | Sodder, Jr. et al. | |
| 4,365,676 A | | 12/1982 | Boyadjieff et al. | |
| 4,385,021 A | | 5/1983 | Neeley | |
| 4,440,239 A | | 4/1984 | Evans | |
| 4,463,814 A | | 8/1984 | Horstmeyer, et al. | |
| 4,558,751 A | | 12/1985 | Huffaker | |
| 4,615,401 A | | 10/1986 | Garrett | |
| 4,674,914 A | | 6/1987 | Wayman, et al. | |

(List continued on next page.)

FOREIGN PATENT DOCUMENTS

| | | |
|---|---|---|
| EP | 0 257 744 B1 | 1/1995 |
| WO | WO 94/27022 | 11/1994 |

OTHER PUBLICATIONS

"Kolibomac to Challenge Tradition." Norwegian Oil Review, 1988. pp. 50 & 52.

*Primary Examiner*—F. Daniel Lopez
(74) *Attorney, Agent, or Firm*—Knobbe, Martens, Olson & Bear, LLP

(57) ABSTRACT

A sensor assembly including a sensor mounted on the piston and a transmitter mounted on either the piston or cylinder. Preferably the transmitter includes a wheel which engages the wall of the cylinder so as to rotate as the piston reciprocates within the cylinder. The wheel includes one or more magnets which emit a magnetic field that is received by the sensor as the wheel rotates whereby the sensor provides a signal indicative of the rotation of the wheel. The sensor then sends the signal to a logic component which determines the direction, travel and position of the piston within the cylinder.

21 Claims, 69 Drawing Sheets

U.S. PATENT DOCUMENTS

| | | | | |
|---|---|---|---|---|
| 4,686,653 | A | | 8/1987 | Staron, et al. |
| 4,811,785 | A | | 3/1989 | Weber |
| 4,819,546 | A | * | 4/1989 | Ernst et al. ..... 92/5 R |
| 4,821,817 | A | | 4/1989 | Cendre et al. |
| 4,854,397 | A | | 8/1989 | Warren et al. |
| 4,951,760 | A | | 8/1990 | Cendre et al. |
| 5,010,965 | A | | 4/1991 | Schmelzer |
| 5,138,934 | A | * | 8/1992 | Murayama et al. ..... 92/5 R |
| 5,169,264 | A | | 12/1992 | Kimura |
| 5,184,676 | A | | 2/1993 | Graham et al. |
| 5,186,264 | A | | 2/1993 | de Chaffaut |
| 5,310,012 | A | | 5/1994 | Cendre et al. |
| 5,425,429 | A | | 6/1995 | Thompson |
| 5,449,047 | A | | 9/1995 | Schively, Jr. |
| 5,467,832 | A | | 11/1995 | Orban et al. |
| 5,519,668 | A | | 5/1996 | Montaron |
| 5,752,572 | A | | 5/1998 | Baiden et al. |
| 5,758,731 | A | | 6/1998 | Zollinger |
| 5,758,732 | A | | 6/1998 | Liw |
| 5,794,703 | A | | 8/1998 | Newman et al. |
| 5,857,731 | A | | 1/1999 | Heim et al. |
| 6,003,606 | A | | 12/1999 | Moore et al. |

* cited by examiner

ANNULUS
E

ANNULUS
E
100
104
106
108
110
112
114
116
118
124
129
140
142
144
146
148
150
151
152
153
154
155
156
158
160
162
164
166
168
170
172
174
176
178
180
182
184
186
188
190
192
194
202
206
208
210
234
236
238
238A
260
40
42

ANNULUS
40
100
102
104
106
108
110
112
114
116
118
124
129
140
142
144
146
148
150
151
152
153
154
155
156
158
160
162
164
166
168
170
172
174
176
178
180
182
184
186
188
190
192
194
202
206
208
210
234
236
238
238A
260
E 280
278
276
256

286
284
282
254

26
26
27
27
25
25
24
24
155
256
242
236
258
244
234
252
246
238
202
204
240
254
260

274
272
270
258

264
268
262
266
252

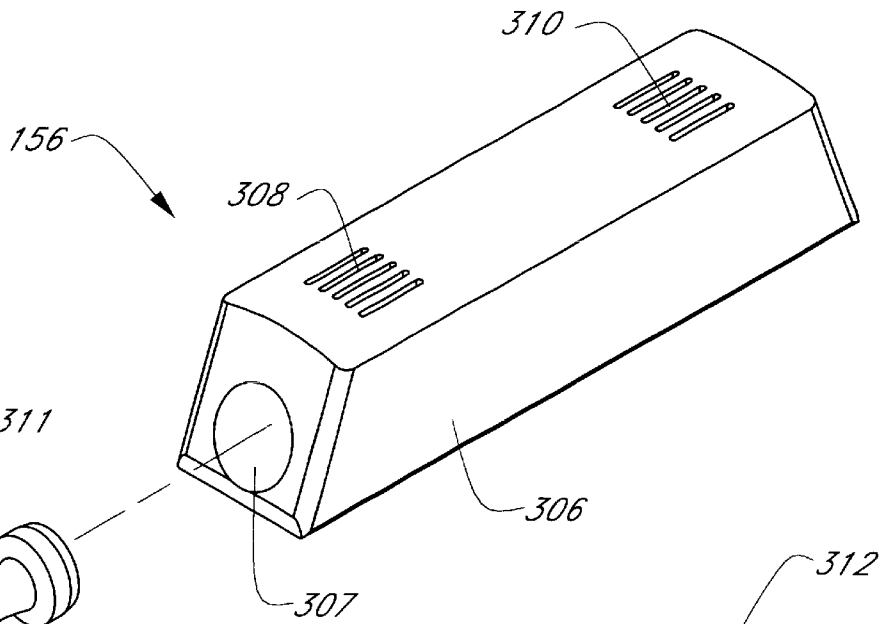
FIG. 38
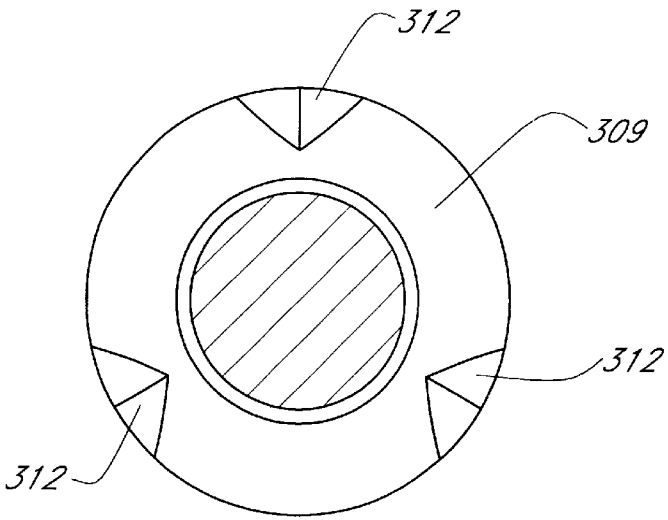
FIG. 39
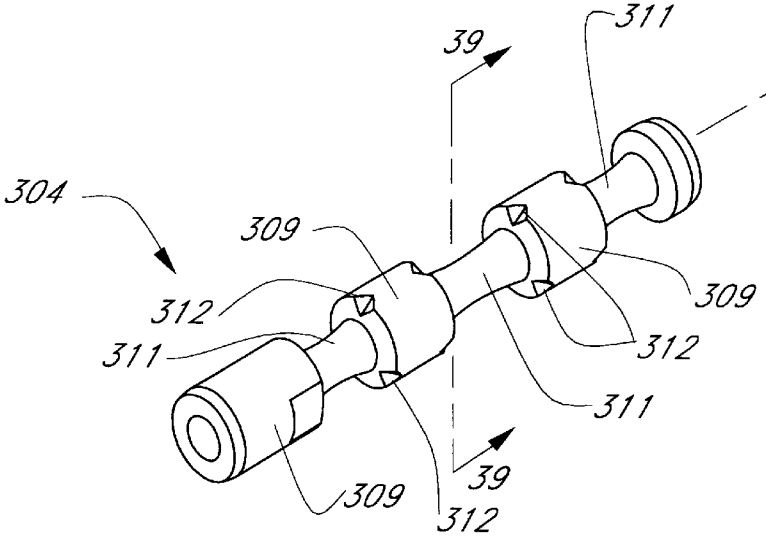

367
366
51
51
367
55
55
376
374
56
56
57
57
58
58
362
360
372
380
59
59
118
382
52
52

54
54
370
368
378
118

208
204A
206
202
210

202
204A 365
210
365
206
365
202
365
204A
208
365

SENSOR ASSEMBLY

RELATED APPLICATIONS

The present application is a continuation of U.S. patent application Ser. No. 09/453,996 filed Dec. 3, 1999 and entitled "ELECTRICALLY SEQUENCED TRACTOR," which claims the benefit of 35 U.S.C. § 119(e) of U.S. Provisional Patent Application Serial No. 60/168,790, filed Dec. 2, 1999, both hereby incorporated herein by reference.

BACKGROUND AND SUMMARY OF THE INVENTION

The present invention relates to apparatus and methods for determining the position of a piston within a cylinder and more particularly to the position of a piston within a propulsion cylinder of a propulsion system or tractor.

It is often important to know the position of a piston within a cylinder as the piston reciprocates within the cylinder. Typically the piston actuates another member such that it is important to know the position of the piston during its travel within the cylinder so as to know the position of the other member.

In particular, propulsion systems are used in the oilfield for propelling a bottom hole assembly within the borehole. Typically the propulsion system includes first and second housings with a packerfoot mounted on each of the housings with each housing having a piston and cylinder for moving the propulsion system within the borehole. The propulsion system operates by the packerfoot on one end of the first housing expanding into engagement with the wall of the borehole with the first piston then extending in the first cylinder to move the bottom hole assembly downhole. Simultaneously, the second packerfoot on the second housing contracts and moves to the other end of the second housing. Once the first piston completes its stroke, then the second piston in the second housing is actuated to propel the bottom hole assembly and propulsion system further downhole as the first packerfoot retracts and resets at the other end of the first housing. This cycle is repeated to continuously move the bottom hole assembly within the borehole. Thus, it is important to know the positioning of each of the pistons in the cylinders as the propulsion system cycles to know the position of the propulsion system as it propels the bottom hole assembly further downhole.

The sensor assembly includes a sensor mounted within the piston and a transmitter mounted either on the piston or cylinder. Preferably the transmitter includes a wheel disposed on the piston which engages the wall of the cylinder so as to rotate as the piston reciprocates within the cylinder. The wheel includes one or more magnets which emit a magnetic field that is received by the sensor as the wheel rotates. The sensor then sends an electric pulse signal to a logic component which determines the direction, travel, position, and speed of the piston within the cylinder.

More preferably, the wheel includes two oppositely charged magnets positioned on opposite sides of the wheel's outer circumference. The sensor senses reversals in polarity of the two magnets every time the wheel rotates 180°. For every reversal in polarity, the sensor sends an electric pulse signal to the logic component. As the wheel rotates, the sensor transmits a stream of electric pulses as the wheel rotates. The direction, travel, position, and speed of the piston within the cylinder can then be determined by monitoring the number of pulses and the direction of piston travel. The position can be calculated from the wheel diameter, since each pulse corresponds to one-half of the wheel circumference.

Other objects and advantages of the invention will appear from the following description.

BRIEF DESCRIPTION OF THE DRAWINGS

FIG. 38 is a rear perspective view of the aft propulsion valve spool and aft propulsion valve body of the EST;

FIG. 39 is a cross-sectional view of the aft propulsion valve spool, taken along line 39—39 of FIG. 38;

DETAILED DESCRIPTION OF THE PREFERRED EMBODIMENT

It must be emphasized that the following describes one configuration of the Electrically Sequenced Tractor (hereinafter "EST"). However, numerous variations are possible. These variations in structure result in various ranges of performance characteristics. Several physical constraints require the EST to be innovative with respect to the use of available space within the borehole. The physical constraints are the result of the drilling environment. First, the maximum diameter of the tool is restricted by the diameter of the drilled hole and the amount and pressure of the drilling fluid pumped through the internal bore of the tool and returning to the ground surface with drill cuttings. Next, the physical length of the tractor is restricted by the size of surface handling equipment and rig space. The temperature and pressure downhole are the result of rock formation conditions. The desired thrust capacity of the EST is defined by the size of the drill bit, the downhole motor thrust capacity, and rock characteristics. The desired pull capacity of the tool is defined by the weight of the drill string and the bottom hole assembly in the drilling fluid considering the friction of the components against the borehole wall or casing wall or by the desired functional requirements, such as the amount of force required to move a sliding sleeve in a casing. The desired maximum speed is influenced by rig economics that include the associated costs of drilling labor, material, facilities, cost of money, risk, and other economic factors. The lowest desired speed is defined by the type of operation, such as rate of penetration in a particular formation or rate of milling casing. In addition, drilling convention has resulted in numerous default sizes used in drilling. These size constraints are generally a function of the size of drill bit available, the size of casing available, the size of ground surface equipment, and other parameters.

For example, the EST design described herein has a maximum diameter of 3.375 inches for use in a 3.75-inch hole. However, several other designs are conceived, including a 2.125 inch diameter tool for use in a 2.875 inch hole, a 4.75 inch diameter tool for use in a 6.0 inch hole, and a 6.0 inch diameter tool for use in a 8.5 inch hole.

It is believed, however, that for a given set of operating criteria, such as a requirement that the tool operate within a 3.75 inch diameter borehole and have a given maximum length, that the present invention has numerous advantages over prior art tractors. For example, having a single tractor which can fit within a given borehole and which can sustain both slow speeds for activities such as milling and high speeds for activities such as tripping out of a borehole is extremely valuable, in that it saves both the expense of having another tractor and the time which would otherwise be required to change tractors.

Figure 1:
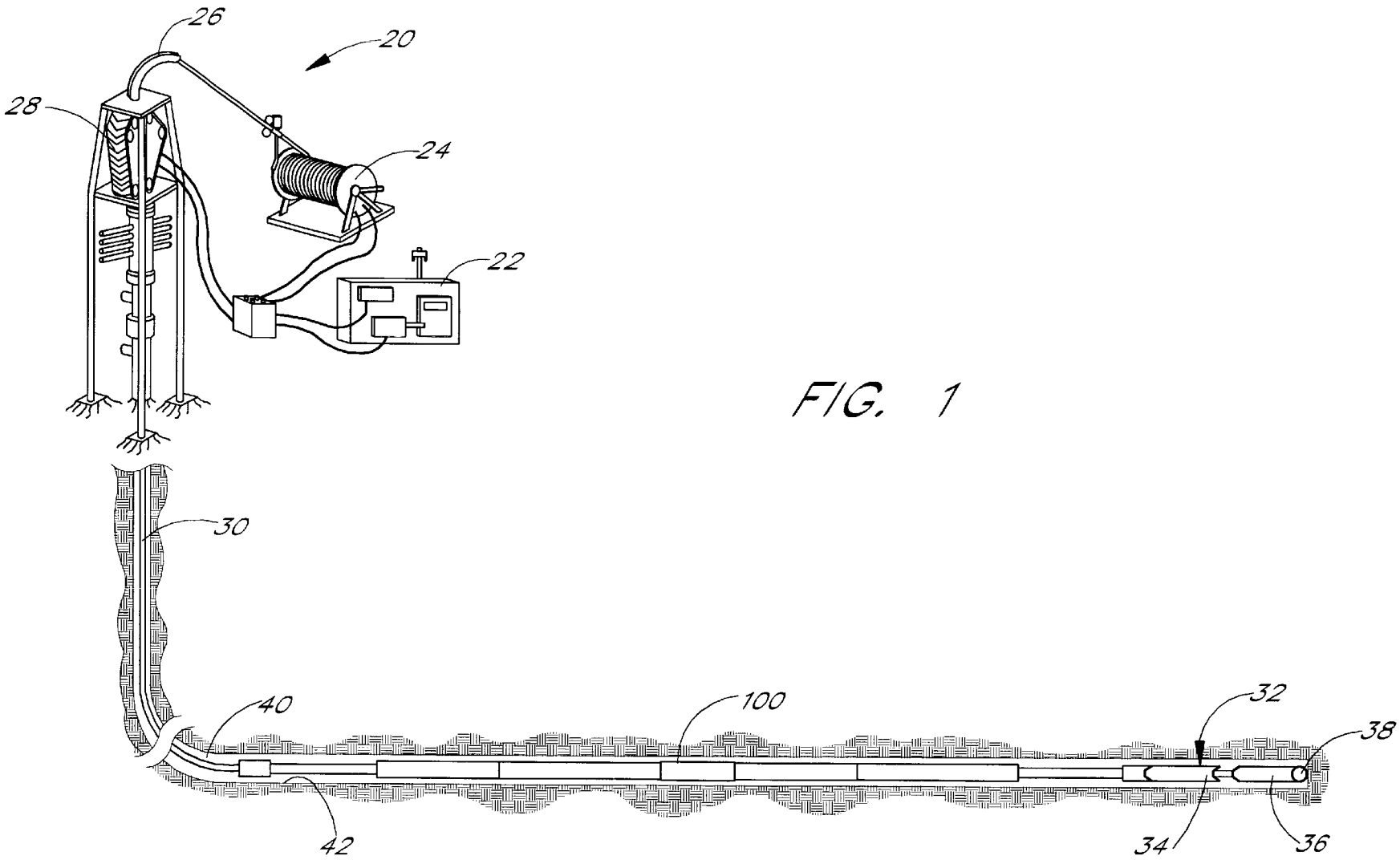
FIG. 1 is a schematic diagram of the major components of one embodiment of a coiled tubing drilling system of the present invention.

FIG. 1 shows an electrically sequenced tractor (EST) 100 for moving equipment within a passage, configured in accordance with a preferred embodiment of the present invention. In the embodiments shown in the accompanying figures, the electrically sequenced tractor (EST) of the present invention may be used in conjunction with a coiled tubing drilling system 20 and a bottom hole assembly 32. System 20 may include a power supply 22, tubing reel 24, tubing guide 26, tubing injector 28, and coiled tubing 30, all of which are well known in the art. Assembly 32 may include a measurement while drilling (MWD) system 34, downhole motor 36, and drill bit 38, all of which are also known in the art. The EST is configured to move within a borehole having an inner surface 42. An annulus 40 is defined by the space between the EST and the inner surface 42.

It will be appreciated that the EST may be used to move a wide variety of tools and equipment within a borehole. Also, the EST can be used in conjunction with numerous types of drilling, including rotary drilling and the like. Additionally, it will be understood that the EST may be used in many areas including petroleum drilling, mineral deposit drilling, pipeline installation and maintenance, communications, and the like. Also, it will be understood that the apparatus and method for moving equipment within a passage may be used in many applications in addition to drilling. For example, these other applications include well completion and production work for producing oil from an oil well, pipeline work, and communications activities. It will be appreciated that these applications may require the use of other equipment in conjunction with an EST according to the present invention. Such equipment, generally referred to as a working unit, is dependent upon the specific application undertaken.

For example, one of ordinary skill in the art will understand that oil and gas well completion typically requires that the reservoir be logged using a variety of sensors. These sensors may operate using resistivity, radioactivity, acoustics, and the like. Other logging activities include measurement of formation dip and borehole geometry, formation sampling, and production logging. These completion activities can be accomplished in inclined and horizontal boreholes using a preferred embodiment of the EST. For instance, the EST can deliver these various types of logging sensors to regions of interest. The EST can either place the sensors in the desired location, or the EST may idle in a stationary position to allow the measurements to be taken at the desired locations. The EST can also be used to retrieve the sensors from the well.

Examples of production work that can be performed with a preferred embodiment of the EST include sands and solids washing and acidizing. It is known that wells sometimes become clogged with sand, hydrocarbon debris, and other solids that prevent the free flow of oil through the borehole 42. To remove this debris, specially designed washing tools known in the industry are delivered to the region, and fluid is injected to wash the region. The fluid and debris then return to the surface. Such tools include acid washing tools. These washing tools can be delivered to the region of interest for performance of washing activity and then returned to the ground surface by a preferred embodiment of the EST.

In another example, a preferred embodiment of the EST can be used to retrieve objects, such as damaged equipment and debris, from the borehole. For example, equipment may become separated from the drill string, or objects may fall into the borehole. These objects must be retrieved, or the borehole must be abandoned and plugged. Because abandonment and plugging of a borehole is very expensive, retrieval of the object is usually attempted. A variety of retrieval tools known to the industry are available to capture these lost objects. The EST can be used to transport retrieving tools to the appropriate location, retrieve the object, and return the retrieved object to the surface.

In yet another example, a preferred embodiment of the EST can also be used for coiled tubing completions. As known in the art, continuous-completion drill string deployment is becoming increasingly important in areas where it is undesirable to damage sensitive formations in order to run production tubing. These operations require the installation and retrieval of fully assembled completion drill string in boreholes with surface pressure. The EST can be used in conjunction with the deployment of conventional velocity string and simple primary production tubing installations. The EST can also be used with the deployment of artificial lift devices such as gas lift and downhole flow control devices.

In a further example, a preferred embodiment of the EST can be used to service plugged pipelines or other similar passages. Frequently, pipelines are difficult to service due to physical constraints such as location in deep water or proximity to metropolitan areas. Various types of cleaning devices are currently available for cleaning pipelines. These various types of cleaning tools can be attached to the EST so that the cleaning tools can be moved within the pipeline.

In still another example, a preferred embodiment of the EST can be used to move communication lines or equipment within a passage. Frequently, it is desirable to run or move various types of cables or communication lines through various types of conduits. The EST can move these cables to the desired location within a passage.

Overview of EST Components

Figure 2:
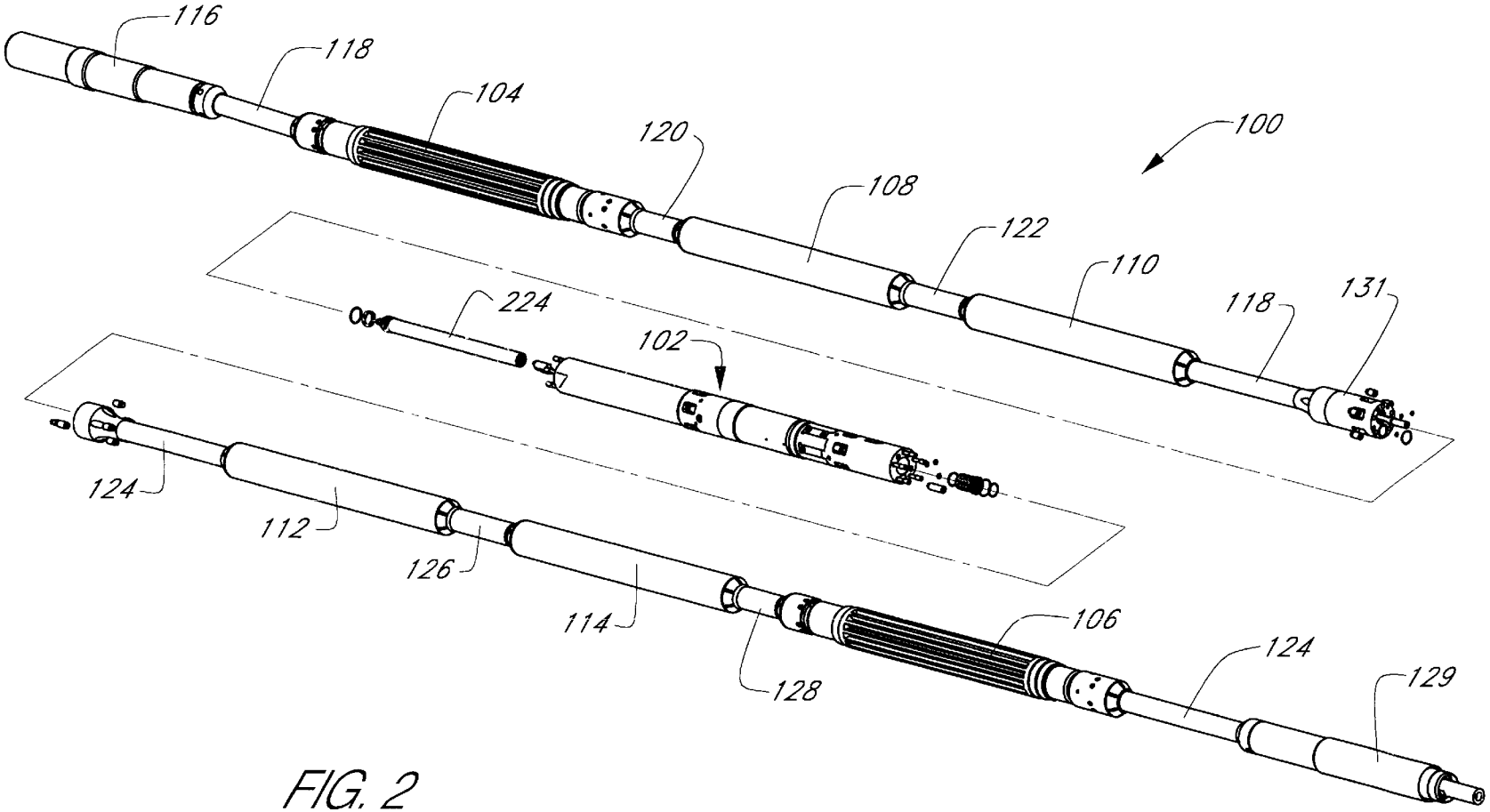
FIG. 2 is a front perspective view of the electrically sequenced tractor of the present invention (EST)

FIG. 2 shows a preferred embodiment of an electrically sequenced tractor (EST) of the present invention. The EST 100 comprises a central control assembly 102, an uphole or aft packerfoot 104, a downhole or forward packerfoot 106, aft propulsion cylinders 108 and 110, forward propulsion cylinders 112 and 114, a drill string connector 116, shafts 118 and 124, flexible connectors 120, 122, 126, and 128, and a bottom hole assembly connector 129. Drill string connector 116 connects a drill string, such as coiled tubing, to shaft 118. Aft packerfoot 104, aft propulsion cylinders 108 and 110, and connectors 120 and 122 are assembled together end to end and are all axially slidably engaged with shaft 118. Similarly, forward packerfoot 106, forward propulsion cylinders 112 and 114, and connectors 126 and 128 are assembled together end to end and are slidably engaged with shaft 1 24. Connector 129 provides a connection between EST 100 and downhole equipment such as a bottom hole assembly. Shafts 118 and 124 and control assembly 102 are axially fixed with respect to one another and are sometimes referred to herein as the body of the EST. The body of the EST is thus axially fixed with respect to the drill string and the bottom hole assembly.

EST Schematic Configuration and Operation

FIGS. 4A–4F schematically illustrate a preferred configuration and operation of the EST. Aft propulsion cylinders 108 and 110 are axially slidably engaged with shaft 118 and form annular chambers surrounding the shaft. Annular pistons 140 and 142 reside within the annular chambers form ed by cylinders 108 and 110, respectively, and are axially fixed to shaft 118. Piston 140 fluidly divides the annular chamber formed by cylinder 108 into a rear chamber 166 and a front chamber 168. Such rear and front chambers are fluidly sealed to substantially prevent fluid flow between the chambers or leakage to annulus 40. Similarly, piston 142 fluidly divides the annular chamber formed by cylinder 110 into a rear chamber 170 and a front chamber 172.

The forward propulsion cylinders 112 and 114 are configured similarly to the aft propulsion cylinders. Cylinders 112 and 114 are axially slidably engaged with shaft 124. Annular pistons 144 and 146 are axially fixed to shaft 124 and are enclosed within cylinders 112 and 114, respectively. Piston 144 fluidly divides the chamber formed by cylinder 112 into a rear chamber 174 and a front chamber 176. Piston 146 fluidly divides the chamber formed by cylinder 114 into a rear chamber 178 and a front chamber 180. Chambers 166, 168, 170, 172, 174, 176, 178, and 180 have varying volumes, depending upon the positions of pistons 140, 142, 144, and 146 therein.

Although two aft propulsion cylinders and two forward propulsion cylinders (along with two corresponding aft pistons and forward pistons) are shown in the illustrated embodiment, any number of aft cylinders and forward cylinders may be provided, which includes only a single aft cylinder and a single forward cylinder. As described below, the hydraulic thrust provided by the EST increases as the number of propulsion cylinders increases. In other words, the hydraulic force provided by the cylinders is additive. Four propulsion cylinders are used to provide the desired thrust of approximately 10,500 pounds for a tractor with a maximum outside diameter of 3.375 inches. It is believed that a configuration having four propulsion cylinders is preferable, because it permits relatively high thrust to be generated, while limiting the length of the tractor. Alternatively, fewer cylinders can be used, which will decrease the resulting maximum tractor pull-thrust. Alternatively, more cylinders can be used, which will increase the maximum output force from the tractor. The number of cylinders is selected to provide sufficient force to provide sufficient force for the anticipated loads for a given hole size.

The EST is hydraulically powered by a fluid such as drilling mud or hydraulic fluid. Unless otherwise indicated, the terms "fluid" and "drilling fluid" are used interchangeably hereinafter. In a preferred embodiment, the EST is powered by the same fluid which lubricates and cools the drill bit. Preferably, drilling mud is used in an open system. This avoids the need to provide additional fluid channels in the tool for the fluid powering the EST. Alternatively, hydraulic fluid may be used in a closed system, if desired. Referring to FIG. 1, in operation, drilling fluid flows from the drill string 30 through EST 100 and down to drill bit 38. Referring again to FIGS. 4A–F, diffuser 148 in control assembly 102 diverts a portion of the drilling fluid to power the EST. Preferably, diffuser 148 filters out larger fluid particles which can damage internal components of the control assembly, such as the valves.

Fluid exiting diffuser 148 enters a spring-biased failsafe valve 150. Failsafe valve 150 serves as an entrance point to a central galley 155 (illustrated as a flow path in FIGS. 4A–F) in the control assembly which communicates with a relief valve 152, packerfoot valve 154, and propulsion valves 156 and 158. When the differential pressure (unless otherwise indicated, hereinafter "differential pressure" or "pressure" at a particular location refers to the difference in pressure at that location from the pressure in annulus 40) of the drilling fluid approaching failsafe valve 150 is below a threshold value, failsafe valve 150 remains in an off position, in which fluid within the central galley vents out to exhaust line E, i.e., to annulus 40. When the differential pressure rises above the threshold value, the spring force is overcome and failsafe valve 150 opens to permit drilling fluid to enter central galley 155. Failsafe valve 150 prevents premature starting of the EST and provides a fail-safe means to shut down the EST by pressure reduction of the drilling fluid in the coiled tubing drill string. Thus, valve 150 operates as a system on/off valve. The threshold value for opening failsafe valve 150, i.e., for turning the system on, is controlled by the stiffness of spring 151 and can be any value within the expected operational drilling pressure range of the tool. A preferred threshold pressure is about 500 psig.

Drilling fluid within central galley 155 is exposed to all of the valves of EST 100. A spring-biased relief valve 152 protects over-pressurization of the fluid within the tool. Relief valve 152 operates similarly to failsafe valve 150. When the fluid pressure in central galley 155 is below a threshold value, the valve remains closed. When the fluid pressure exceeds the threshold, the spring force of spring 153 is overcome and relief valve 152 opens to permit fluid in galley 155 to vent out to annulus 40. Relief valve 152 protects pressure-sensitive components of the EST, such as the bladders of packerfeet 104 and 106, which can rupture at high pressure. In the illustrated embodiment, relief valve 152 has a threshold pressure of about 1600 psig.

Packerfoot valve 154 controls the inflation and deflation of packerfeet 104 and 106. Packerfoot valve 154 has three positions. In a first extreme position (shown in FIG. 4A), fluid from central galley 155 is permitted to flow through passage 210 into aft packerfoot 104, and fluid from forward packerfoot 106 is exhausted through passage 260 to annulus 40. When valve 154 is in this position aft packerfoot 104 tends to inflate and forward packerfoot 106 tends to deflate. In a second extreme position (FIG. 4D), fluid from the central galley is permitted to flow through passage 260 into forward packerfoot 106, and fluid from aft packerfoot 104 is exhausted through passage 210 to annulus 40. When valve 154 is in this position aft packerfoot 104 tends to deflate and forward packerfoot 106 tends to inflate. A central third position of valve 154 permits restricted flow from galley 155 to both packerfeet. In this position, both packerfeet can be inflated for a double-thrust stroke, described below.

In normal operation, the aft and forward packerfeet are alternately actuated. As aft packerfoot 104 is inflated, forward packerfoot 106 is deflated, and vice-versa. The position of packerfoot valve 154 is controlled by a packerfoot motor 160. In a preferred embodiment, motor 160 is electrically controllable and can be operated by a programmable logic component on EST 100, such as in electronics housing 130 (FIGS. 8–12), to sequence the inflation and deflation of the packerfeet. Although the illustrated embodiment utilizes a single packerfoot valve controlling both packerfeet, two valves could be provided such that each valve controls one of the packerfeet. An advantage of a single packerfoot valve is that it requires less space than two valves. An advantage of the two-valve configuration is that each packerfoot can be independently controlled. Also, the packerfeet can be more quickly simultaneously inflated for a double thrust stroke.

Propulsion valve 156 controls the flow of fluid to and from the aft propulsion cylinders 108 and 110. In one extreme position (shown in FIG. 4B), valve 156 permits fluid from central galley 155 to flow through passage 206 to rear chambers 166 and 170. When valve 156 is in this position, rear chambers 166 and 170 are connected to the drilling fluid, which is at a higher pressure than the rear chambers. This causes pistons 140 and 142 to move toward the downhole ends of the cylinders due to the volume of incoming fluid. Simultaneously, front chambers 168 and 172 reduce in volume, and fluid is forced out of the front chambers through passage 208 and valve 156 out to annulus 40. If packerfoot 104 is inflated to grip borehole wall 42, the pistons move downhole relative to wall 42. If packerfoot 104 is deflated, then cylinders 108 and 110 move uphole relative to wall 42.

In its other extreme position (FIG. 4E), valve 156 permits fluid from central galley 155 to flow through passage 208 to front chambers 168 and 172. When valve 156 is in this position, front chambers 168 and 172 are connected to the drilling fluid, which is at a higher pressure than the front chambers. This causes pistons 140 and 142 to move toward the uphole ends of the cylinders due to the volume of incoming fluid. Simultaneously, rear chambers 166 and 170 reduce in volume, and fluid is forced out of the rear chambers through passage 206 and valve 156 out to annulus 40. In a central position propulsion valve 156 blocks any fluid communication between cylinders 108 and 110, galley 155, and annulus 40. If packerfoot 104 is inflated to grip borehole wall 42, the pistons move uphole relative to wall 42. If packerfoot 104 is deflated, then cylinders 108 and 110 move downhole relative to wall 42.

Propulsion valve 158 is configured similarly to valve 156. Propulsion valve 158 controls the flow of fluid to and from the forward propulsion cylinders 112 and 114. In one extreme position (FIG. 4E), valve 158 permits fluid from central galley 155 to flow through passage 234 to rear chambers 174 and 178. When valve 156 is in this position, rear chambers 174 and 178 are connected to the drilling fluid, which is at a higher pressure than the rear chambers. This causes the pistons 144 and 146 to move toward the downhole ends of the cylinders due to the volume of incoming fluid. Simultaneously, front chambers 176 and 180 reduce in volume, and fluid is forced out of the front chambers through passage 236 and valve 158 out to annulus 40. If packerfoot 106 is inflated to grip borehole wall 42, the pistons move downhole relative to wall 42. If packerfoot 106 is deflated, then cylinders 108 and 110 move uphole relative to wall 42.

In its other extreme position (FIG. 4B), valve 158 permits fluid from central galley 155 to flow through passage 236 to front chambers 176 and 180 are connected to the drilling fluid, which is at a higher pressure than rear chambers 174 and 178. This causes the pistons 144 and 146 to move toward the uphole ends of the cylinders due to the volume of incoming fluid. Simultaneously, rear chambers 174 and 178 reduce in volume, and fluid is forced out of the rear chambers through passage 234 and valve 158 out to annulus 40. If packerfoot 106 is inflated to grip borehole wall 42, the pistons move uphole relative to wall 42. If packerfoot 106 is deflated, then cylinders 108 and 110 move downhole relative to wall 42. In a central position, propulsion valve 158 blocks any fluid communication between cylinders 112 and 114, galley 155, and annulus 40.

In a preferred embodiment, propulsion valves 156 and 158 are configured to form a controllable variable flow restriction between central galley 155 and the chambers of the propulsion cylinders. The physical configuration of valves 156 and 158 is described below. To illustrate the advantages of this feature, consider valve 156. As valve 156 deviates slightly from its central position, it permits a limited volume flowrate from central galley 155 into the aft propulsion cylinders. The volume flowrate can be precisely increased or decreased by varying the flow restriction, i.e., by opening further or closing further the valve. By carefully positioning the valve, the volume flowrate of fluid into the aft propulsion cylinders can be controlled. The flow-restricting positions of the valves are indicated in FIGS. 4A–F by flow lines which intersect X's. The flow-restricting positions permit precise control over (1) the longitudinal hydraulic force received by the pistons; (2) the longitudinal position of the pistons within the aft propulsion cylinders; and (3) the rate of longitudinal movement of the pistons between positions. Propulsion valve 158 may be similarly configured, to permit the same degree of control over the forward propulsion cylinders and pistons. As will be shown below, controlling these attributes facilitates enhanced control of the thrust and speed of the EST and, hence, the drill bit.

In a preferred embodiment, the position of propulsion valve 156 is controlled by an aft propulsion motor 162, and the position of propulsion valve 158 is controlled by a forward propulsion motor 164. Preferably, these motors are electrically controllable and can be operated by a programmable logic component on EST 100, such as in electronics unit 92 (FIG. 3), to precisely control the expansion and contraction of the rear and front chambers of the aft and forward propulsion cylinders.

Figure 4A:
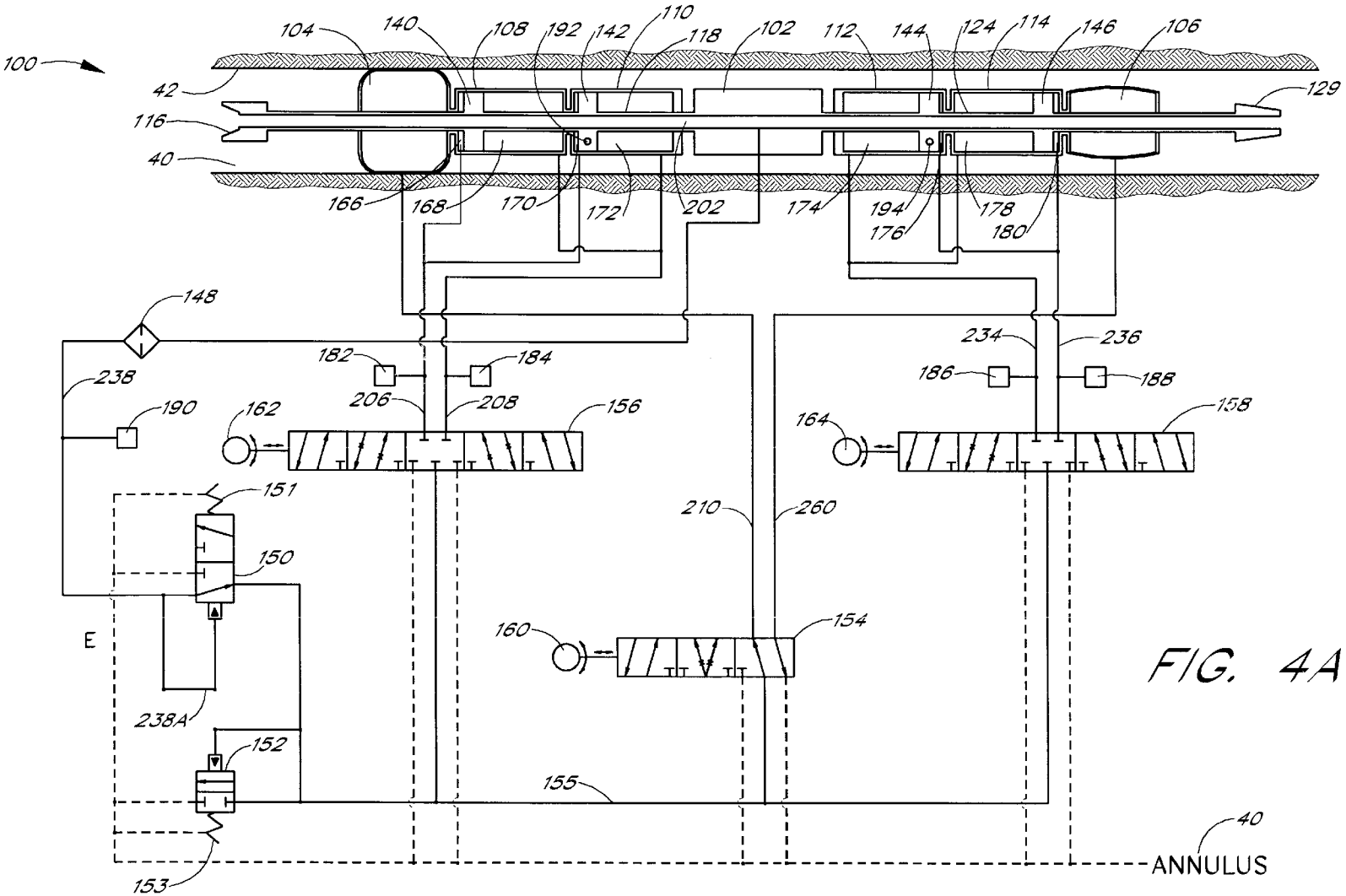
FIGS. 4A–F are schematic diagrams illustrating an operational cycle of the EST.
Figure 4B:
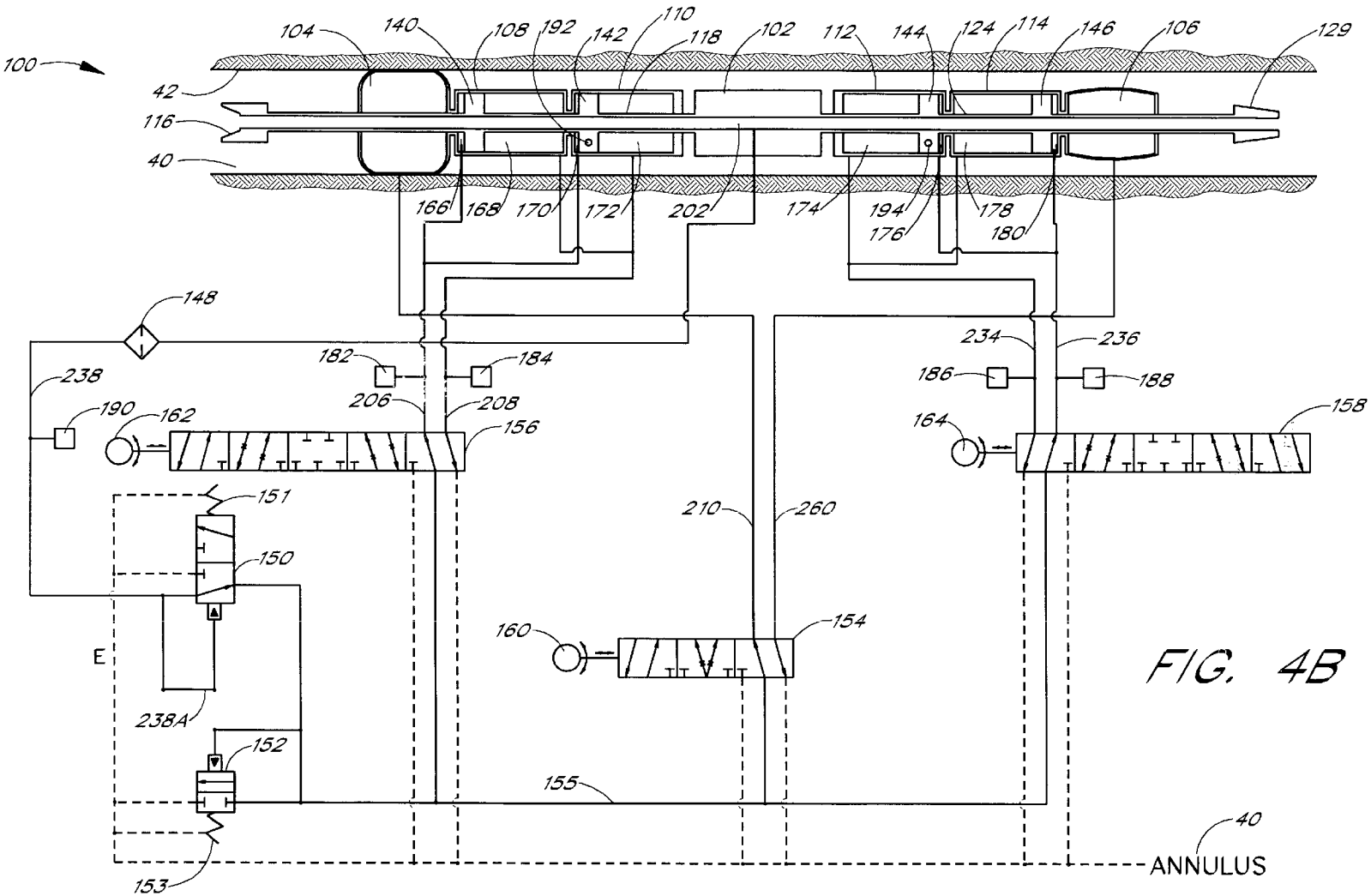
Figure 4C:
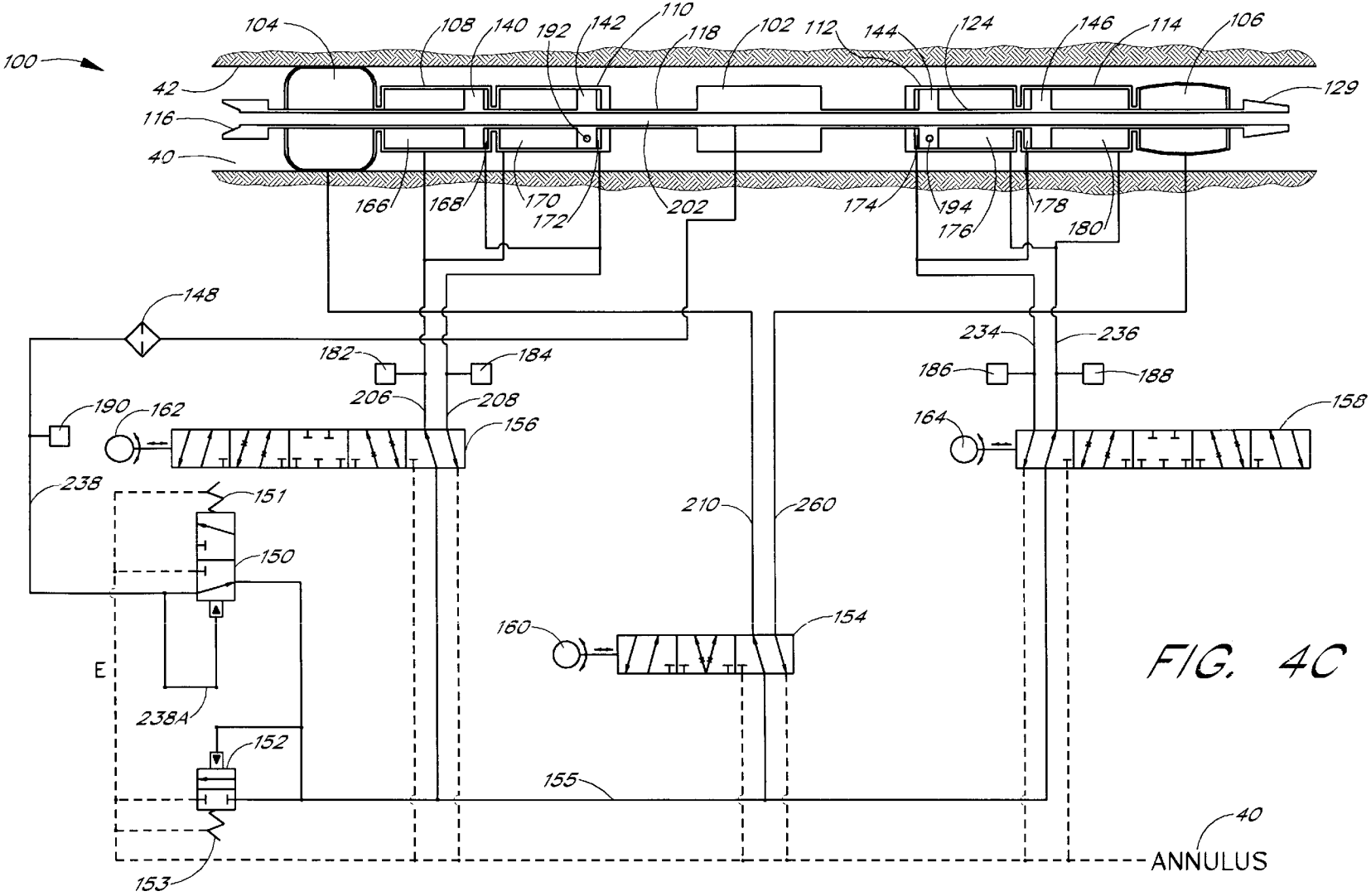

The above-described configuration of the EST permits greatly improved control over tractor thrust, speed, and direction of travel. EST 100 can be moved downhole according to the cycle illustrated in FIGS. 4A–F. As shown in FIG. 4A, packerfoot valve 154 is shuttled to a first extreme position, permitting fluid to flow from central galley 155 to aft packerfoot 104, and also permitting fluid to be exhausted from forward packerfoot 106 to annulus 40. Aft packerfoot 104 inflates and grips borehole wall 42, anchoring aft propulsion cylinders 108 and 110. Forward packerfoot 106 deflates, so that forward propulsion cylinders 112 and 114 are free to move axially with respect to borehole wall 42. Next, as shown in FIG. 4B, propulsion valve 156 is moved toward its first extreme position, permitting fluid to flow from central galley 155 into rear chambers 166 and 170, and also permitting fluid to be exhausted from front chambers 168 and 172 to annulus 40. The incoming fluid causes rear chambers 166 and 170 to expand due to hydraulic force. Since cylinders 108 and 110 are fixed with respect to borehole wall 42, pistons 140 and 142 are forced downhole to the forward ends of the pistons, as shown in FIG. 4C. Since the pistons a fixed to shaft 118 of the EST body, the forward movement of the pistons propels the EST body downhole. This is known as a power stroke.

Simultaneously or independently to the power stroke of the aft pistons 140 and 142, propulsion valve 158 is moved to its second extreme position, shown in FIG. 4B. This permits fluid to flow from central galley 155 into front chambers 176 and 180, and from rear chambers 174 and 178 to annulus 40. The incoming fluid causes front chambers 176 and 180 to expand due to hydraulic force. Accordingly, forward propulsion cylinders 112 and 114 move downhole with respect to the pistons 144 and 146, as shown in FIG. 4C. This is known as a reset stroke.

Figure 4D:
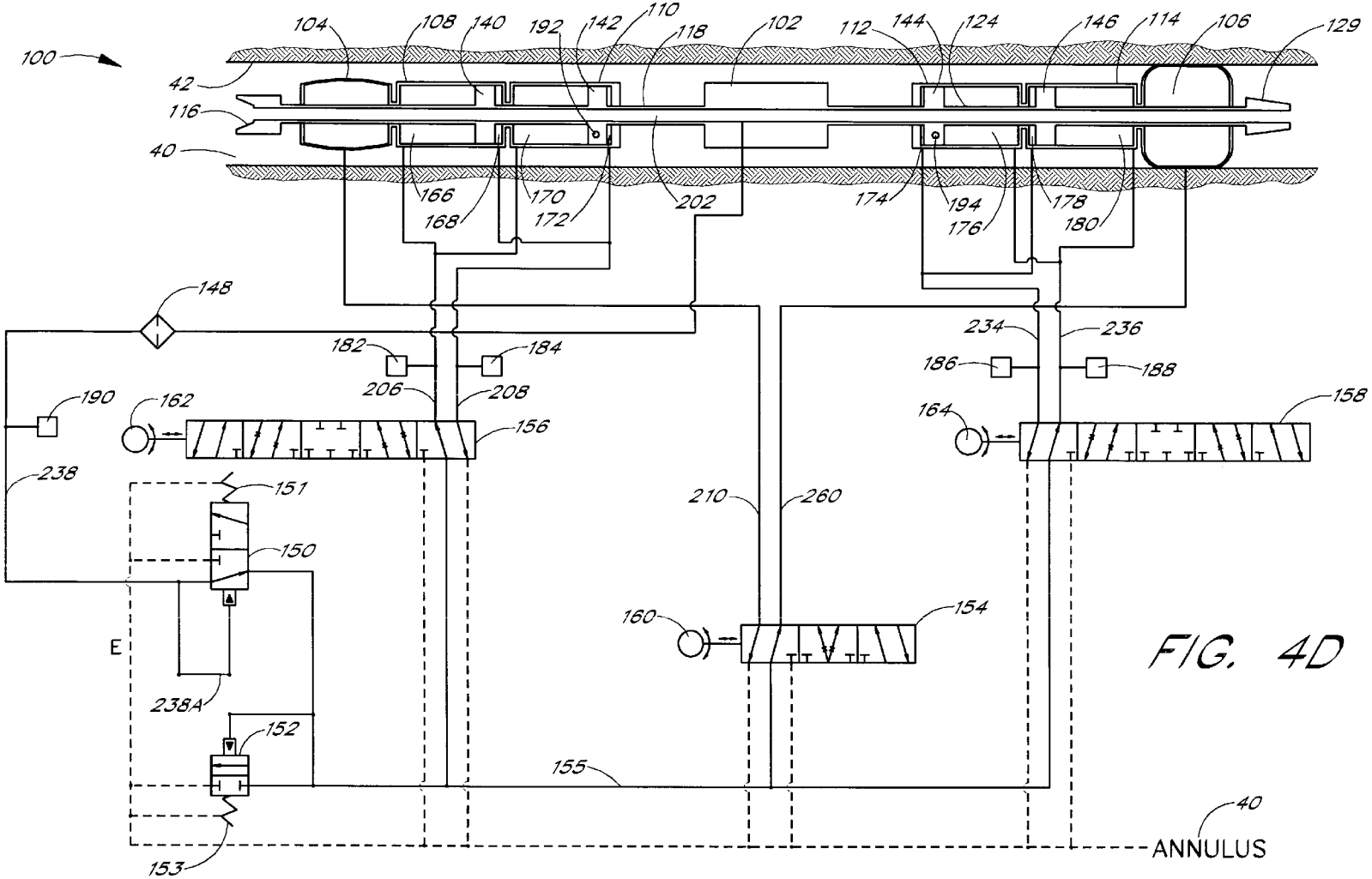
Figure 4E:
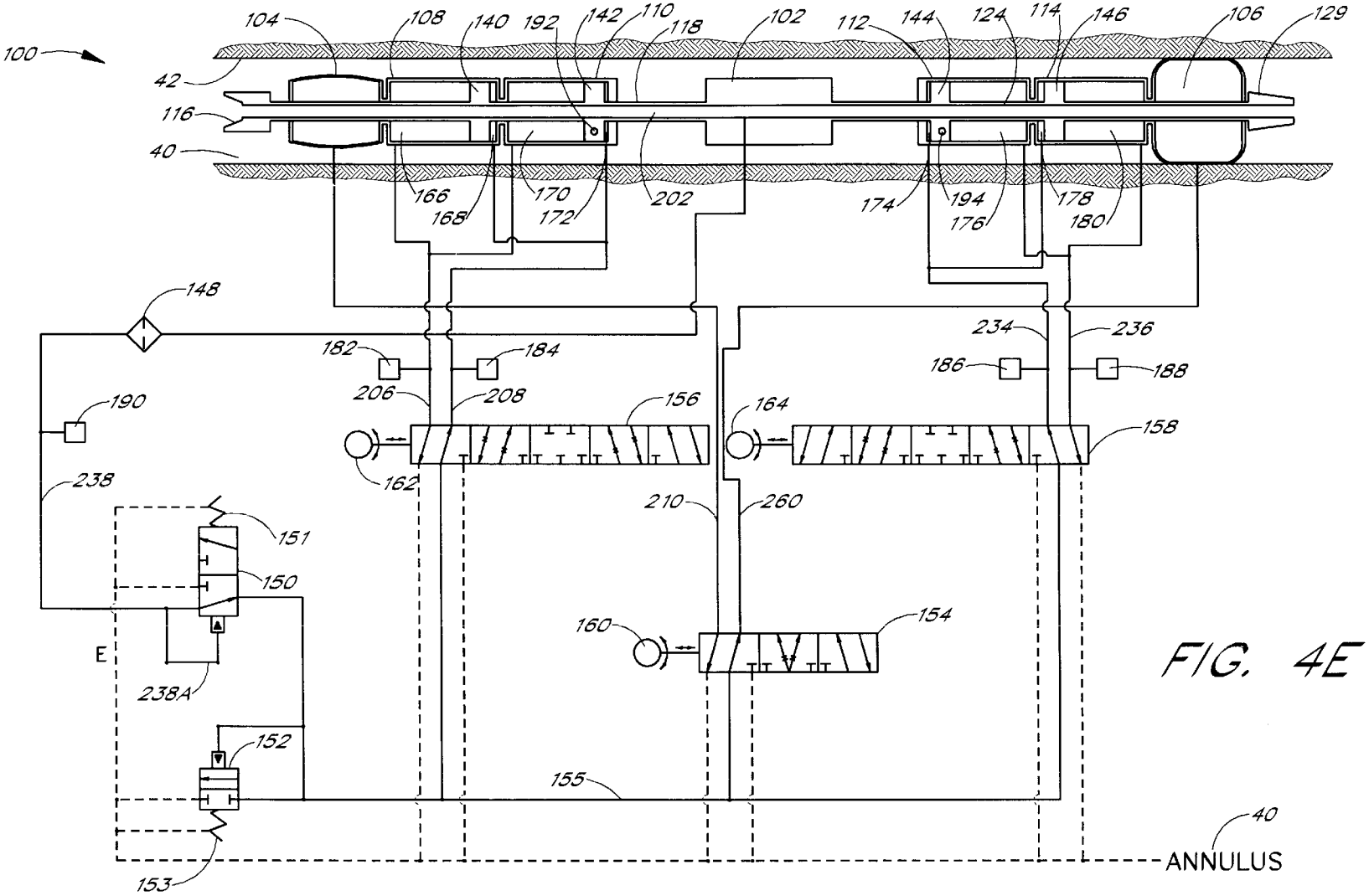
Figure 4F:
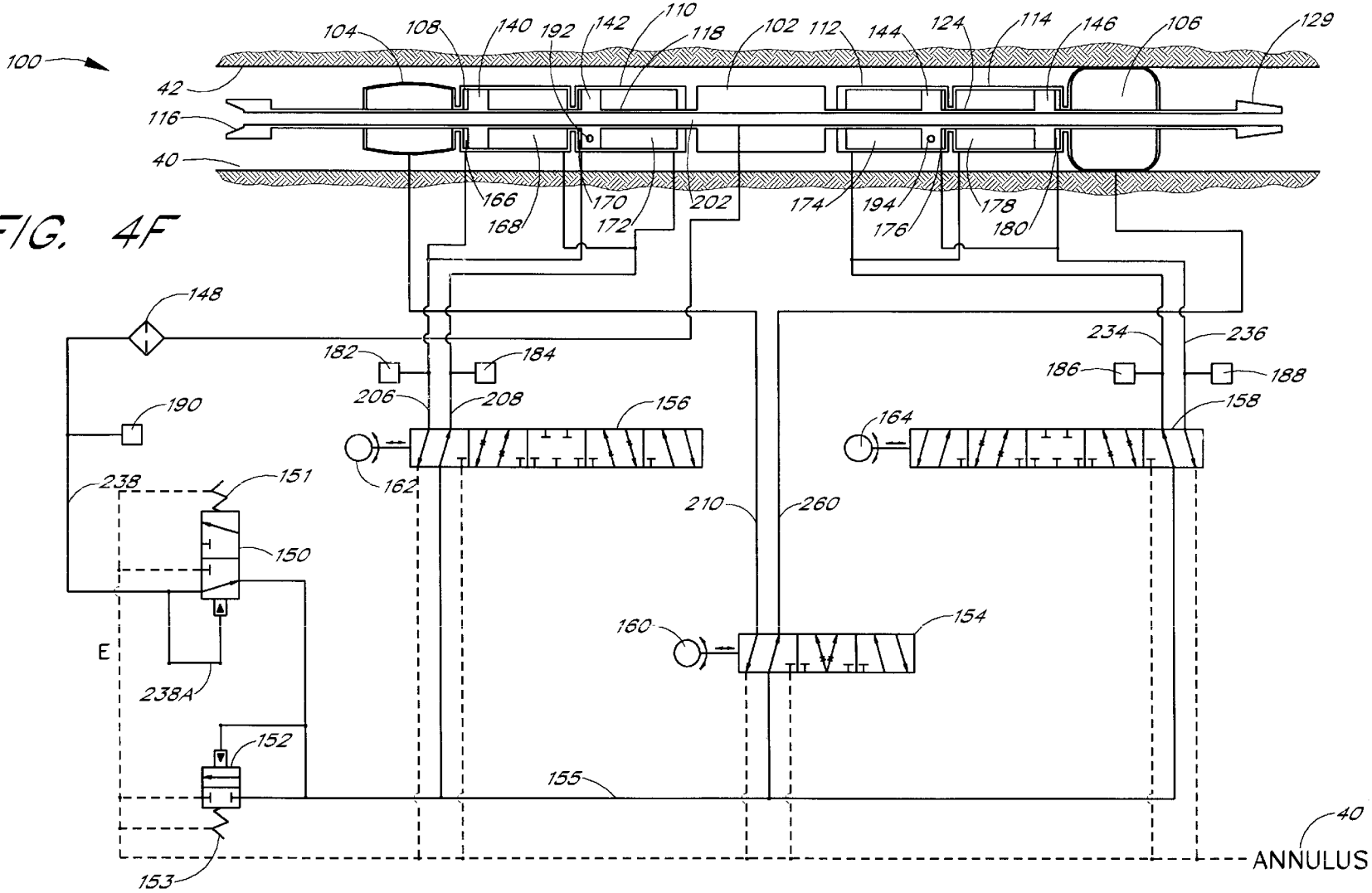

After the aft propulsion cylinders complete a power stroke and the forward propulsion cylinders complete a reset stroke, packerfoot valve 154 is shuttled to its second extreme position, shown in FIG. 4D. This causes forward packerfoot 106 to inflate and grip borehole wall 42, and also causes aft packerfoot 104 to deflate. Then, propulsion valves 156 and 158 are reversed, as shown in FIG. 4E. This causes cylinders 112 and 114 to execute a power stroke and also causes the cylinders 108 and 110 to execute a reset stroke, shown in FIG. 4F. Packerfoot valve 154 is then shuttled back to its first extreme position, and the cycle repeats.

Those skilled in the art will understand that EST 100 can move in reverse, i.e., uphole, simply by reversing the sequencing of packerfoot valve 154 or propulsion valves 156 and 158. When packerfoot 104 is inflated to grip borehole wall 42, propulsion valve 156 is positioned to deliver fluid to front chambers 168 and 172. The incoming fluid imparts an uphole hydraulic force on pistons 140 and 142, causing cylinders 108 and 110 to execute an uphole power stroke. Simultaneously, propulsion valve 158 is positioned to deliver fluid to rear chambers 174 and 178, so that cylinders 112 and 114 execute a reset stroke. Then, packerfoot valve 154 is moved to inflate packerfoot 106 and deflate packerfoot 104. Then the propulsion valves are reversed so that cylinders 112 and 114 execute an uphole power stroke while cylinders 108 and 110 execute a reset stroke. Then, the cycle is repeated.

Advantageously, the EST can reverse direction prior to reaching the end of any particular power or reset stroke. The tool can be reversed simply by reversing the positions of the propulsion valves so that hydraulic power is provided on the opposite sides of the annular pistons in the propulsion cylinders. This feature prevents damage to the drill bit which can be caused when an obstruction is encountered in the formation.

The provision of separate valves controlling (1) the inflation of the packerfeet, (2) the delivery of hydraulic power to the aft propulsion cylinders, and (3) the delivery of hydraulic power to the forward propulsion cylinders permits a dual power stroke operation and, effectively, a doubling of axial thrust to the EST body. For example, packerfoot valve 154 can be moved to its central position to inflate both packerfeet 104 and 106. Propulsion valves 156 and 158 can then be positioned to deliver fluid to the rear chambers of their respective propulsion cylinders. This would result in a doubling of downhole thrust to the EST body. Similarly, the propulsion valves can also be positioned to deliver fluid to the front chambers of the propulsion cylinders, resulting in double uphole thrust. Double thrust may be useful when penetrating harder formations.

As mentioned above, packerfoot valve motor 160 and propulsion valve motors 162 and 164 may be controlled by an electronic control system. In one embodiment, the control system of the EST includes a surface computer, electric cables (fiber optic or wire), and a programmable logic component 224 (FIG. 69) located in electronics housing 130. Logic component 224 may comprise electronic circuitry, a microprocessor, EPROM and/or tool control software. The tool control software is preferably provided on a programmable integrated chip (PIC) on an electronic control board. The control system operates as follows: An operator places commands at the surface, such as desired EST speed, direction, thrust, etc. Surface software converts the operator's commands to electrical signals that are conveyed downhole through the electric cables to logic component 224. The electric cables are preferably located within the composite coiled tubing and connected to electric wires within the EST that run to logic component 224. The PIC converts the operator's electrical commands into signals which control the motors.

As part of its control algorithm, logic component 224 can also process various feedback signals containing information regarding tool conditions. For example, logic component 224 can be configured to process pressure and position signals from pressure transducers and position sensors throughout the EST, a weight on bit (WOB) signal from a sensor measuring the load on the drill bit, and/or a pressure signal from a sensor measuring the pressure difference across the drill bit. In a preferred embodiment, logic component 224 is programmed to intelligently operate valve motors 160, 162, and 164 to control the valve positions, based at least in part upon one or both of two different properties—pressure and displacement. From pressure information the control system can determine and control the thrust acting upon the EST body. From displacement information, the control system can determine and control the speed of the EST. In particular, logic component 224 can control the valve motors in response to (1) the differential pressure of fluid in the rear and front chambers of the propulsion cylinders and in the entrance to the failsafe valve, (2) the positions of the annular pistons with respect to the propulsion cylinders, or (3) both.

The actual command logic and software for controlling the tractor will depend on the desired performance characteristics of the tractor and the environment in which the tractor is to be used. Once the performance characteristics are determined, it is believed that one skilled in the art can readily determine the desired logical sequences and software for the controller. It is believed that the structure and methods disclosed herein offer numerous advantages over the prior art, regardless of the performance characteristics and software selected. Accordingly, while a prototype of the invention uses a particular software program (developed by Halliburton Company of Dallas, Tex.), it is believed that a wide variety of software could be used to operate the system.

Pressure transducers 182, 184, 186, 188, and 190 may be provided on the tool to measure the differential fluid pressure in (1) rear chambers 166 and 170, (2) front chambers 168 and 172, (3) rear chambers 174 and 178, (4) front chambers 176 and 180, and (5) in the entrance to failsafe valve 150, respectively. These pressure transducers send electrical signals to logic component 224, which are proportional to the differential fluid pressure sensed. In addition, as shown in FIGS. 4A–F, displacement sensors 192 and 194 may be provided on the tool to measure the positions of the annular pistons with respect to the propulsion cylinders. In the illustrated embodiment, sensor 192 measures the axial position of piston 140 with respect to cylinder 110, and sensor 194 measures the axial position of piston 144 with respect to cylinder 112. Sensors 192 and 194 can also be positioned on pistons 140 and 146, or additional displacement sensors can be provided if desired.

Rotary accelerometers or potentiometers are preferably provided to measure the rotation of the motors. By monitoring the rotation of the motors, the positions of the motorized valves 154, 156, and 158 can be determined. Like the signals from the pressure transducers and displacement sensors, the signals from the rotary accelerometers or potentiometers are fed back to logic component 224 for controlling the valve positions.

Detailed Structure of the EST

The major subassemblies of the EST are the aft section, the control assembly, and the forward section. Referring to FIG. 2, the major components of the aft section comprise shaft 118, aft packerfoot 104, aft propulsion cylinders 108 and 110, connectors 120 and 122, and aft transition housing 131. The aft section includes a central conduit for transporting drilling fluid supply from the drill string to control assembly 102 and to the drill bit. The aft section also includes passages for fluid flow between control assembly 102 and aft packerfoot 104 and aft propulsion cylinders 108 and 110. The aft section further includes at least one passage for wires for transmission of electrical signals between the ground surface, control assembly 102, and the bottom hole assembly. A drill string connector 116 is attached to the aft end of the aft section, for fluidly connecting a coiled tubing drill string to shaft 118, as known in the art.

The forward section is structurally nearly identical to the aft section, with the exceptions that the components are inverted in order and the forward section does not include an aft transition housing. The forward section comprises shaft 124, forward propulsion cylinders 112 and 114, connectors 126 and 128, and forward packerfoot 106. The forward section includes a central conduit for transporting drilling fluid supply to the drill bit. The forward section also includes passages for fluid flow between control assembly 102 and forward packerfoot 106 and forward propulsion cylinders 112 and 114. The forward section further includes at least one passage for wires for transmission of electrical signals between the ground surface, control assembly 102, and the bottom hole assembly. A connector 129 is attached to the forward end of the forward section, for connecting shaft 124 to downhole components such as the bottom hole assembly, as known in the art.

Control Assembly

Figure 3:
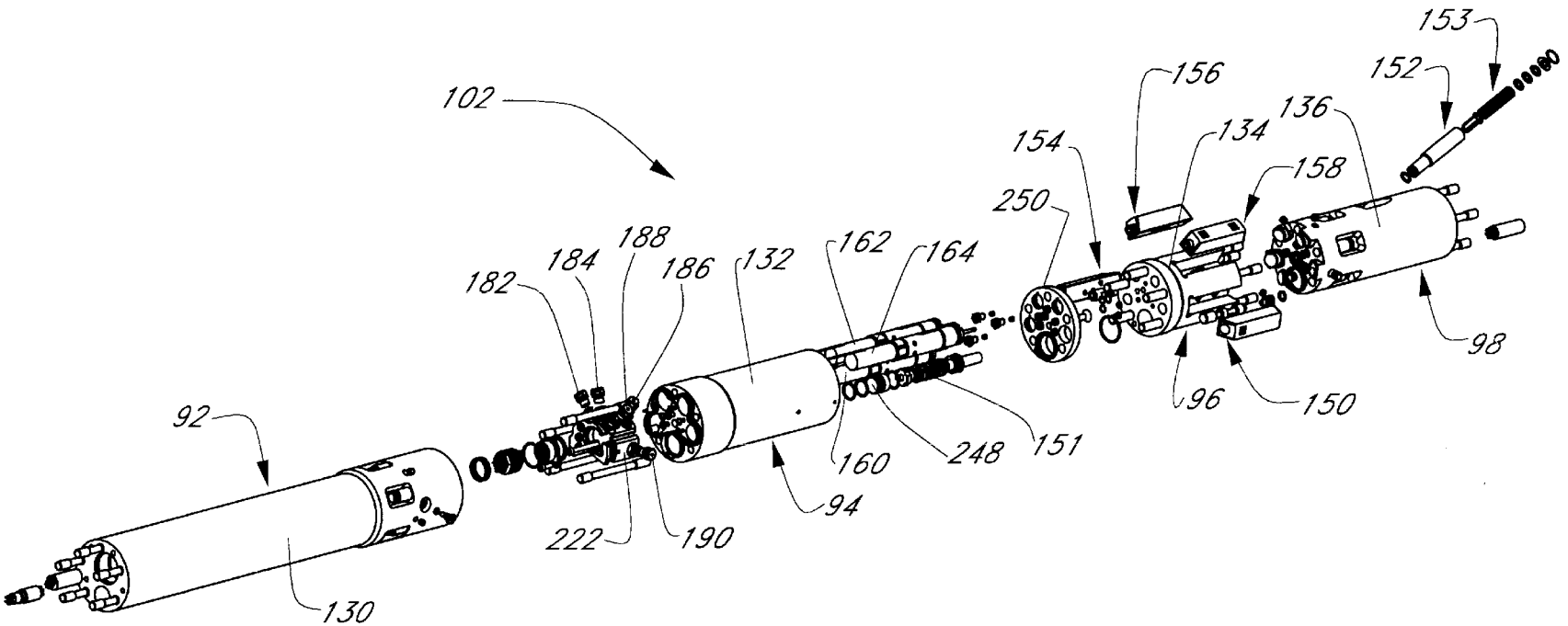
FIG. 3 is a rear perspective view of the control assembly of the EST.

Referring to FIGS. 2 and 3, control assembly 102 comprises an aft transition housing 131 (FIG. 2), electronics unit 92, motor unit 94, valve unit 96, and forward transition unit 98. Electronics unit 92 includes an electronics housing 130 which contains electronic components, such as logic component 224, for controlling the EST. Motor unit 94 includes a motor housing 132 which contains motors 160, 162, and 164. These motors control packerfoot valve 154 and propulsion valves 156 and 158, respectively. Valve unit 96 includes a valve housing 134 containing these valves, as well as failsafe valve 150. Forward transition unit 98 includes a forward transition housing 136 which contains diffuser 148 (not shown) and relief valve 152.

Figure 5:
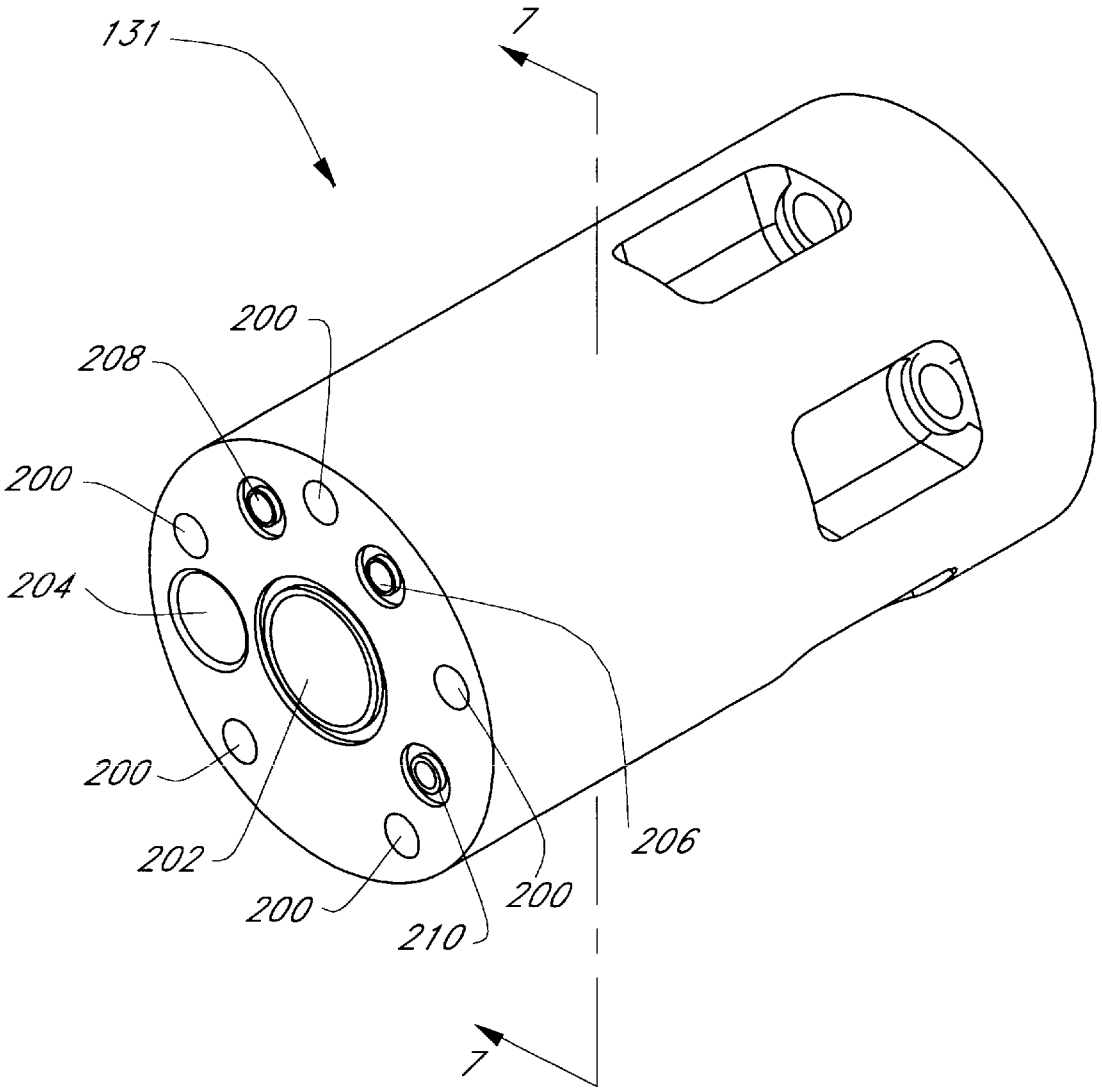
FIG. 5 is a rear perspective view of the aft transition housing of the EST.
Figure 6:
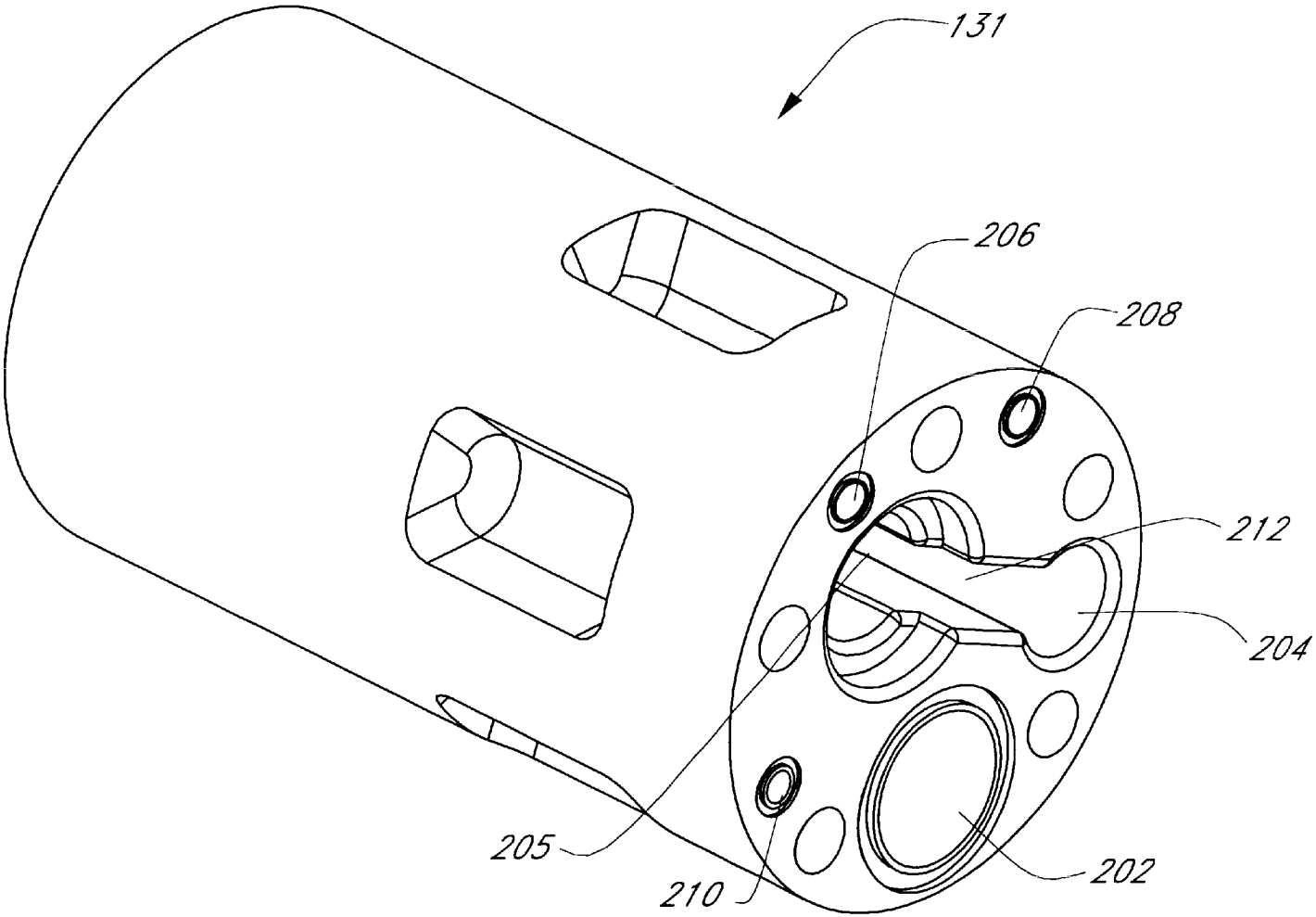
FIG. 6 is a front perspective view of the aft transition housing of FIG. 5.
Figure 7:
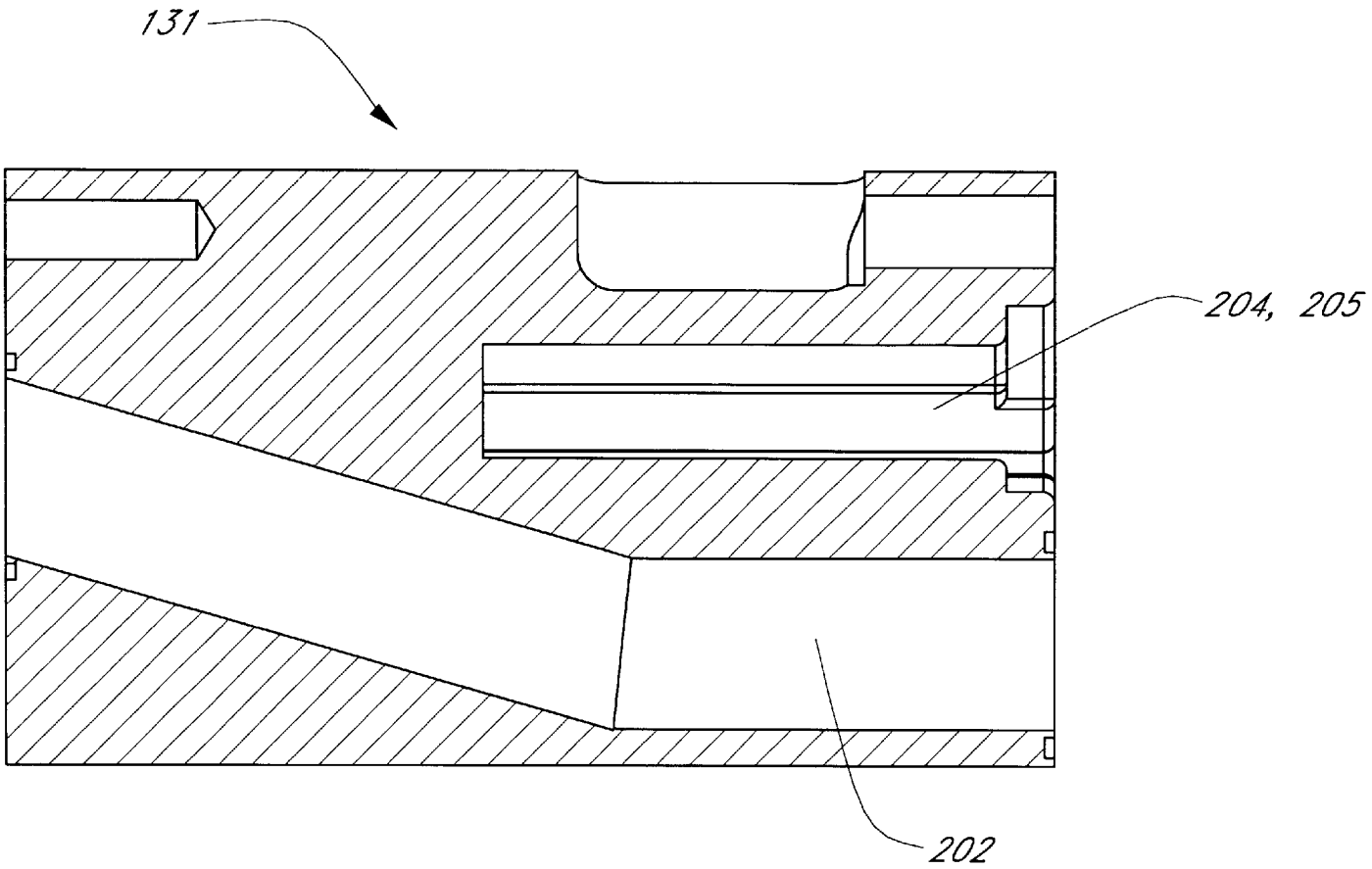
FIG. 7 is a sectional view of the aft transition housing, taken along line 7—7 of FIG. 5.
Figure 8:
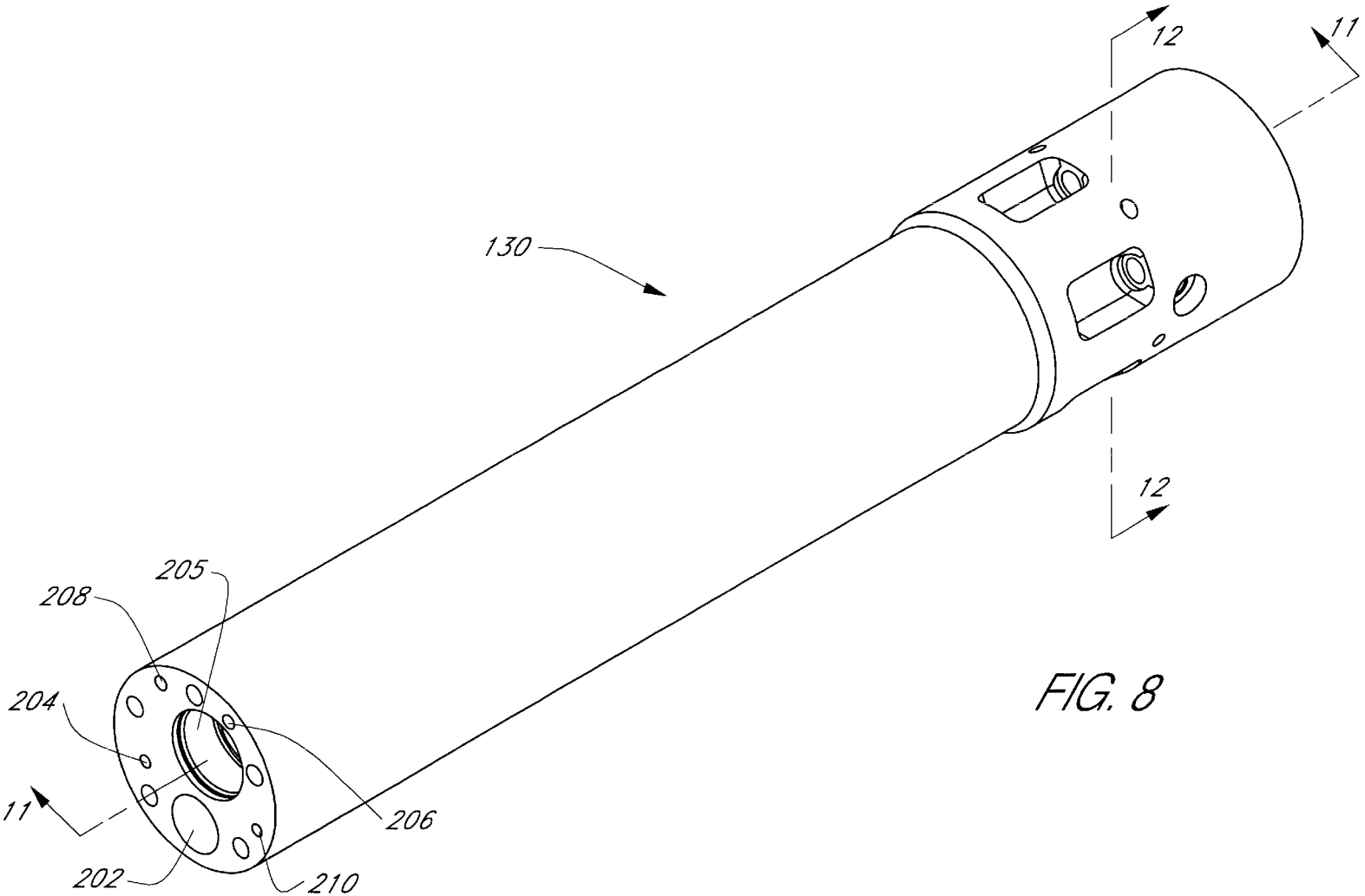
FIG. 8 is a rear perspective view of the electronics housing of the EST.
Figure 49B:
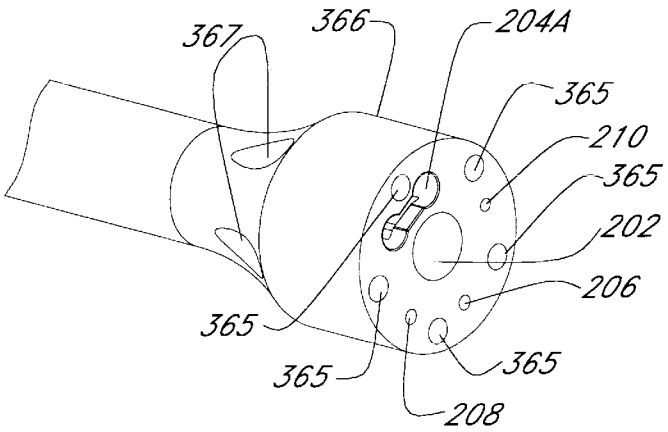
FIG. 49B is an exploded view of the forward end of the aft shaft shown in FIG. 49A.

The first component of control assembly 102 is aft transition unit 90. Aft transition housing 131 is shown in FIGS. 5–7. Housing 131 is connected to and is supplied with drilling fluid from shaft 118. Housing 131 shifts the drilling fluid supply from the center of the tool to a side, to provide space for an electronics package 224 in electronics unit 92. FIG. 5 shows the aft end of housing 131, and FIG. 6 shows its forward end. The aft end of housing 131 attaches to flange 366 (FIGS. 49A–B) on shaft 118. In particular, housing 131 has pentagonally arranged threaded connection bores 200 which align with similar bores 365 in flange 366. High strength connection studs or bolts are received within bores 365 and bores 200 to secure the flange and housing 131 together. Flange 366 has recesses 367 through which nuts can be fastened onto the aft ends of the connection studs, against surfaces of recesses 367. Suitable connection bolts are MP33 non-magnetic bolts, which are high in strength, elongation, and toughness. At its forward end, housing 131 is attached to electronics housing 130 in a similar manner, which therefore need not be described in detail. Furthermore, all of the adjacent housings may be attached to each other and to the shafts in a like or similar manner, and, therefore, also need not be described in detail.

It will be appreciated that the components of the EST include numerous passages for transporting drilling fluid and electrical wires through the tool. Aft transition housing 131 includes several longitudinal bores which comprise a portion of these passages. Lengthwise passage 202 transports the drilling fluid supply (from the drill string) downhole. As shown in FIG. 7, passage 202 shifts from the center axis of the tool at the aft end of housing 131 to an offcenter position at the forward end. Longitudinal wire passage 204 is provided for electrical wires. A longitudinal wire passage 205 is provided in the forward end of housing 131, extending about half of the length of the housing. Passages 204 and 205 communicate through an elongated opening 212 in housing 131. In a preferred embodiment, wires from the surface are separated at opening 212 and connected to a 7-pin boot 209 (FIG. 69) and a 10-pin boot 211. Boots 209 and 211 fit into passages 204 and 205, respectively, at the forward end of housing 131 and connect to corresponding openings in electronics housing 132. Passage 206 permits fluid communication between aft propulsion valve 156 and rear chambers 166 and 170 of aft propulsion cylinders 108 and 110. Passage 208 permits fluid communication between valve 156 and front chambers 168 and 172 of cylinders 108 and 110. Passage 210 permits fluid communication between packerfoot valve 154 and aft packerfoot 104.

FIGS. 8–12 show electronics housing 130 of electronics unit 92, which contains an electronic logic component or package 224. Housing 130 includes longitudinal bores for passages 202, 204, 205, 206, 208, and 210. Electronics package 224 resides in a large diameter portion of passage 205 inside housing 130. The above-mentioned 10-pin boot 211 at the forward end of aft transition housing 131 is connected to electronics package 224. Passage 205 is preferably sealed at the aft and forward ends of electronics housing 130 to prevent damage to electronics package 224 caused by exposure to high pressure from annulus 40, which can be as high as 16,000 psi. A suitable seal, rated at 20,000 psi, is sold by Green Tweed, Inc., having offices in Houston, Tex. Preferably, housing 130 is constructed of a material which is sufficiently heat-resistant to protect electronics package 224 from damage which can be caused by exposure to high downhole temperatures. A suitable material is Stabaloy AG 17.

Figure 9:
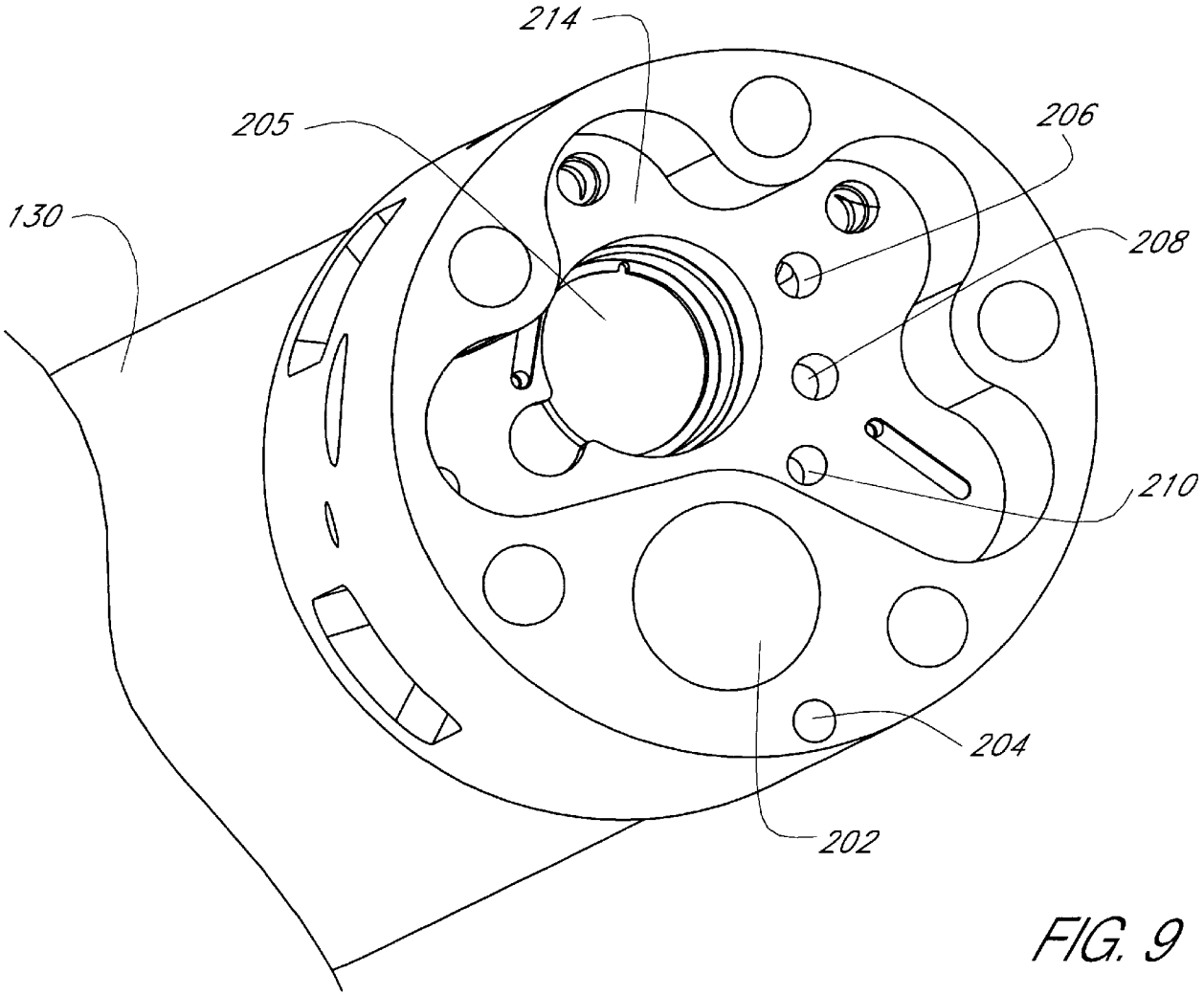
FIG. 9 is a front perspective view of the forward end of the electronics housing of FIG. 8.
Figure 11:
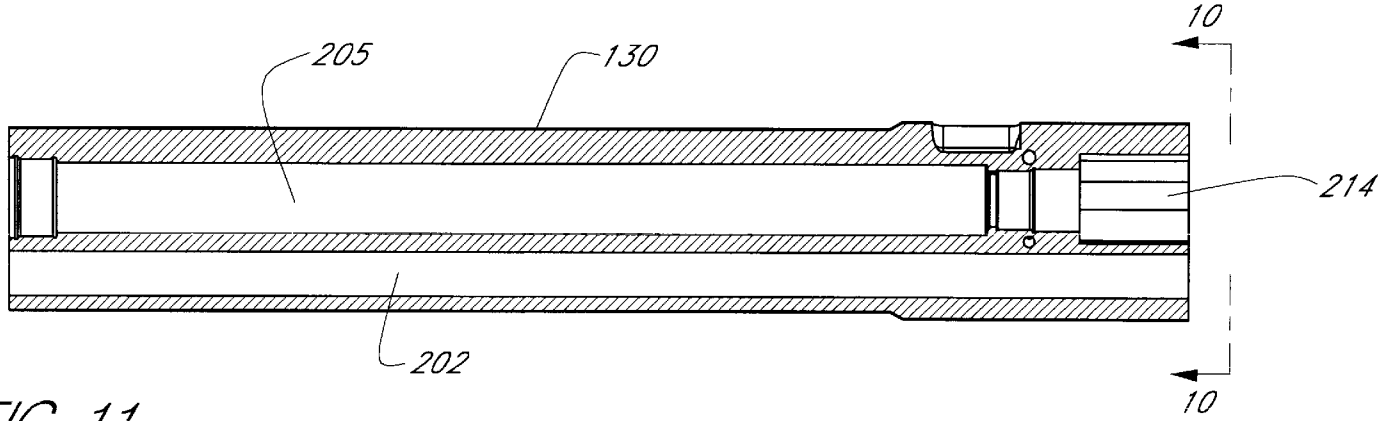
FIG. 11 is a longitudinal sectional view of the electronics housing, taken along line 11—11 of FIG. 8.
Figure 10:
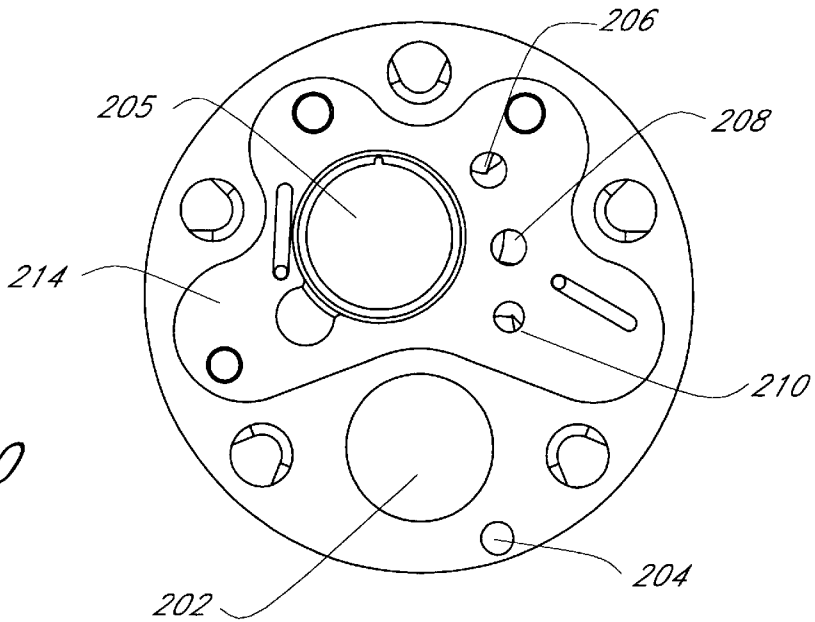
FIG. 10 is a front view of the electronics housing of FIG. 8.
Figure 12:
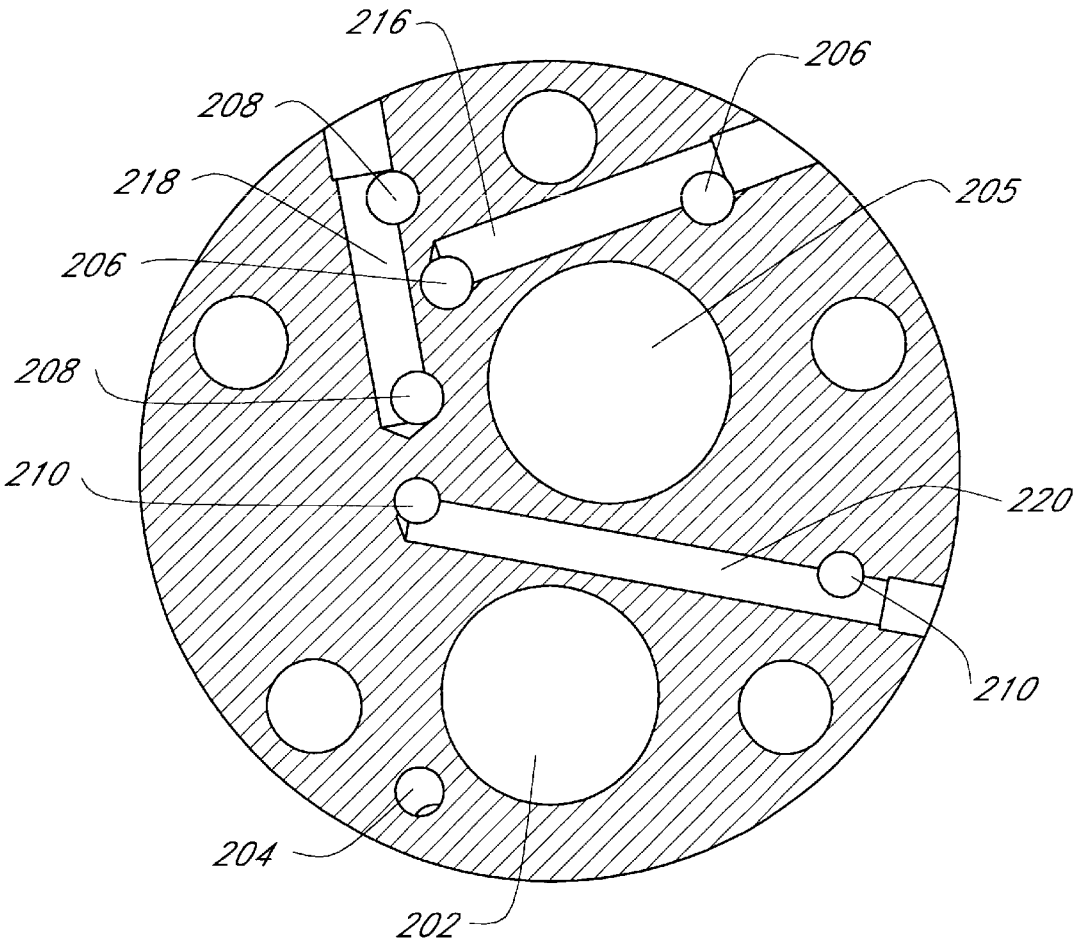
FIG. 12 is a cross-sectional view of the electronics housing, taken along line 12—12 of FIG. 8.
Figure 13:
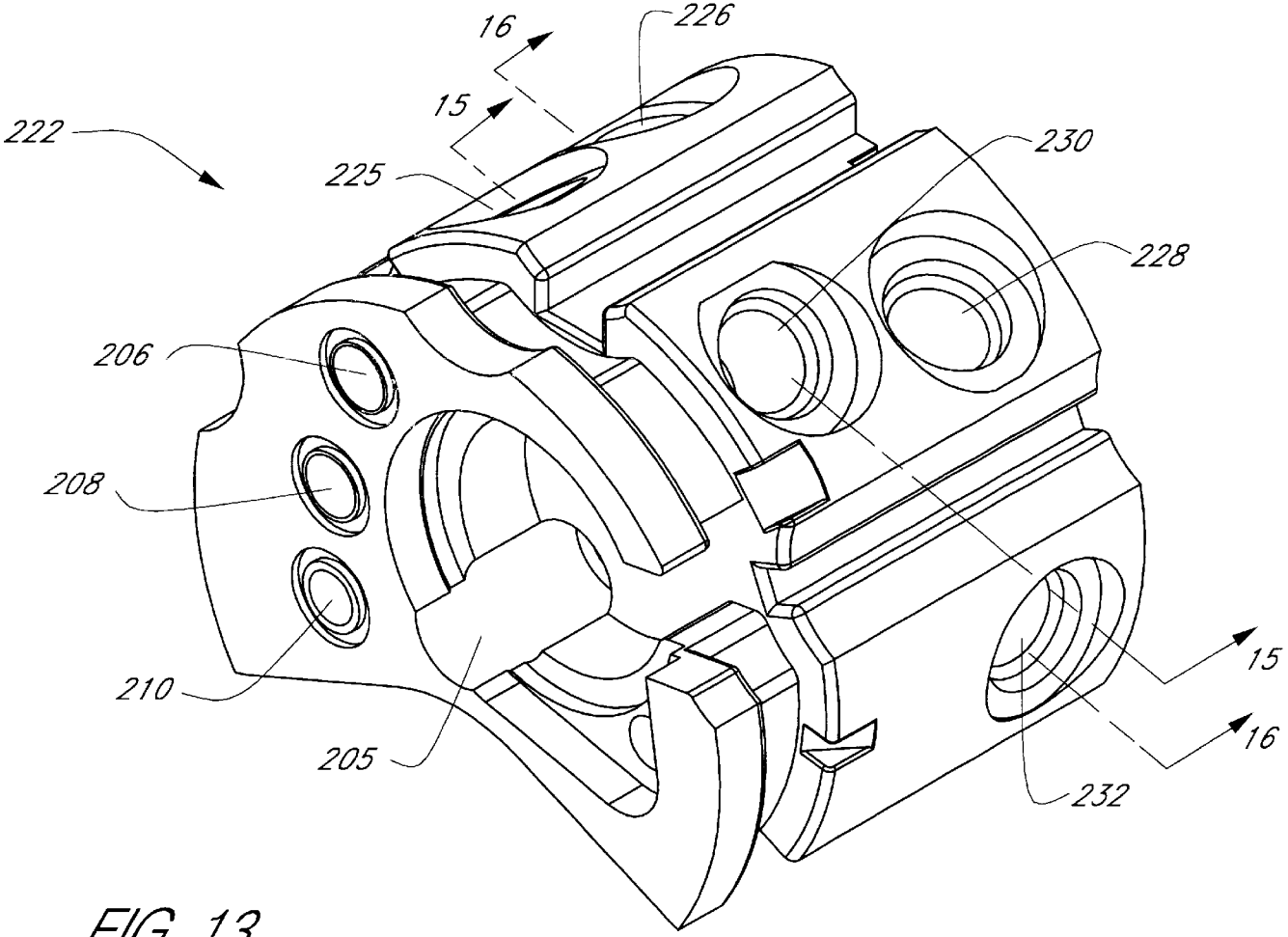
FIG. 13 is a rear perspective view of the pressure transducer manifold of the EST.
Figure 14:
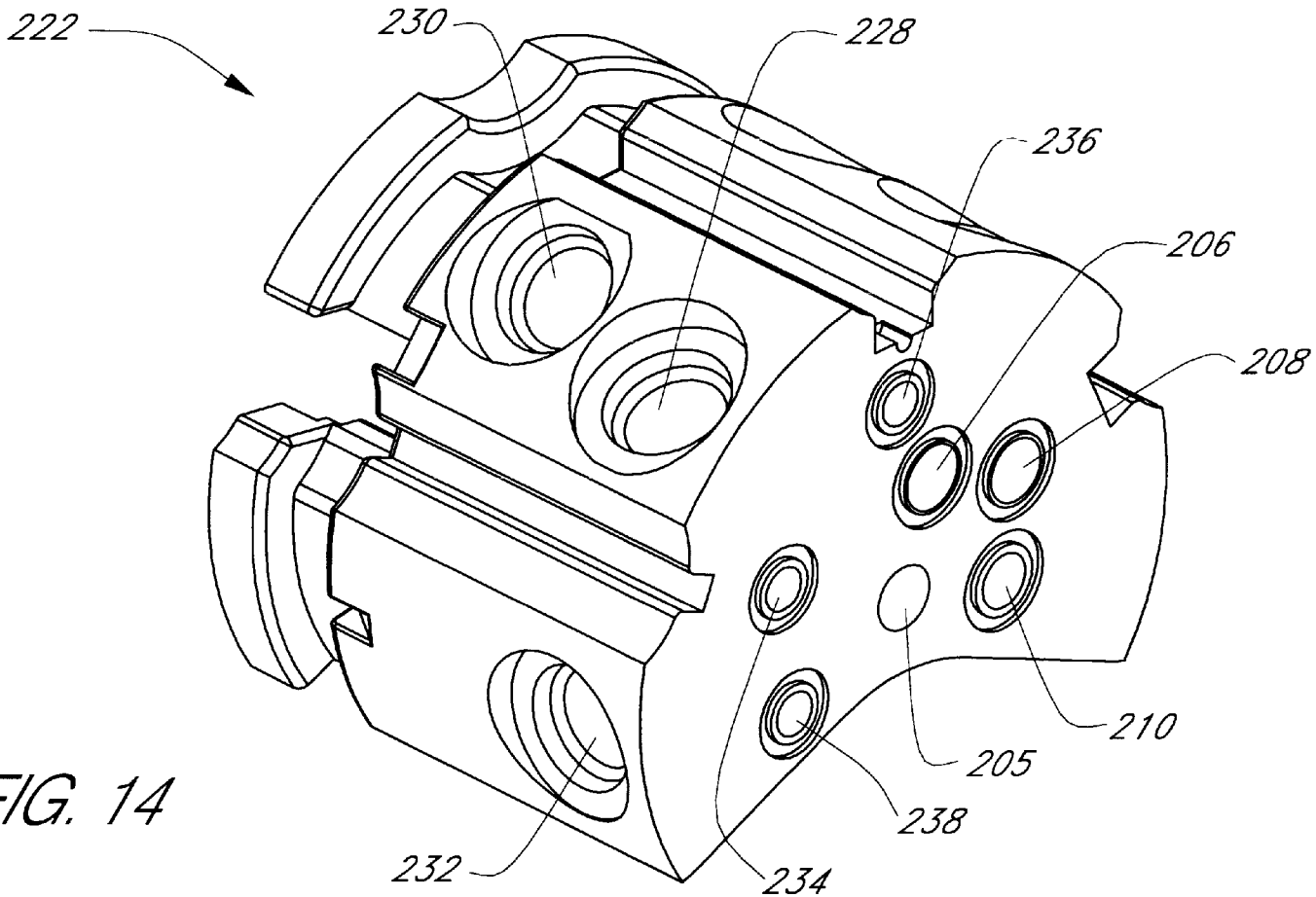
FIG. 14 is a front perspective view of the pressure transducer manifold of FIG. 13.

As shown in FIGS. 9 and 11, a recess 214 is provided in the forward end of electronics housing 130, for receiving a pressure transducer manifold 222 (FIGS. 13–16) which includes pressure transducers 182, 184, 186, 188, and 190 (FIG. 3). Passages 206, 208, and 210 are shifted transversely toward the central axis of electronics housing 130 to make room for the pressure transducers. Referring to FIG. 12, transverse shift bores 216, 218, and 220 are provided to shift passages 206, 208, and 210, respectively, to their forward end positions shown in FIGS. 9 and 10. Shift bores 216, 218, and 220 are plugged at the radial exterior of housing 130 to prevent leakage of fluid to annulus 40.

Figure 16:
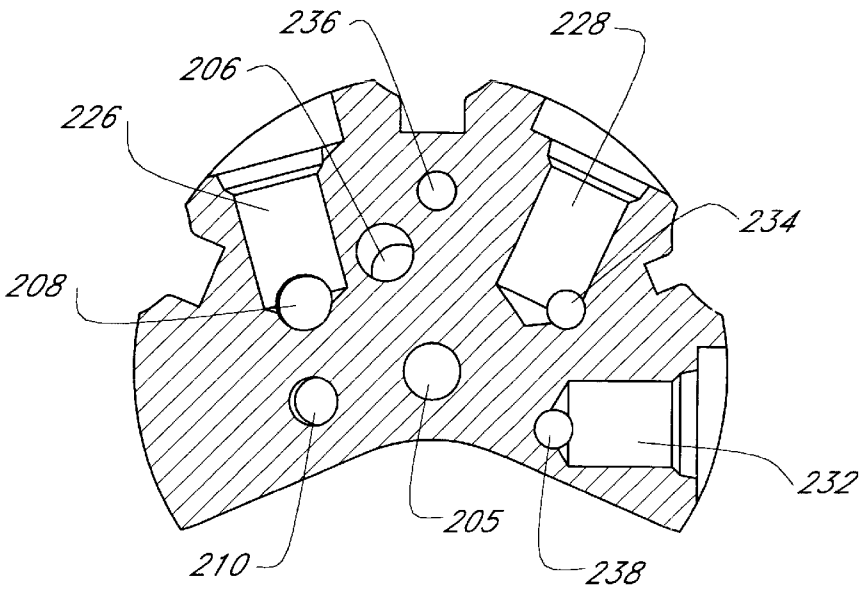
FIG. 16 is a cross-sectional view of the pressure transducer manifold, taken along line 16—16 of FIG. 13.
Figure 15:
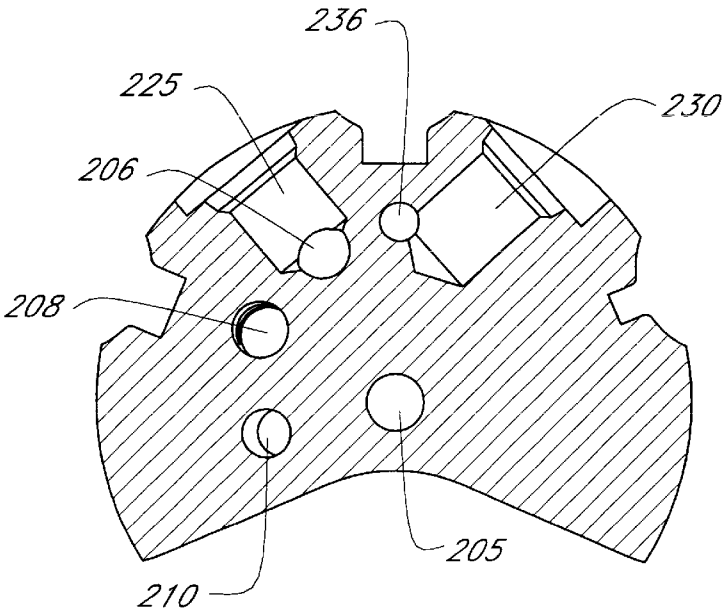
FIG. 15 is a cross-sectional view of the pressure transducer manifold, taken along line 15—15 of FIG. 13.

FIGS. 13–16 show pressure transducer manifold 222, which is configured to house pressure transducers for measuring the differential pressure of drilling fluid passing through various manifold passages. Pressure transducers 182, 184, 186, 188, and 190 are received within transducer bores 225, 226, 228, 230, and 232, respectively, which extend radially inward from the outer surface of manifold 222 to longitudinal bores therein. Longitudinal bores for passages 205, 206, 208, and 210 extend through the length of manifold 222 and align with corresponding bores in electronics housing 130. In addition, longitudinal bores extend rearward from the forward end of manifold 222 without reaching the aft end, forming passages 234, 236, and 238. Passage 234 fluidly communicates with rear chambers 174 and 178 of forward propulsion cylinders 112 and 114. Passage 236 fluidly communicates with front chambers 176 and 180 of cylinders 112 and 114. Passage 238 fluidly communicates with forward packerfoot 106. As shown in FIGS. 15 and 16, transducer bores 225, 226, 228, 230, and 232 communicate with passages 206, 208, 234, 236, and 238, respectively. As will be described below, the pressure transducers are exposed to drilling fluid on their inner sides and to oil on their outer sides. The oil is maintained at the pressure of annulus 40 via a pressure compensation piston 248 (FIG. 45), in order to produce the desired differential pressure measurements.

Figure 17:
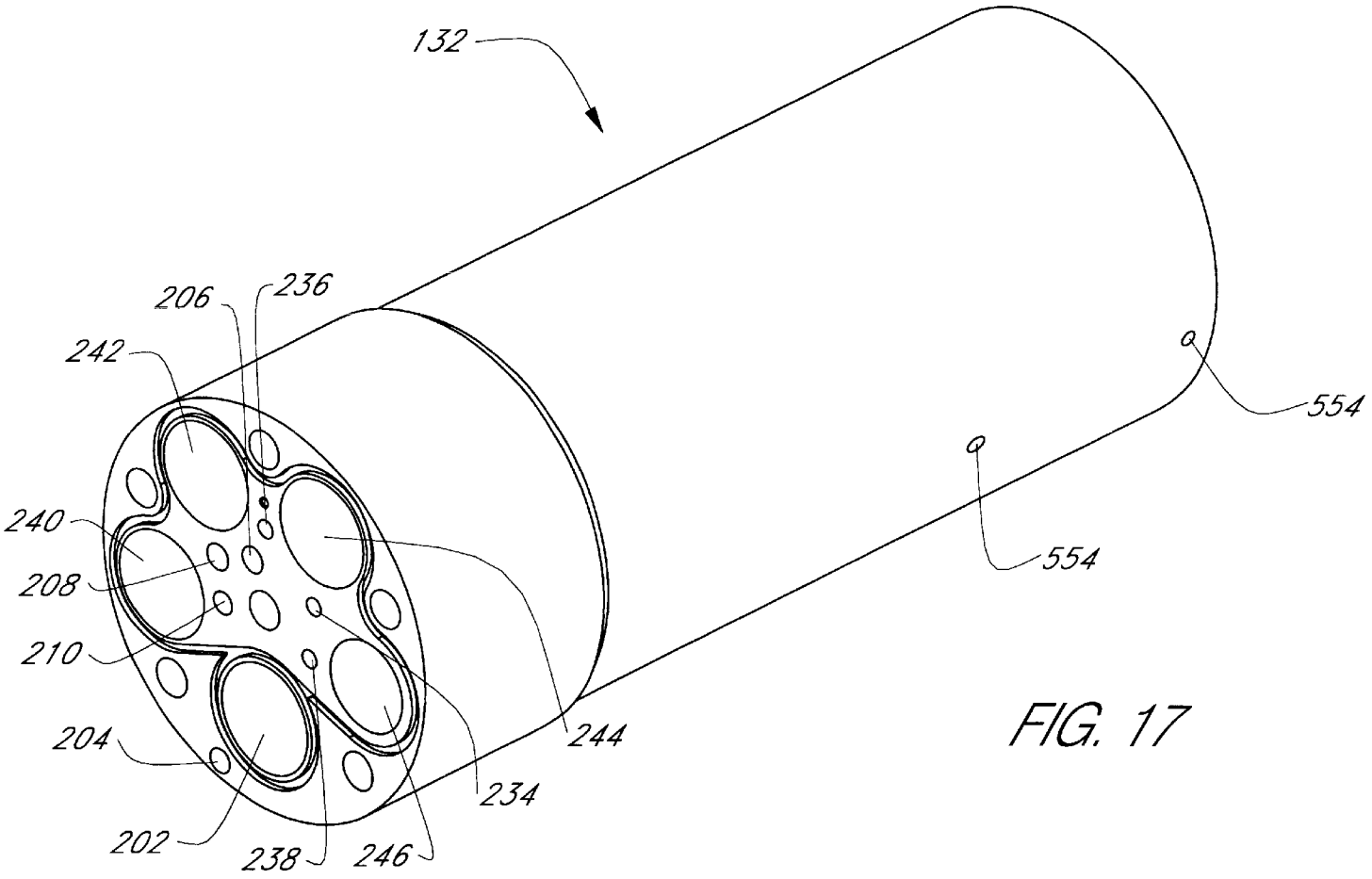
FIG. 17 is a rear perspective view of the motor housing of the EST.
Figure 18:
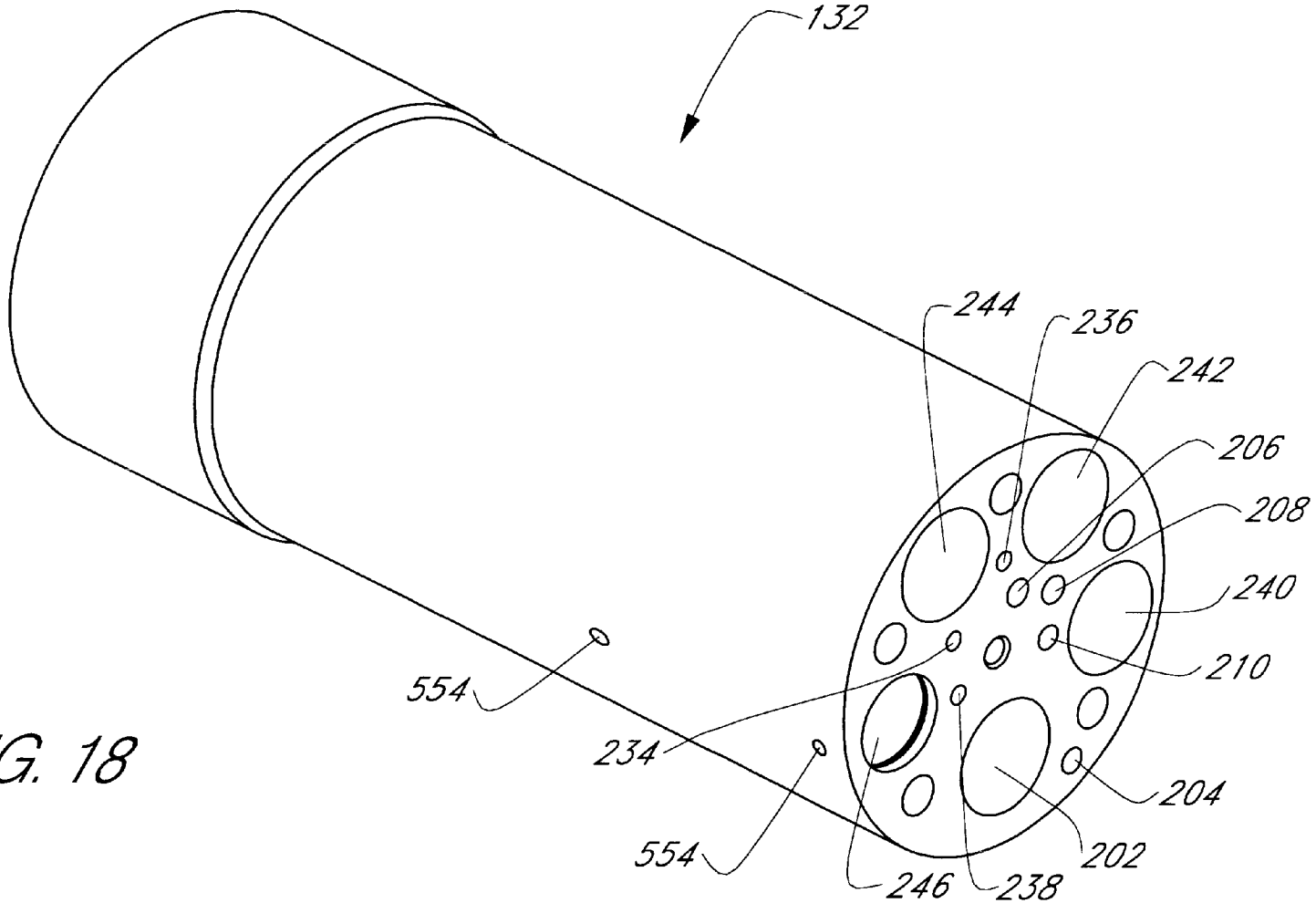
FIG. 18 is a front perspective view of the motor housing of FIG. 17.

FIGS. 17 and 18 show motor housing 132 of motor unit 94. Attached to the forward end of electronics housing 130, housing 132 includes longitudinal bores for passages 202, 204, 206, 208, 210, 234, 236, and 238 which align with the corresponding bores in electronics housing 130 and pressure transducer manifold 222. Housing 132 also includes longitudinal bores for passages 240, 242, and 244, which respectively house packerfoot motor 160, aft propulsion motor 162, and forward propulsion motor 164. In addition, a longitudinal bore for a passage 246 houses a pressure compensation piston 248 on its aft end and failsafe valve spring 151 (FIG. 45) on its forward end. The assembly and operation of the motors, valves, pressure compensation piston, and failsafe valve spring are described below.

Figure 20:
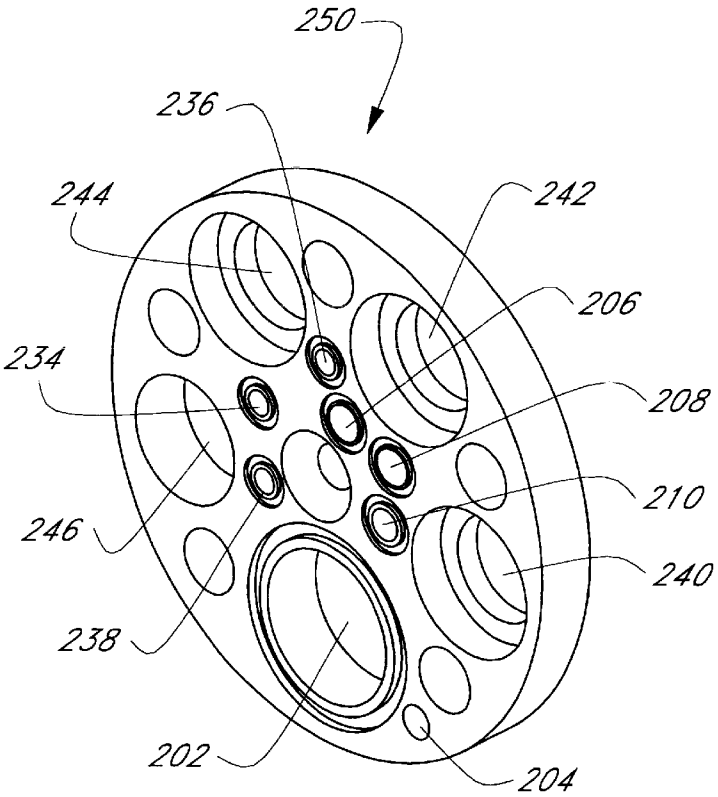
FIG. 20 is a front perspective view of the motor mount plate of FIG. 19.
Figure 19:
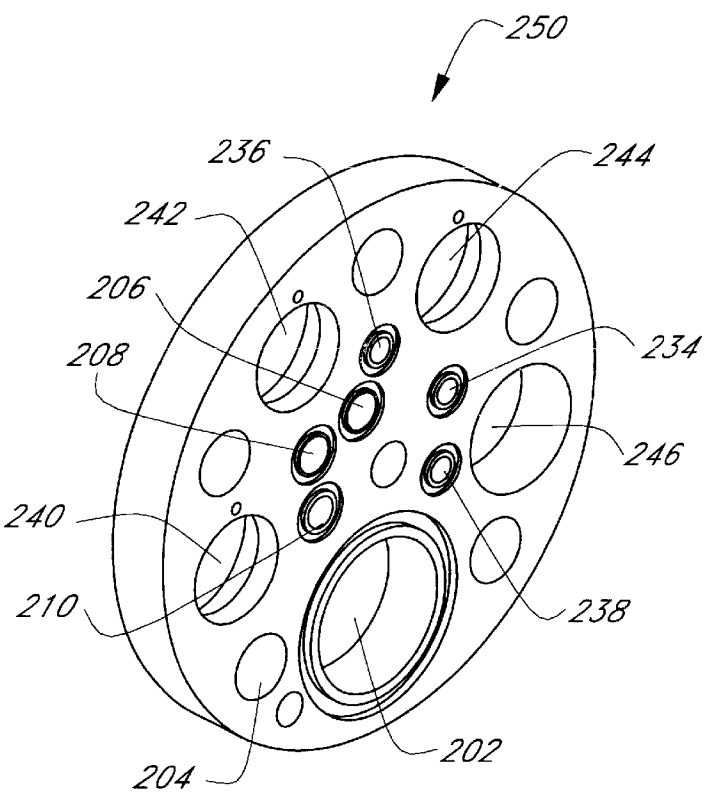
FIG. 19 is a rear perspective view of the motor mount plate of the EST.
Figure 21:
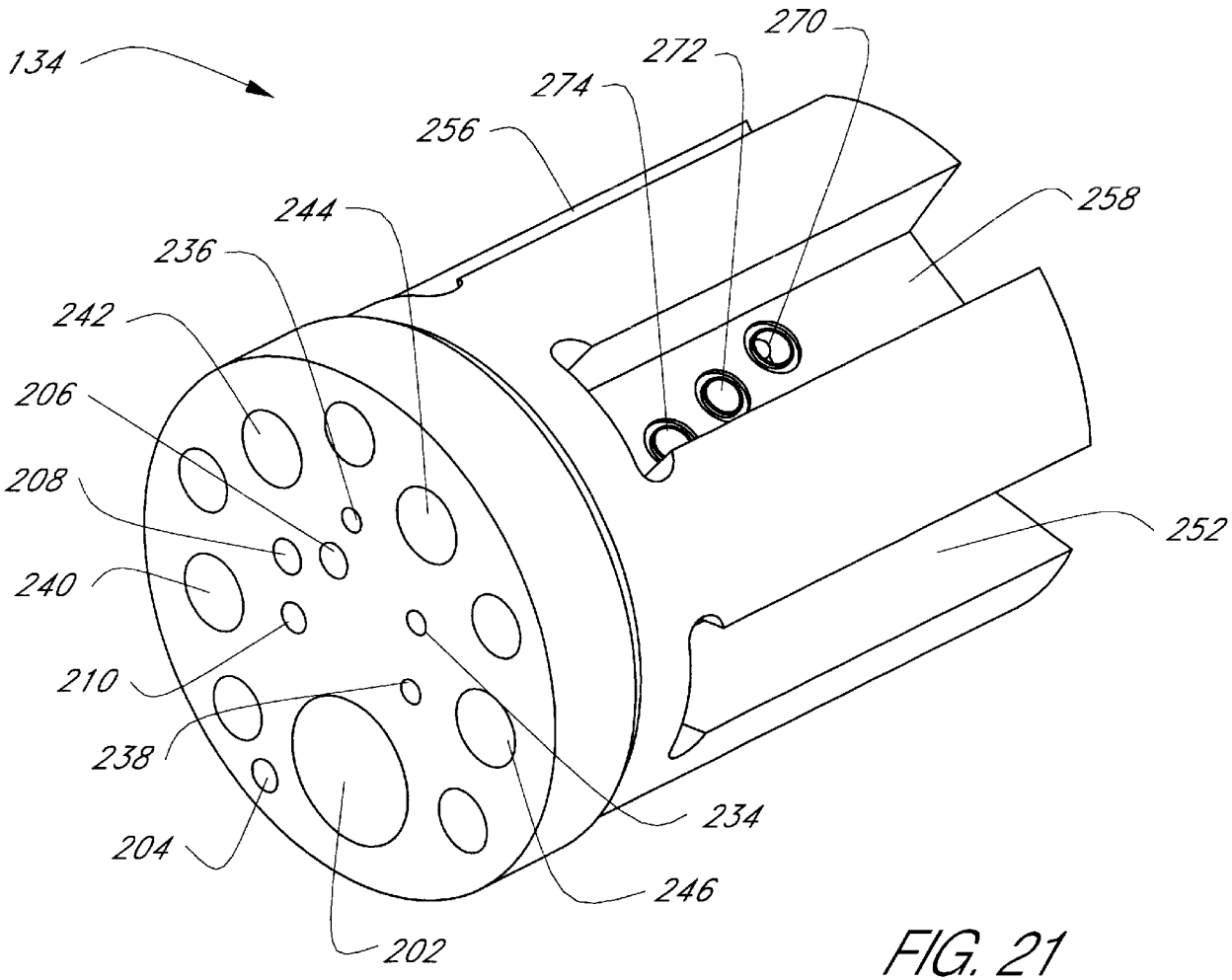
FIG. 21 is a rear perspective view of the valve housing of the EST.
Figure 22:
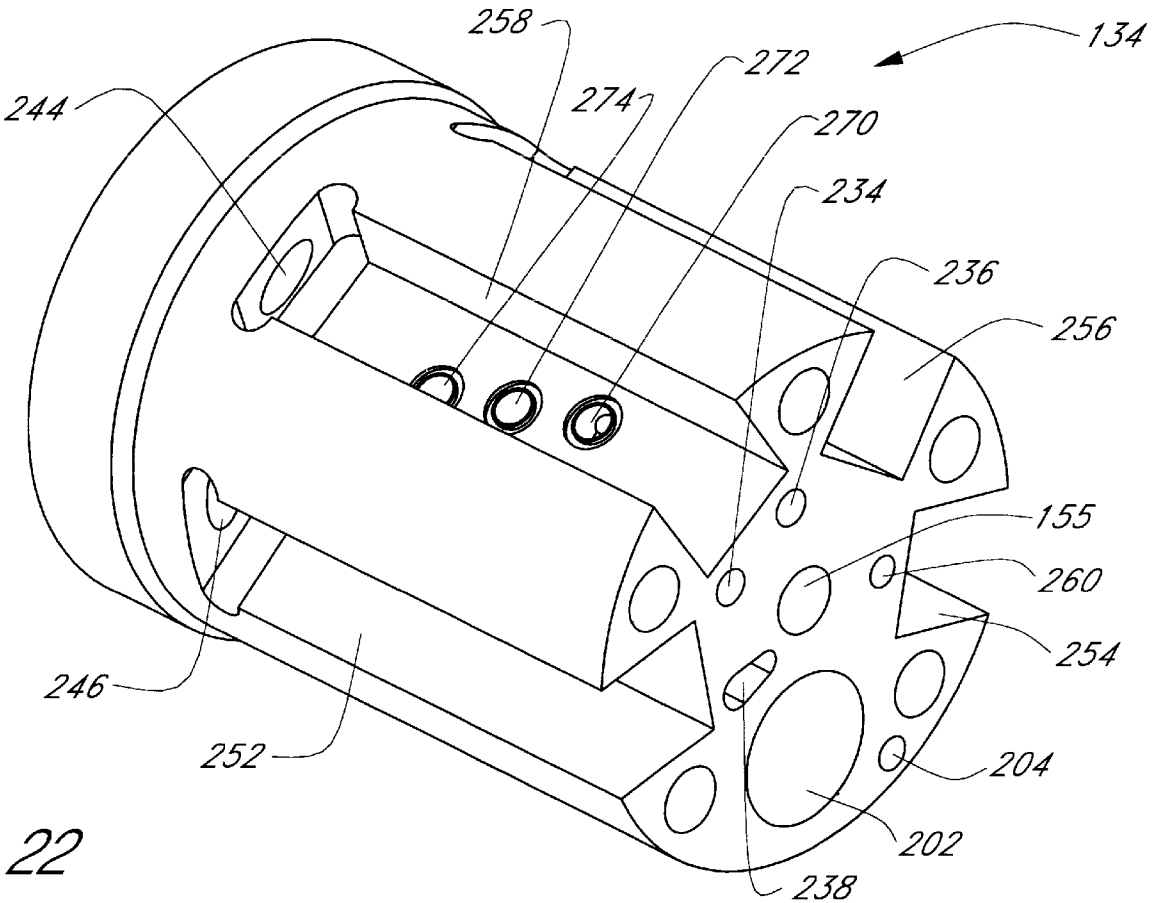
FIG. 22 is a front perspective view of the valve housing of FIG. 21.
Figure 44:
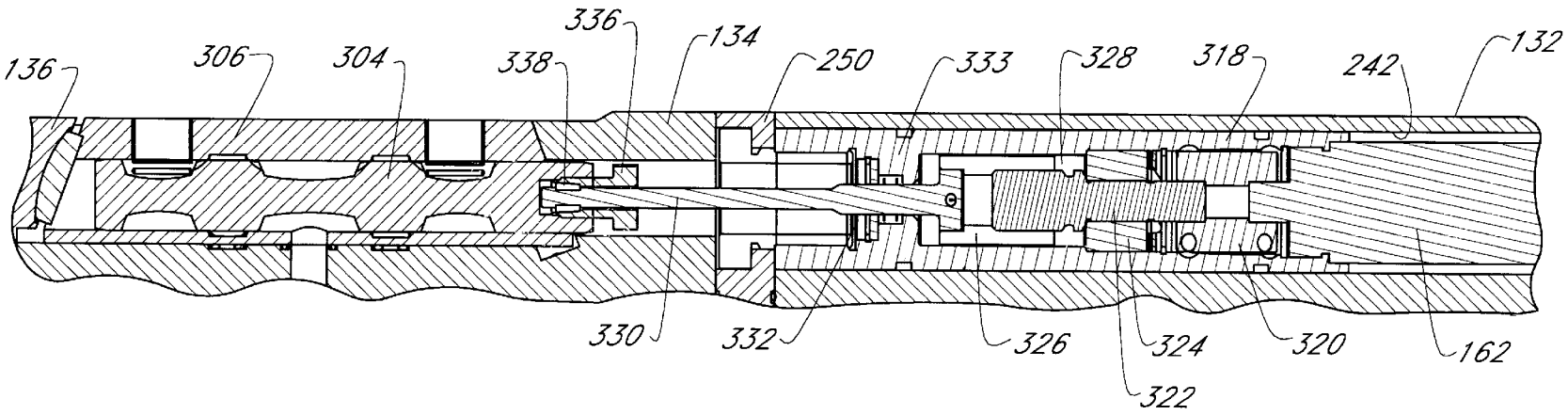
FIG. 44A is a longitudinal partially sectional view of the EST, showing the leadscrew assembly for the aft propulsion valve.
FIG. 44B is an exploded view of the leadscrew assembly of FIG. 44A.

A motor mount plate 250, shown in FIGS. 19 and 20, is secured between the forward end of motor housing 132 and the aft end of valve housing 134. The motors are enclosed within leadscrew housings 318 (described below) which are secured to mount plate 250. Plate 250 includes bores for passages 202, 204, 206, 208, 210, 234, 236, 238, 240, 242, 244, and 246 which align with corresponding bores in motor housing 132 and valve housing 134. As shown in FIG. 20, on the forward side of plate 250 the bores for passages 240 (packerfoot motor), 242 (aft propulsion motor), and 244 (forward propulsion motor) are countersunk to receive retaining bolts 334 (FIG. 44). Bolts 334 secure leadscrew housings 318 to the aft side of plate 250.

FIGS. 21–27 show valve housing 134 of valve unit 96. Attached to the forward end of motor mount plate 250, housing 134 has longitudinal recesses 252, 254, 256, and 258 in its outer radial surface which house failsafe valve 150, packerfoot valve 154, aft propulsion valve 156, and forward propulsion valve 158, respectively. Housing 134 has bores for passages 202, 204, 206, 208, 210, 234, 236, 238, 240, 242, 244, and 246, which align with corresponding bores in motor mount plate 250. At the forward end of housing 134, a central longitudinal bore is provided which forms an aft portion of galley 155. Galley 155 does not extend to the aft end of housing 134, since its purpose is to feed fluid from the exit of failsafe valve 150 to the other valves. In addition, a longitudinal bore is provided at the forward end of housing 134 for a passage 260. Passage 260 permits fluid communication between packerfoot valve 154 and forward packerfoot 106.

Figures 23, 24, 25, 26, 27:
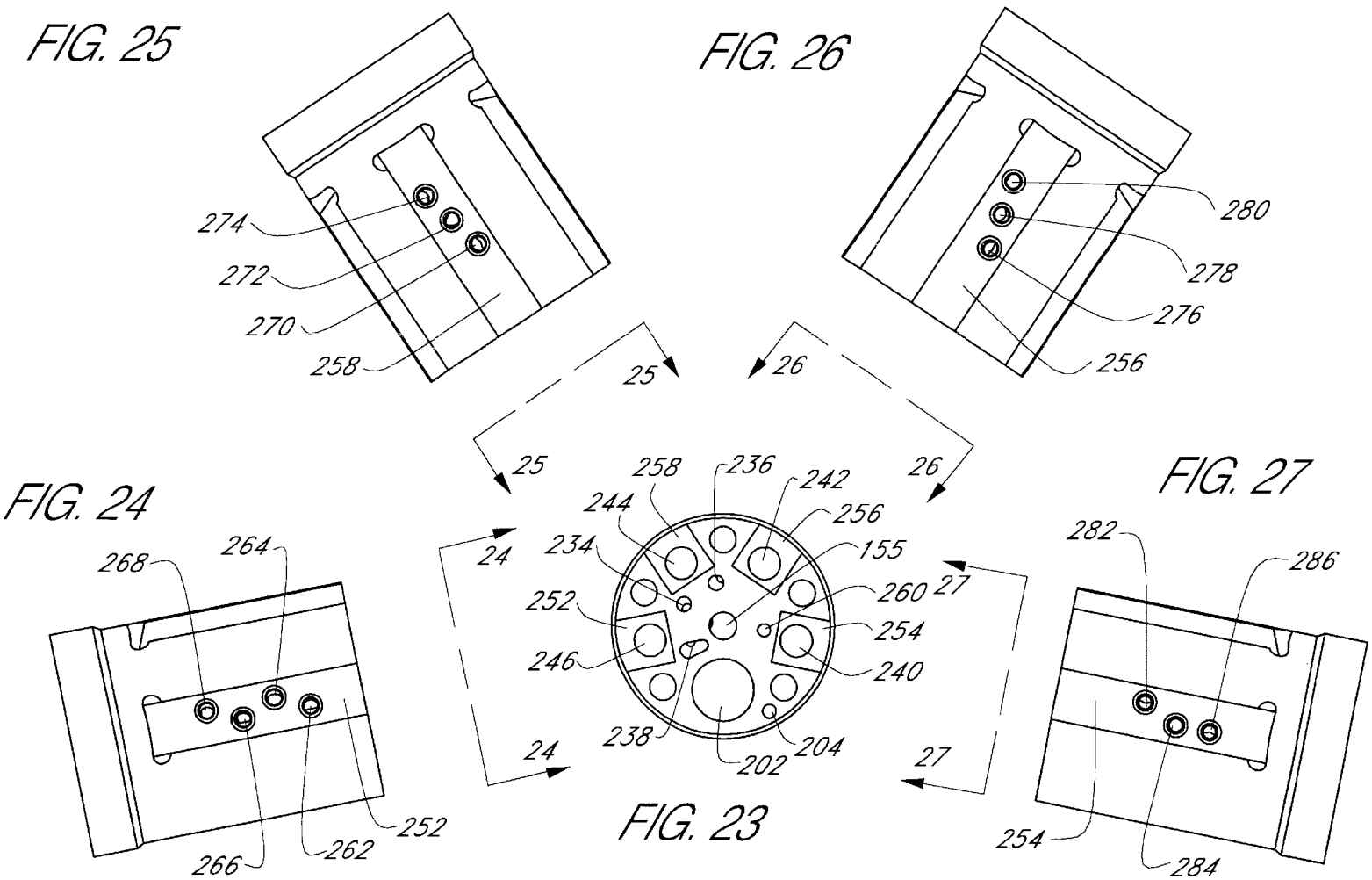
FIG. 23 is a front view of the valve housing of FIG. 21.
FIG. 24 is a side view of the valve housing, showing view 24 of FIG. 23.
FIG. 25 is a side view of the valve housing, showing view 25 of FIG. 23.
FIG. 26 is a side view of the valve housing, showing view 26 of FIG. 23.
FIG. 27 is a side view of the valve housing, showing view 27 of FIG. 23.

As shown in FIGS. 24–27, valve housing 134 includes various transverse bores which extend from the valve recesses to the longitudinal fluid passages, for fluid communication with the valves. As described below, valves 150, 154, 156, and 158 are spool valves, each comprising a spool configured to translate inside of a valve body. During operation, the spools translate longitudinally within the bores in the valve bodies and communicate with the fluid passages to produce the behavior schematically shown in FIGS. 4A–F. FIG. 24 shows the openings of transverse bores within failsafe valve recess 252 which houses failsafe valve 150. The bores form passages 262, 264, 266, and 268 which extend inward between failsafe valve 150 and various internal passages. In particular, passages 262 and 266 extend inward to passage 238 (the exit of diffuser 148), and passages 264 and 268 extend to galley 155. As will be described below, failsafe valve 150 distributes fluid from passage 238 to galley 155 when the fluid pressure in passage 238 exceeds the desired "on/off" threshold.

FIG. 25 shows the openings of transverse bores within forward propulsion valve recess 258. The bores form passages 270, 272, and 274 which extend from forward propulsion valve 158 to passage 236, galley 155, and passage 234, respectively. FIG. 26 shows the openings of transverse bores within aft propulsion valve recess 256. The bores form passages 276, 278, and 280 which extend from aft propulsion valve 156 to passage 208, galley 155, and passage 206, respectively. FIG. 27 shows the openings of transverse bores within packerfoot valve recess 254. The bores form passages 282, 284, and 286 which extend from packerfoot valve 154 to passage 260, galley 155, and passage 210, respectively. As mentioned above, propulsion valves 156 and 158 distribute fluid from galley 155 to the rear and front chambers of aft and forward propulsion cylinders 108, 110, 112, and 114. Packerfoot valve 154 distributes fluid from galley 155 to aft and forward packerfeet 104 and 106.

Figure 28:
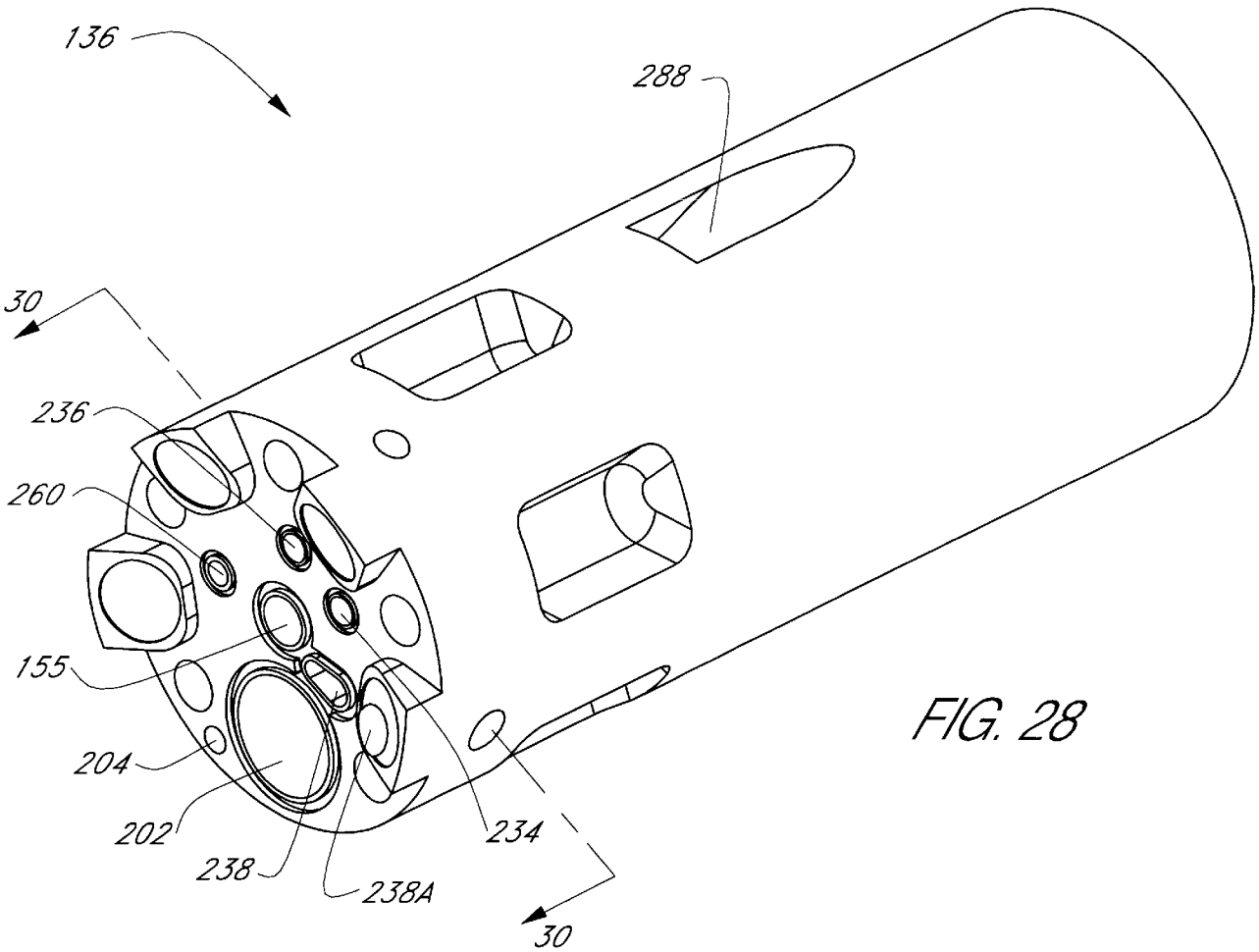
FIG. 28 is a rear perspective view of the forward transition housing of the EST.
Figure 29:
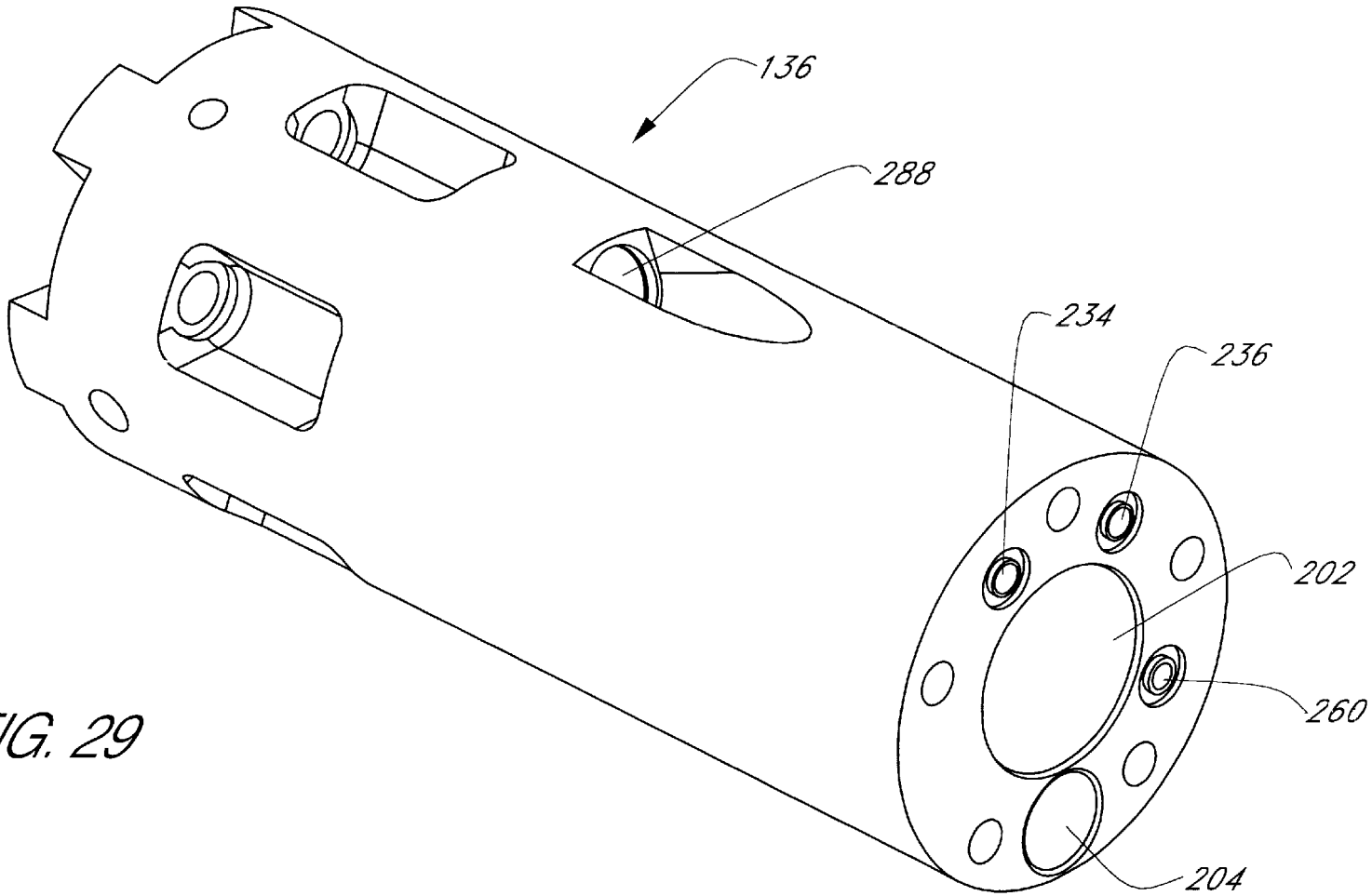
FIG. 29 is a front perspective view of the forward transition housing of FIG. 28.
Figure 30:
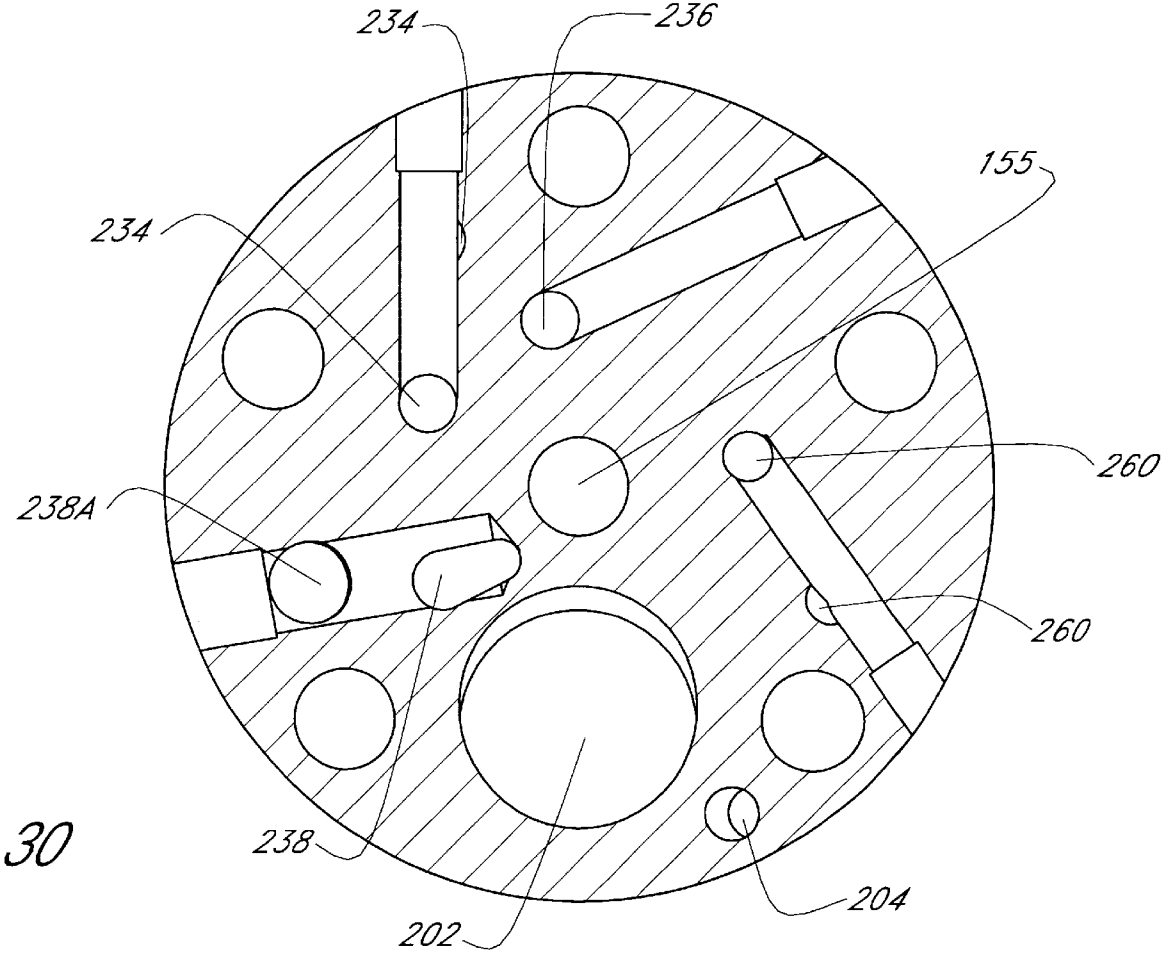
FIG. 30 is a cross-sectional view of the forward transition housing, taken along line 30—30 of FIG. 28.

FIGS. 28–30 show forward transition housing 136 of forward transition unit 98, which connects valve housing 134 to forward shaft 124 and houses relief valve 152 and diffuser 148. To simplify manufacturing of the tool, aft and forward shafts 118 and 124 are preferably identical. Thus, housing 136 repositions the various passages passing through the tool, via transverse shift bores (FIG. 30) as described above, to align with corresponding passages in forward shaft 124. Note that the shift bores are plugged on the exterior radial surface of housing 136, to prevent leakage of fluid to annulus 40. As seen in the figures, the aft end of housing 136 has longitudinal bores for passages 155, 202, 204, 234, 236, 238, and 260, which align with the corresponding bores in valve housing 134. Supply passage 202 transitions from the lower portion of the housing at the aft end to the central axis of the housing at the forward end, to align with a central bore in forward shaft 124. Wire passage 204 is enlarged at the forward end of housing 136, to facilitate connection with wire passages in forward shaft 124. Also, note that passage 238 does not extend to the forward end of housing 136. The purpose of passage 238 is to feed fluid from the diffuser to failsafe valve 150.

Referring still to FIGS. 28–30, diffuser 148 (FIGS. 31 and 32) is received in passage 202, at the forward end of housing 136. Fluid passing through the diffuser wall enters passage 238 and flows back toward valve housing 134 and to failsafe valve 150. An additional passage 238A fluidly communicates with passage 238 via a transverse shift bore. Fluid in passage 238A exerts an uphole axial force on the failsafe spool and hence on spring 151 (FIG. 45), to open the valve. Galley 155 extends forward to upper orifice 288 of housing 136, within which relief valve 152 (FIGS. 46–48) is received. The configuration and operation of diffuser 148 and the valves of the tool are described below.

Figure 31:
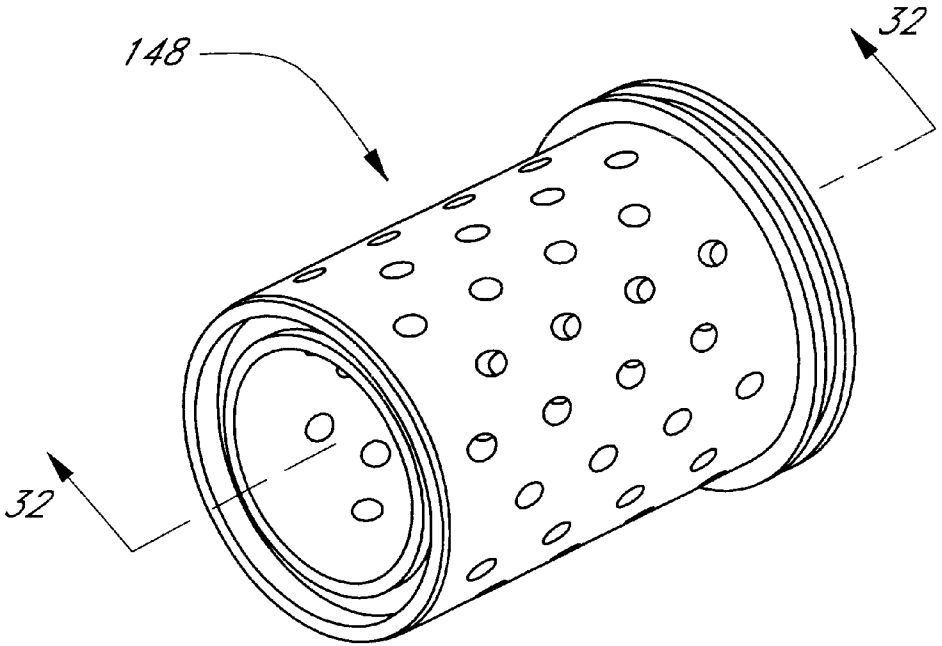
FIG. 31 is a rear perspective view of the diffuser of the EST.
Figure 32:
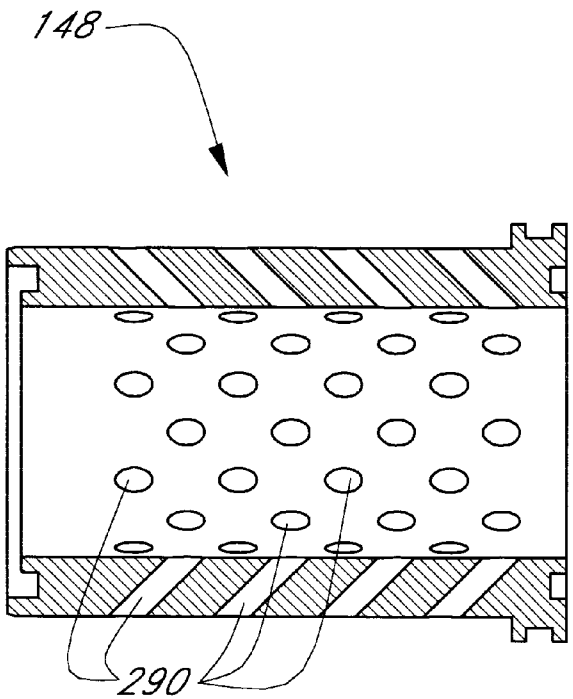
FIG. 32 is a sectional view of the diffuser, taken along line 32—32 of FIG. 31.
Figure 33:
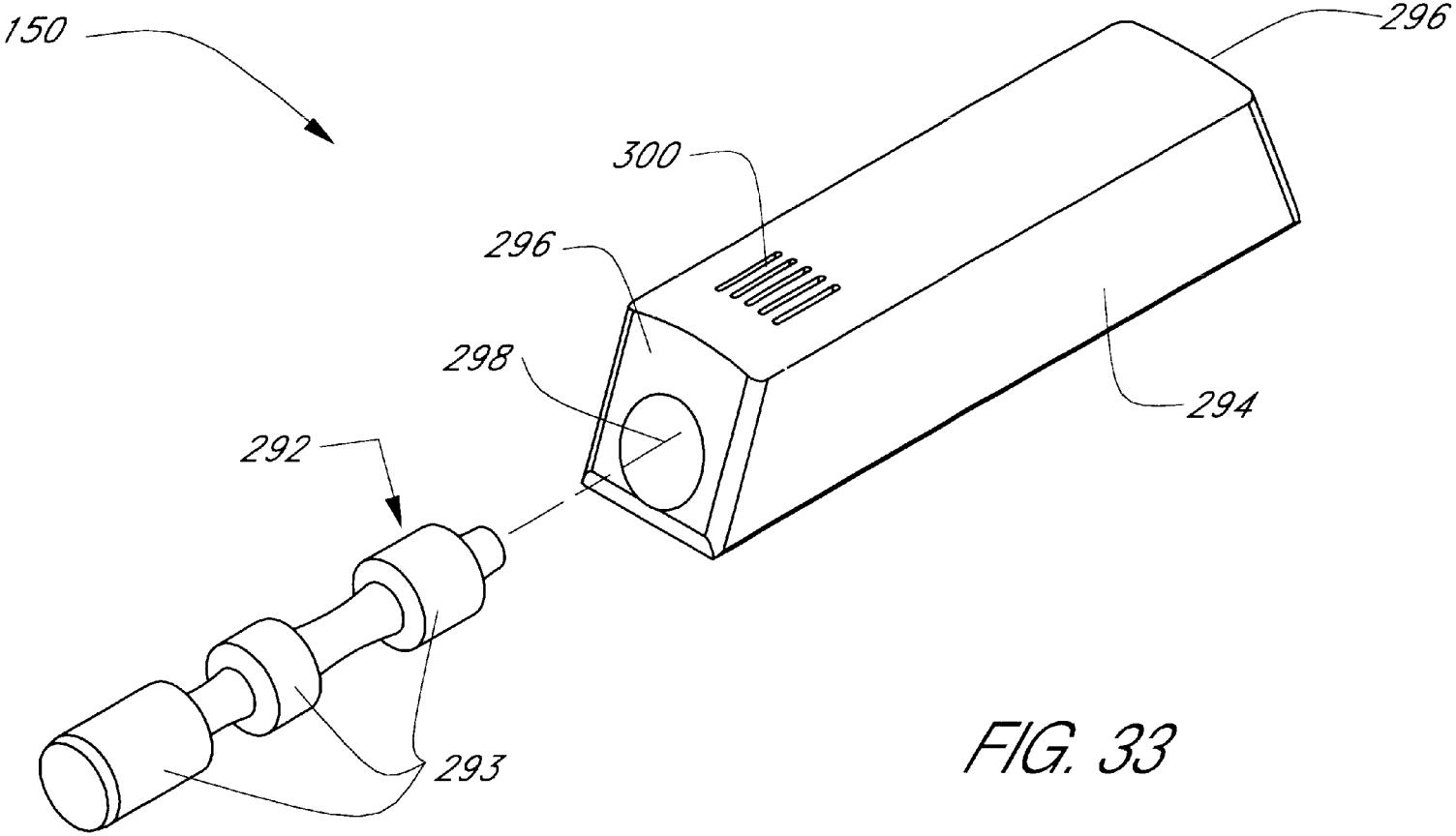
FIG. 33 is a rear perspective view of the failsafe valve spool and failsafe valve body of the EST.
Figure 34:
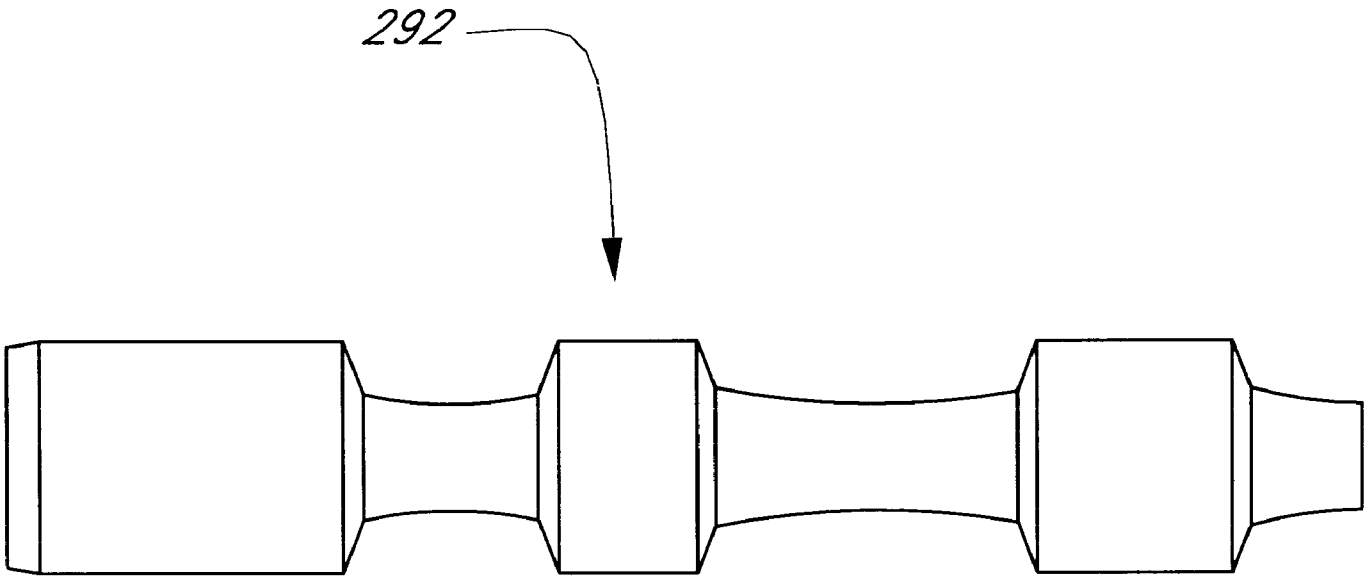
FIG. 34 is a side view of the failsafe valve spool of FIG. 33.
Figure 35:
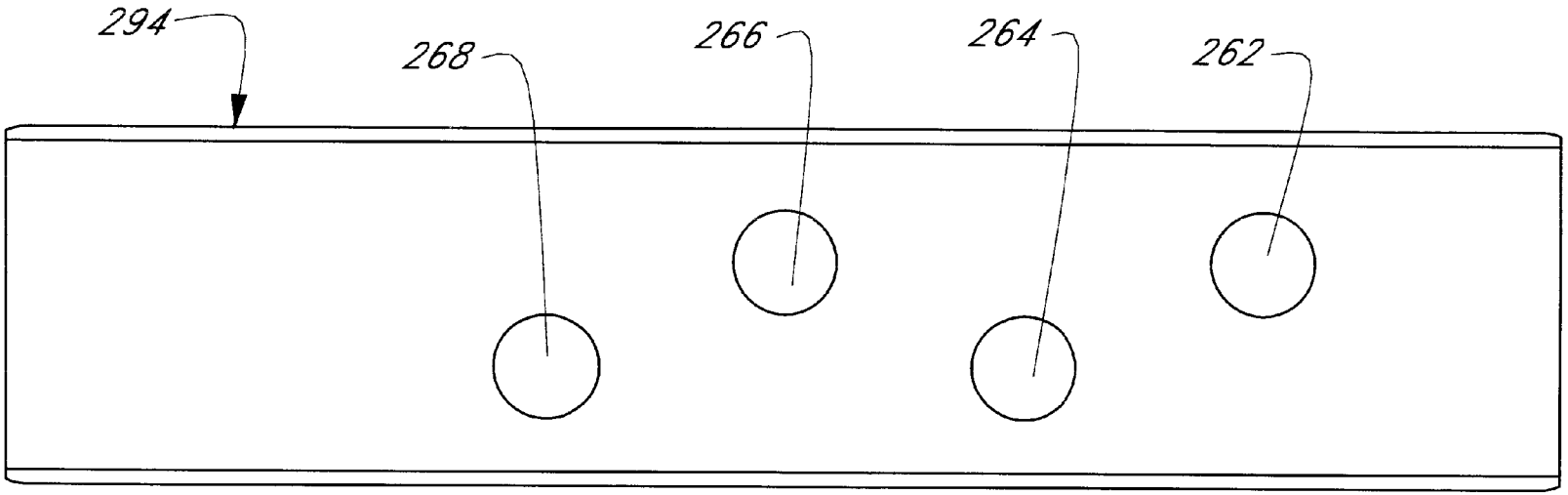
FIG. 35 is a bottom view of the failsafe valve body.

One embodiment of diffuser 148 is shown in FIGS. 31 and 32. As shown, diffuser 148 is a cylindrical tube having a flange at its forward end and rearwardly angled holes 290 in the tube. The majority of the drilling fluid flowing through passage 202 of forward transition housing 136 flows through the tube of diffuser 148 down to the bottom hole assembly. However, some of the fluid flows back uphole through holes 290 and into passage 238 which feeds failsafe valve 150. It is believed that the larger fluid particles will generally not make a reversal in direction, but will be forced downhole by the current. Holes 290 form an angle of approximately 135° with the flow of fluid, though an angle of at least 110° with the flow of fluid is believed sufficient to reduce blockage. Further, rear angled holes 290 are sized to restrict the flow of larger fluid particles to valve housing 134. Preferably, holes 290 have a diameter of 0.125 inch or less. Those skilled in the art will appreciate that a variety of different types of diffusers or filters may be used, giving due consideration to the goal of preventing larger fluid particles from entering and possibly plugging the valves. Of course, if the valves are configured so that pluggage is not a significant concern, or if the fluid is sufficiently devoid of harmful larger fluid particles, then diffuser 148 may be omitted from the EST.

Referring to FIGS. 33–37, failsafe valve 150 comprises valve spool 292 received within valve body 294. Spool 292 has segments 293 of larger diameter. Body 294 has a central bore 298 which receives spool 292, and fluid ports in its lower wall for fluid passages 262, 264, 266, and 268, described above. The diameter of bore 298 is such that spool 292 can be slidably received therein, and so that segments 293 of spool 298 can slide against the inner wall of bore 298 in an effectively fluid-sealing relationship. Central bore 298 has a slightly enlarged diameter at the axial positions of passages 264 and 268. These portions are shown in the figures as regions 279. Regions 279 allow entering fluid to move into or out of the valve with less erosion to the valve body or valve spool. Body 294 is sized to fit in a fluid-tight axially slidable manner in failsafe valve recess 252 in valve housing 134. Body 294 has angled end faces 296 which are compressed between similarly angled portions of valve housing 134 and forward transition housing 136 which define the ends of recess 252. Such compression keeps body 294 tightly secured to the outer surface of valve housing 134. Further, a spacer, such as a flat plate, may be provided in recess 252 between the forward end of valve body 294 and forward transition housing 136. The spacer can be sanded to absorb tolerances in construction of such mating parts. In an EST having a diameter of 3.375 inches, ports 262, 264, 266, and 268 of valve body 294 have a diameter of preferably 0.1 inches to 0.5 inches, and more preferably of 0.2 inches to 0.25 inches. In the same embodiment, passage 298 preferably has a diameter of 0.4 inches to 0.5 inches.

Figure 36:
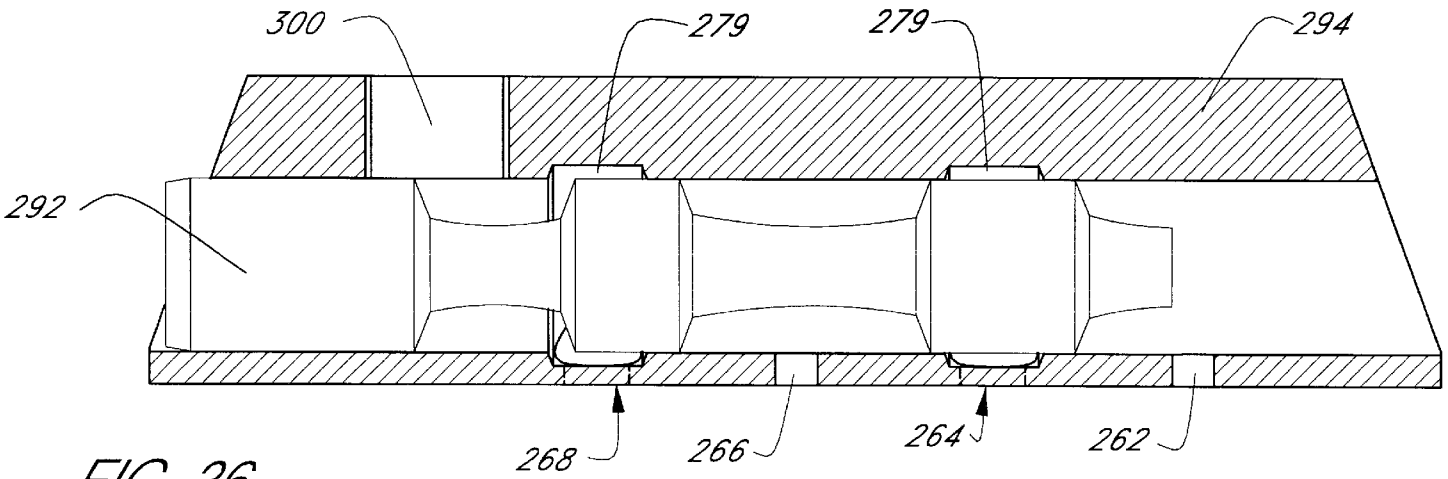
FIG. 36 is a longitudinal sectional view of the failsafe valve in a closed position.
Figure 37:
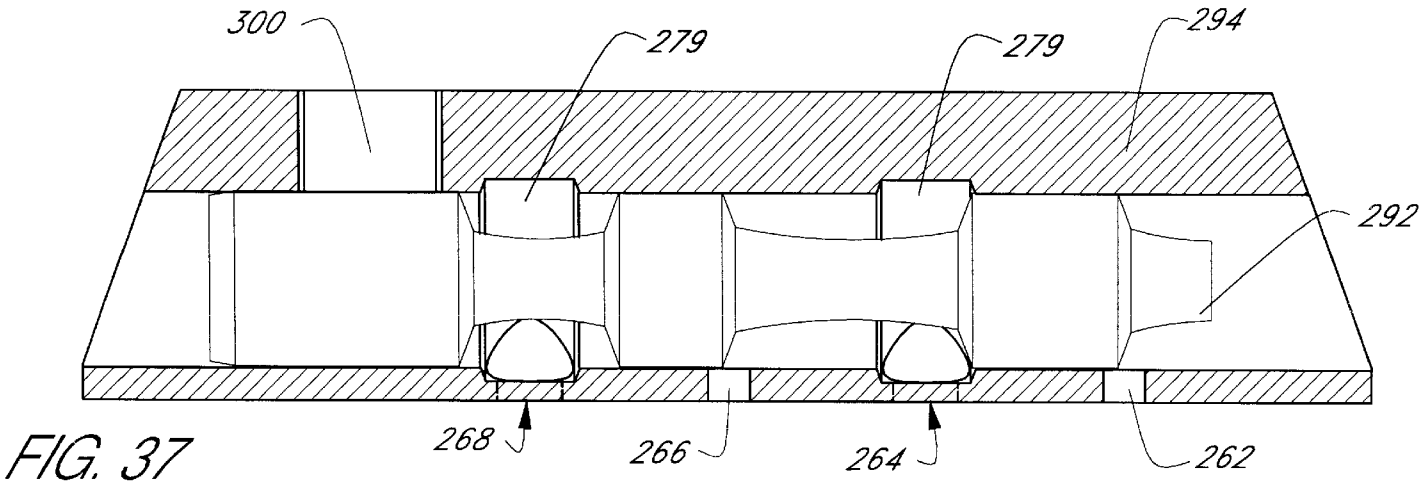
FIG. 37 is a longitudinal sectional view of the failsafe valve in an open position.

Vent 300 of valve body 294 permits fluid to be exhausted from passage 298 to annulus 40. The ports of valve body 294 fluidly communicate with one another depending upon the position of spool 292. FIGS. 36 and 37 are longitudinal sectional views of failsafe valve 150. Note that ports 264 and 268 are shown in phantom because these ports do not lie on the central axis of body 294. Nevertheless, the positions of ports 264 and 268 are indicated in the figures. In a closed position, shown in FIG. 36, spool 292 permits fluid flow from passage 268 (which communicates with galley 155) to vent 300 (which communicates with annulus 40). In an open position, shown in FIG. 37, spool 292 permits fluid flow from passages 264 and 268 (which communicates with galley 155) to passages 262 and 266 (which communicates with diffuser exit 238).

As mentioned above, failsafe valve 150 permits fluid to flow into the galley 155 of valve unit 96. The desired volume flowrate into galley 155 depends upon the tractor size and activity to be performed, and is summarized in the table below. The below-listed ranges of values are the flowrates (in gallons per minute) through valve 150 into galley 155 for milling, drilling, tripping into an open or cased borehole, for various EST diameters. The flowrate into galley 155 depends upon the dimensions of the failsafe valve body and ports.

| EST Diameter | Milling | Drilling | Tripping |
|---|---|---|---|
| 2.175 inches | 0.003–1 | 0–6 | 8–100 |
| 3.375 inches | 0.006–1 | 0–12 | 8–200 |
| 4.75 inches | 0.06–3 | 0–25 | 8–350 |
| 6.0 inches | 0.6–10 | 0–55 | 10–550 |

If desired, the stroke length of failsafe valve 150 may be limited to a ⅛ inch stroke (from its closed to open positions), to minimize the burden on relief valve 152. The failsafe valve spool's stroke is limited by the compression of spring 151. For an EST having a diameter of 3.375 inches, this stroke results in a maximum volume flowrate of approximately 12 gallons per minute from diffuser exit 238 to galley 155, with an average flowrate of approximately 8 gallons per minute. The volume flowrate capacity of failsafe valve 150 is preferably significantly more than, and preferably twice, that of propulsion valves 154 and 156, to assure sufficient flow to operate the tool.

In the illustrated embodiment, propulsion valves 156 and 158 are identical, and packerfoot valve 154 is structurally similar. In particular, as shown in FIGS. 23–28, the locations of the fluid ports of packerfoot valve 154 are slightly different from those of propulsion valves 156 and 158, due to space limitations which limit the positioning of the internal fluid passages of valve housing 134. However, it will be understood that packerfoot valve 154 operates in a substantially similar manner to those of propulsion valves 156 and 158. Thus, only aft propulsion valve 156 need be described in detail herein.

FIGS. 38–42 show aft propulsion valve 156, which is configured substantially similarly to failsafe valve 150. Valve 156 is a 4-way valve comprising spool 304 and valve body 306. Spool 304 has larger diameter segments 309 and smaller diameter segments 311. As shown in FIG. 39, segments 309 include one or more notches 312 which permit a variable flow restriction between the various flow ports in valve body 306. Valve body 306 has a configuration similar to that of failsafe valve body 294, with the exception that body 306 has three ports in its lower wall for fluid passages 276, 278, and 280, described above, and two vents 308 and 310 which fluidly communicate with annulus 40. A central bore 307 has a diameter configured to receive spool 304 so that segments 309 slide along the inner wall of bore 307 in an effectively fluid-sealing relationship. Since the positions of the notches 312 along the circumference of the segments 309 may or may not be adjacent to the fluid ports in the valve body, bore 307 preferably has a slightly enlarged diameter at the axial positions of passages 276 and 280, so that the ports can communicate with all of the notches. That is, the inner radial surface of the valve body 306 defining bore 307 has a larger diameter than the other inner radial surfaces constraining the path of movement of segments 309 of spool 304. These enlarged diameter portions are shown in the figures as regions 279. Valve body 306 is sized to fit tightly in aft propulsion valve recess 256 in valve housing 134. A spacer may also be provided as described above in connection with failsafe valve body 294.

Figure 40:
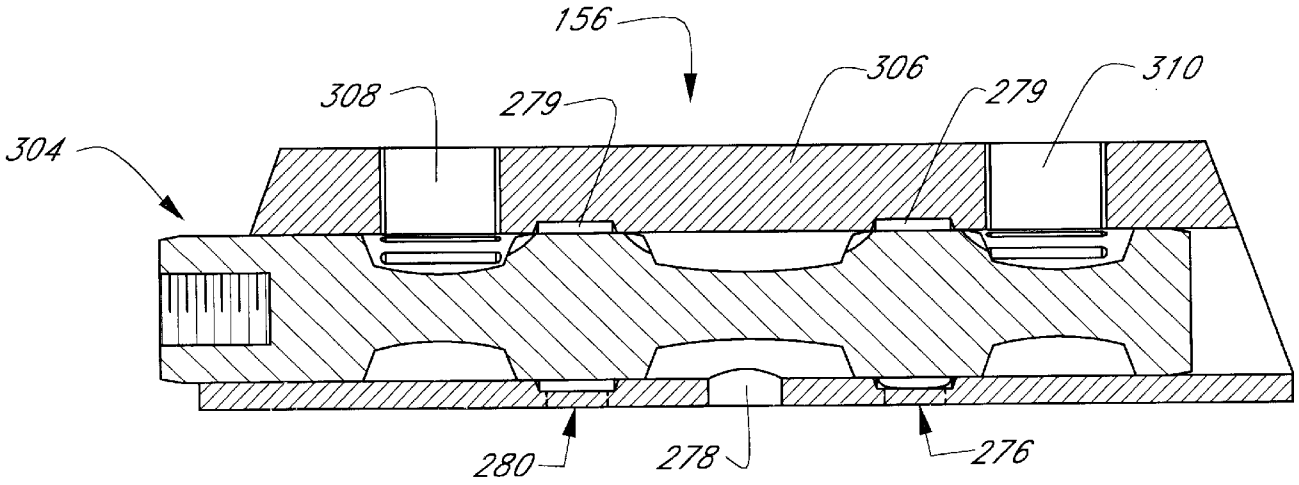
FIG. 40 is a longitudinal sectional view of the aft propulsion valve in a closed position.
Figure 41:
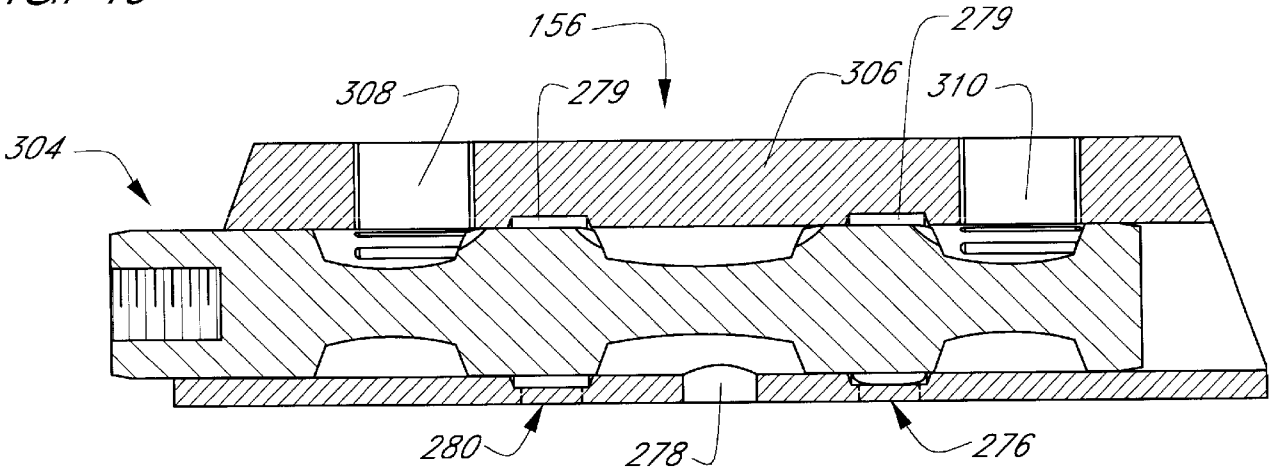
FIG. 41 is a longitudinal sectional view of the aft propulsion valve in a first open position.
Figure 42:
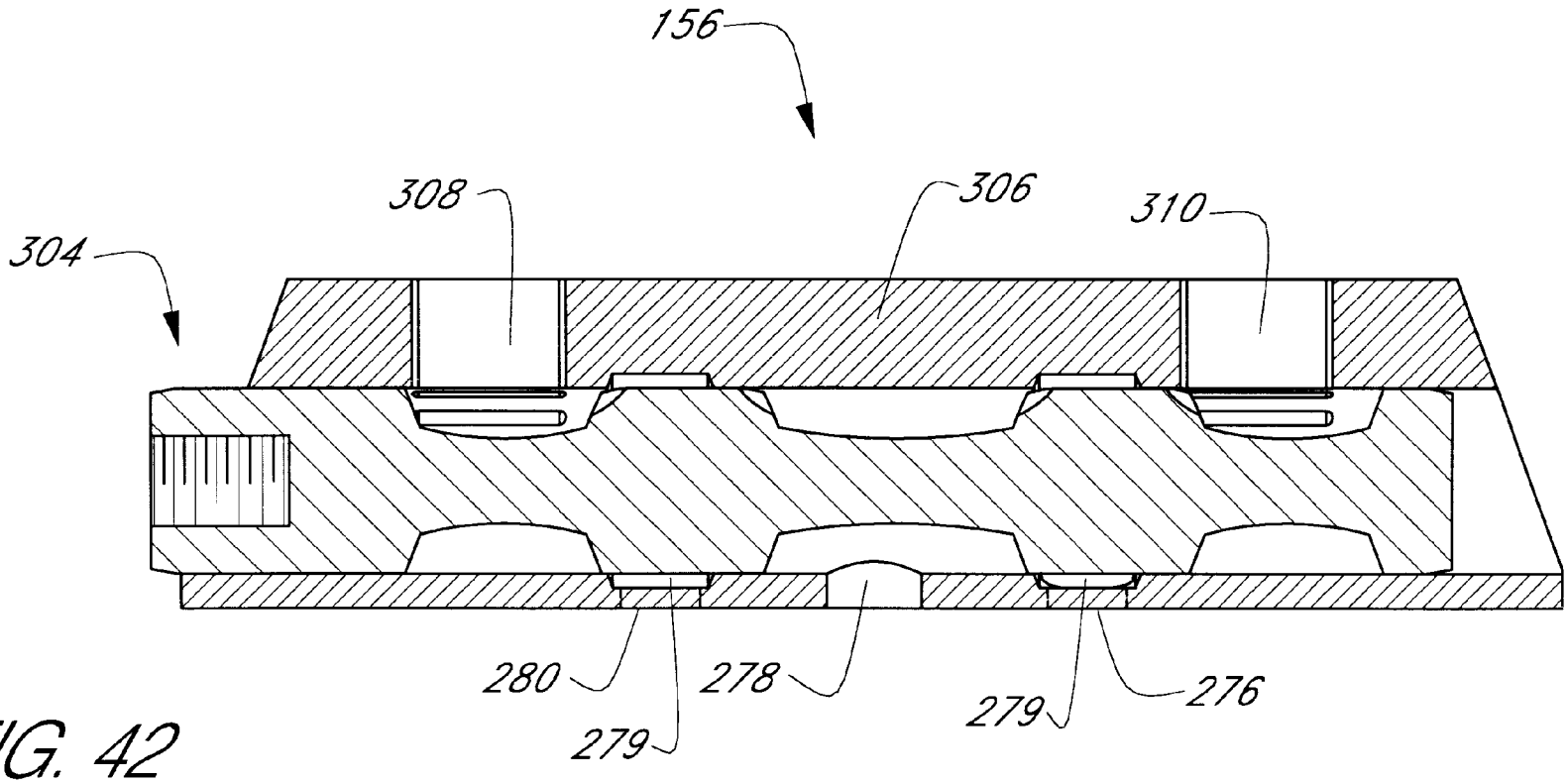
FIG. 42 is a longitudinal sectional view of the aft propulsion valve in a second open position.

FIGS. 40–42 are longitudinal sectional views of the aft propulsion valve 156. Note that ports 276 and 280 are shown in phantom because these ports do not lie on the central axis of valve body 306. Nevertheless, the positions of ports 276 and 280 are indicated in the figures. The ports of body 306 fluidly communicate with one another depending upon the axial position of spool 304. In a closed position of aft propulsion valve 156, shown in FIG. 40, spool 304 completely restricts fluid flow to and from the aft propulsion cylinders. In another position, shown in FIG. 41, spool 304 permits fluid flow from passage 278 (which communicates with galley 155) to passage 280 (which communicates with rear chambers 166 and 170 of aft propulsion cylinders 108 and 110), and from passage 276 (which communicates with front chambers 168 and 172 of cylinders 108 and 110) to vent 310 (which communicates with annulus 40). In this position, valve 156 supplies hydraulic power for a forward thrust stroke of the aft propulsion cylinders, during which fluid is supplied to rear chambers 166 and 170 and exhausted from front chambers 168 and 172. In another position, shown in FIG. 42, spool 304 permits fluid flow from passage 278 (which communicates with galley 155) to passage 276 (which communicates with front chambers 168 and 172), and from passage 280 (which communicates with rear chambers 166 and 170) to vent 308 (which communicates with annulus 40). In this position, valve 156 supplies hydraulic power for a reset stroke of the aft propulsion cylinders, during which fluid is supplied to front chambers 168 and 172 and exhausted from rear chambers 166 and 170.

It will be appreciated that the volume flowrate of drilling fluid into aft propulsion cylinders 108 and 110 can be precisely controlled by controlling the axial position of valve spool 304 within valve body 306. The volume flowrate of fluid through any given fluid port of body 306 depends upon the extent to which a large diameter segment 309 of spool 304 blocks the port.

Figure 43B:
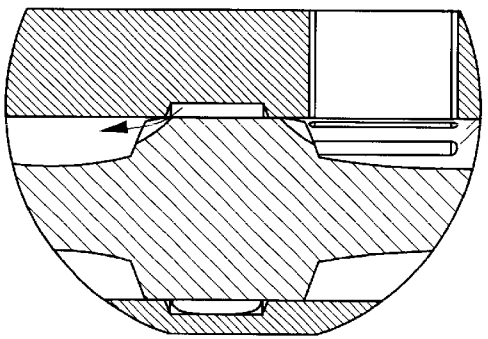
FIGS. 43A–C are exploded longitudinal sectional views of the aft propulsion valve, illustrating different flow-restricting positions of the valve spool.
Figure 43C:
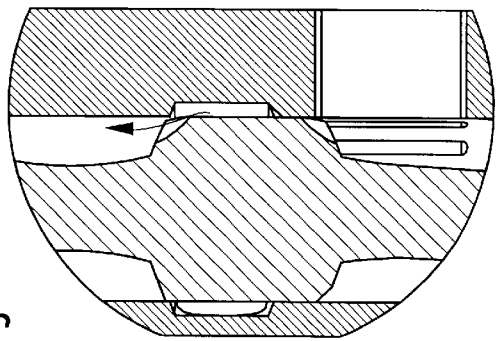
Figure 43A:
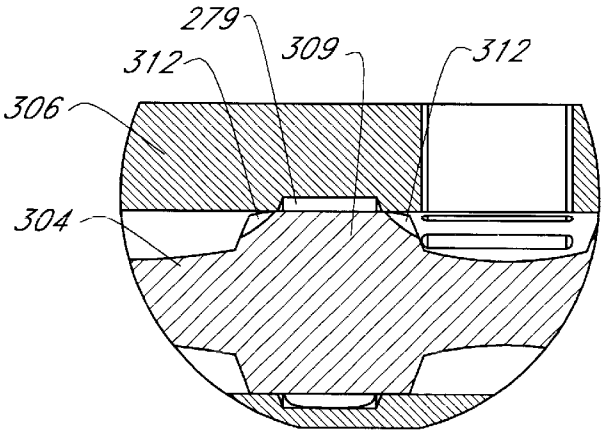

FIGS. 43A–C illustrate this concept. FIG. 43A shows the spool 304 having a position such that a segment 309 completely blocks a fluid port of body 306. In this position, there is no flow through the port. As spool 304 slides a certain distance in one direction, as shown in FIG. 43B, some fluid flow is permitted through the port via the notches 312. In other words, segment 309 permits fluid flow through the port only through the notches. This means that all of the fluid passing through the port passes through the regions defined by notches 312. The volume flowrate through the port is relatively small in this position, due to the small opening through the notches. In general, the flowrate depends upon the shape, dimensions, and number of the notches 312. Notches 312 preferably have a decreasing depth and width as they extend toward the center of the length of the segment 309. This permits the flow restriction, and hence the volume flowrate, to be very finely regulated as a function of the spool's axial position.

In FIG. 43C, spool 304 is moved further so that the fluid is free to flow past segment 309 without necessarily flowing through the notches 312. In other words, segment 309 permits fluid flow through the port at least partially outside of the notches. This means that some of the fluid passing through the port does not flow through the regions defined by notches 312. In this position the flow restriction is significantly decreased, resulting in a greater flowrate through the port. Thus, the valve configuration of the EST permits more precise control over the fluid flowrate to the annular pistons in the propulsion cylinders, and hence the speed and thrust of the tractor.

Figure 78:
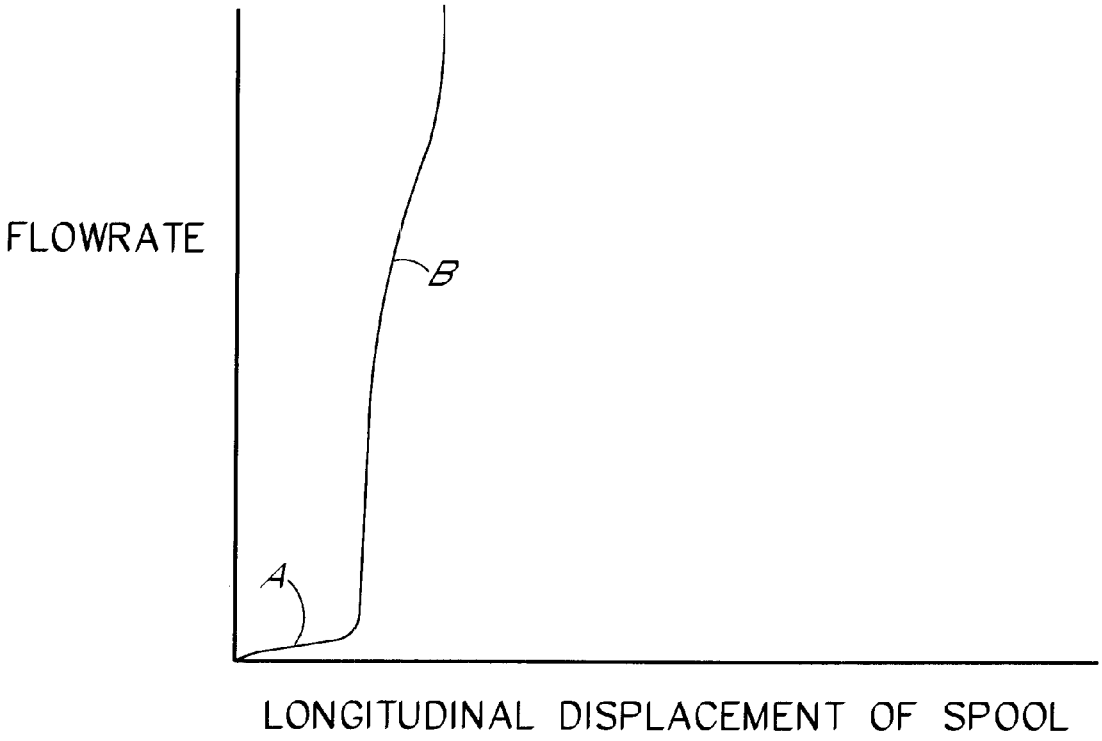
FIG. 78 is a graph illustrating the relationship between longitudinal displacement of a propulsion valve spool of the EST and flowrate of fluid admitted to the propulsion cylinder.

FIG. 78 graphically illustrates how the fluid flowrate to either the rear or front chambers of the propulsion cylinders varies as a function of the axial displacement of the propulsion valve spool. Section A of the curve corresponds to the valve position shown in FIG. 43B, i.e., when the fluid flows only through the notches 312. Section B corresponds to the valve position shown in FIG. 43C, i.e., when the fluid is free to flow past the edge of the large diameter segment 309 of the spool. As shown, the flowrate gradually increases in Section A and then increases much more substantially in Section B. Thus, Section A is a region which corresponds to fine-tuned control over speed, thrust, and position of the EST.

Figure 79:
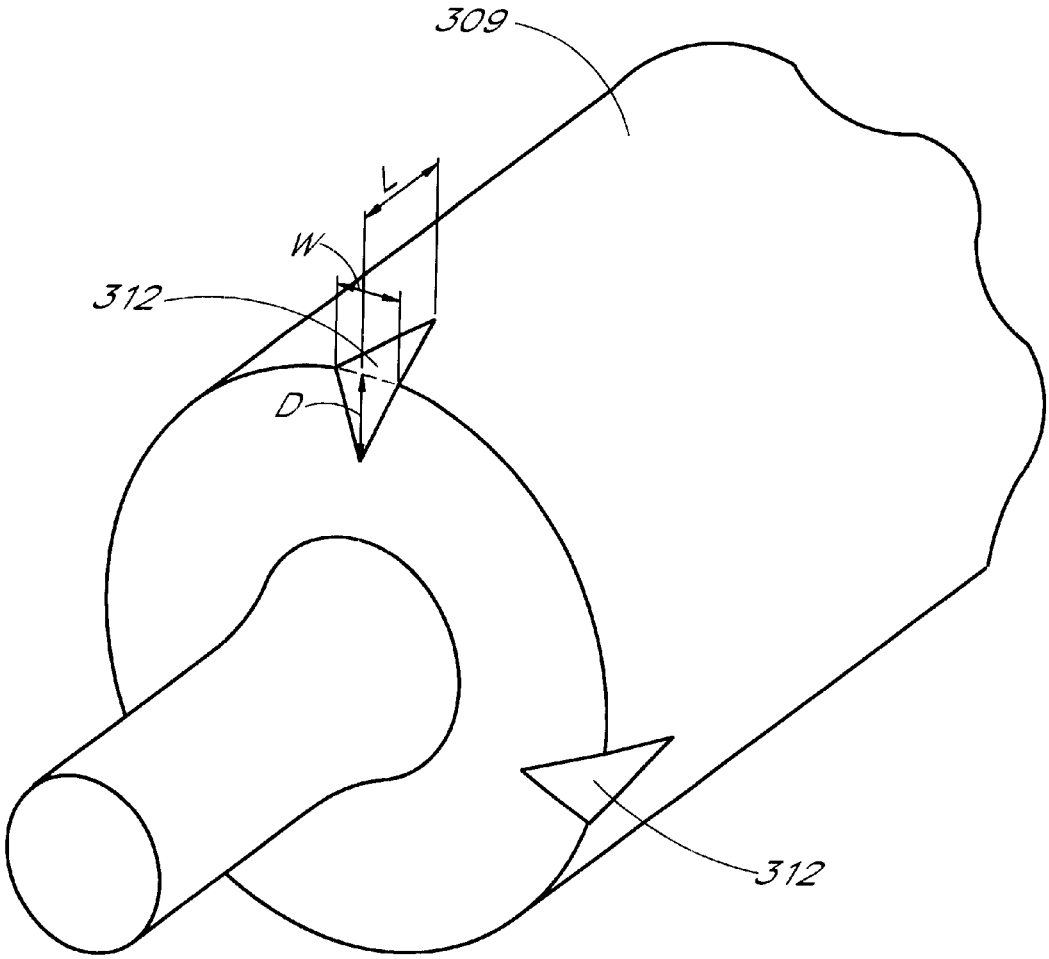
FIG. 79 is a perspective view of a notch of a propulsion valve spool of the EST.

Valve spool 304 preferably includes at least two, advantageously between two and eight, and more preferably three, notches 312 on the edges of the large diameter segments 309. As shown in FIG. 79, each notch 79 has an axial length L extending inward from the edge of the segment 309, a width W at the edge of the segment 309, and depth D. For an EST having a diameter of 3.375 inches, L is preferably about 0.055–0.070 inches, W is preferably about 0.115–0.150 inches, and D is preferably about 0.058–0.070 inches. For larger sized ESTs, the notch sizes are preferably larger, and/or more notches are provided, so as to produce larger flowrates through the notches. The notch size significantly affects the ability for continuous flow of fluid into the pistons, and hence continuous motion of the tractor at low speeds. In fact, the notches allow significantly improved control over the tractor at low speeds, compared to the prior art. However, some drilling fluids (especially barite muds) have a tendency to stop flowing at low flow rates and bridge shut small channels such as those in these valves. Greater volume of the notches allows more mud to flow before bridging occurs, but also results in less control at lower speeds. As an alternative means of controlling the tractor at very low speeds, the spool can be opened for a specified interval, then closed and reopened in a "dithering" motion, producing nearly continuous low speed of the tractor.

Figure 71:
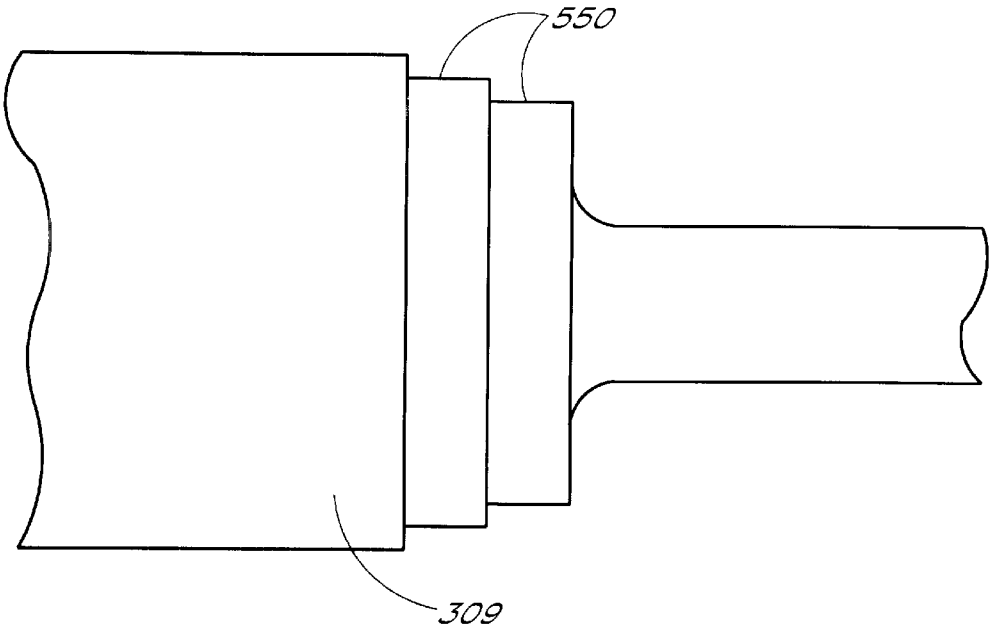
FIG. 71 is an exploded longitudinal sectional view of a stepped valve spool.
Figure 72:
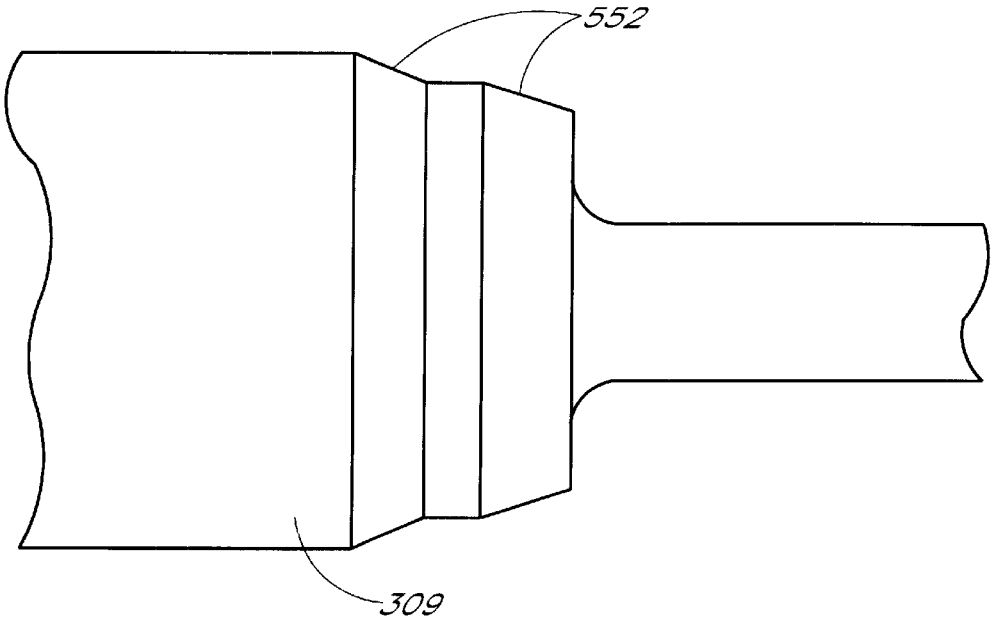
FIG. 72 is an exploded longitudinal sectional view of a stepped tapered valve spool.

The valve spools can also have alternative configurations. For example, the segments 309 may have a single region of smaller diameter at their axial ends, to provide an annular flow conduit for the drilling fluid. In other embodiments, the spools can be provided with a multiplicity of steps and shapes that would allow different mudflow rates through the EST. For example, multiple steps 550 can be provided as shown in FIG. 71. Alternatively, multiple tapered steps 552 may provided as shown in FIG. 72. The spool configurations shown in FIGS. 71 and 72 allow the spool to more quickly "dither" into and out of different positions. Dithering would add surges of pressure to the propulsion cylinders, which may provide a more responsive tool advance, but less fine-tuned control. A stepwise formation of tapers on the spool also tends to prevent drilling mud from plugging gaps between the spool and valve body.

Although the above-described spool configurations can be used to provide different flowrate regulation capabilities, the notched configuration of FIG. 38 is preferred. Notches 312 have a larger minimum dimension than steps or tapered steps as shown in FIGS. 71 and 72. Thus, notches 312 are less likely to become plugged by larger fluid particles, which could render the spool ineffective. Also, the notches are less affected by fluid boundary layers on the spools because the fluid boundary layer represents a smaller percentage of the total cross-sectional area defined by the notches.

Of significance in the design for the spool valves is the radial clearance between the valve body and spool. The clearance is preferably made sufficiently large to resist potential plugging by large particles in the drilling fluid, but sufficiently small to prevent leakage which could inhibit control of the EST. This behavior is attributable to the tendency of some muds (especially those containing barite) to bridge or seal small openings. The clearance is sized within the typical operational characteristics of most drilling fluids. Preferably, the clearance is about 0.0006–0.023 inches.

As mentioned above, the configuration of valves 154, 156, and 158 permits precise control over the volume flowrate of fluid to propulsion cylinders 108, 110, 112, and 114 and packerfeet 104 and 106. In the illustrated embodiment of the EST, the volume flowrate of fluid to the propulsion cylinders can be more precisely controlled and maintained at any flowrate to a minimum of preferably 0.6 gallons per minute, more preferably 0.06 gallons per minute, and even more preferably 0.006 gallons per minute, corresponding to fluid flow only through the notches 312. The ability to control and maintain a substantially constant volume flowrate at such small flow levels permits the EST to operate at slow speeds. For an EST having a diameter of 3.375 inches, the stroke length of the propulsion valve spools is preferably limited so that the maximum volume flowrate into the propulsion cylinders is approximately 0–9 gallons per minute. Preferably, the maximum stroke length from the closed position shown in FIG. 40 is 0.25 inches.

Figure 44A:
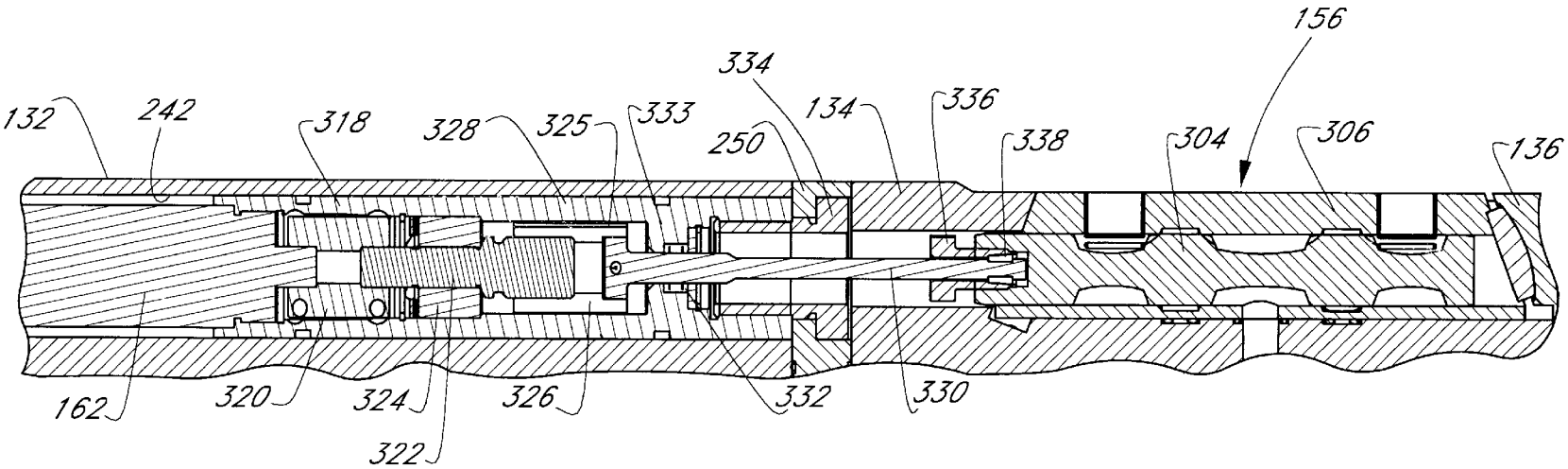

As mentioned above, packerfoot valve 154 and aft and forward propulsion valves 156 and 158 are controlled by motors. In a preferred embodiment, the structural configuration which permits the motors to communicate with the valves is similar for each motorized valve. Thus, only that of aft propulsion valve 156 is described herein. FIGS. 44A and B illustrate the structural configuration of the EST which permits aft propulsion motor 162 to control valve 156. This configuration transforms torque output from the motor into axial translation of valve spool 304. Motor 162 is cylindrical and is secured within a tubular leadscrew housing 318. Motor 162 and leadscrew housing 318 reside in bore 242 of motor housing 132. The forward end of leadscrew housing 318 is retained in abutment with motor mount plate 250 via a retaining bolt 334 which extends through mount plate 250 and is threadingly engaged with the internal surface of housing 318.

Inside leadscrew housing 318, motor 162 is coupled to a leadscrew 322 via motor coupling 320, so that torque output from the motor causes leadscrew 322 to rotate. A bearing 324 is provided to maintain leadscrew 322 along the center axis of housing 318, which is aligned with aft propulsion valve spool 304 in valve housing 134. Leadscrew 322 is threadingly engaged with a leadscrew nut 326. A longitudinal key 325 on leadscrew nut 326 engages a longitudinal slot 328 in leadscrew housing 318. This restricts nut 326 from rotating with respect to leadscrew housing 318, thereby causing nut 326 to rotate along the threads of leadscrew 322. Thus, rotation of leadscrew 322 causes axial translation of nut 326 along leadscrew 322. A stem 330 is attached to the forward end of nut 326. Stem 330 extends forward through annular restriction 333, which separates oil in motor housing 132 from drilling fluid in valve housing 134. The drilling fluid is sealed from the oil via a tee seal 332 in restriction 333. The forward end of stem 330 is attached to valve spool 304 via a spool bolt 336 and split retainer 338. Stem 330 is preferably relatively thin and flexible so that it can compensate for any misalignment between the stem and the valve spool.

Figure 69:
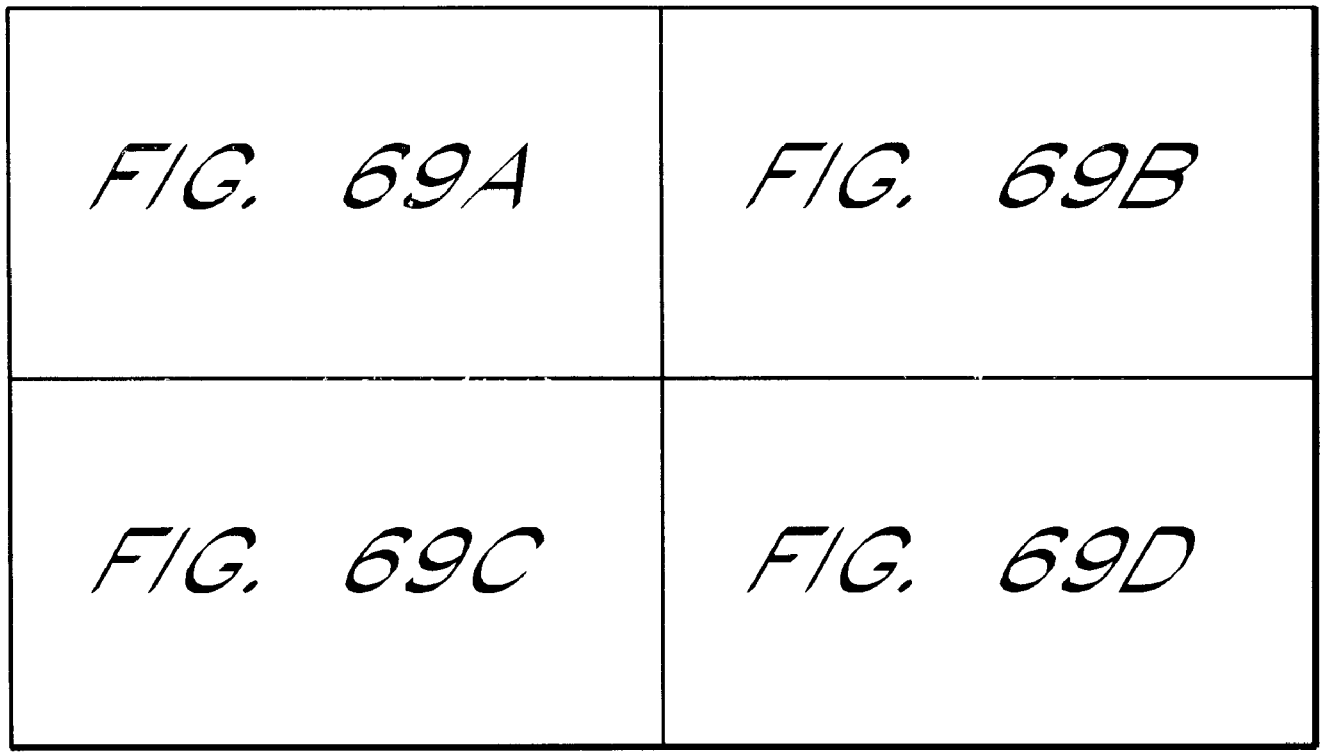
FIG. 69 schematically illustrates the relationship of FIGS. 69A–D.
Figure 69A:
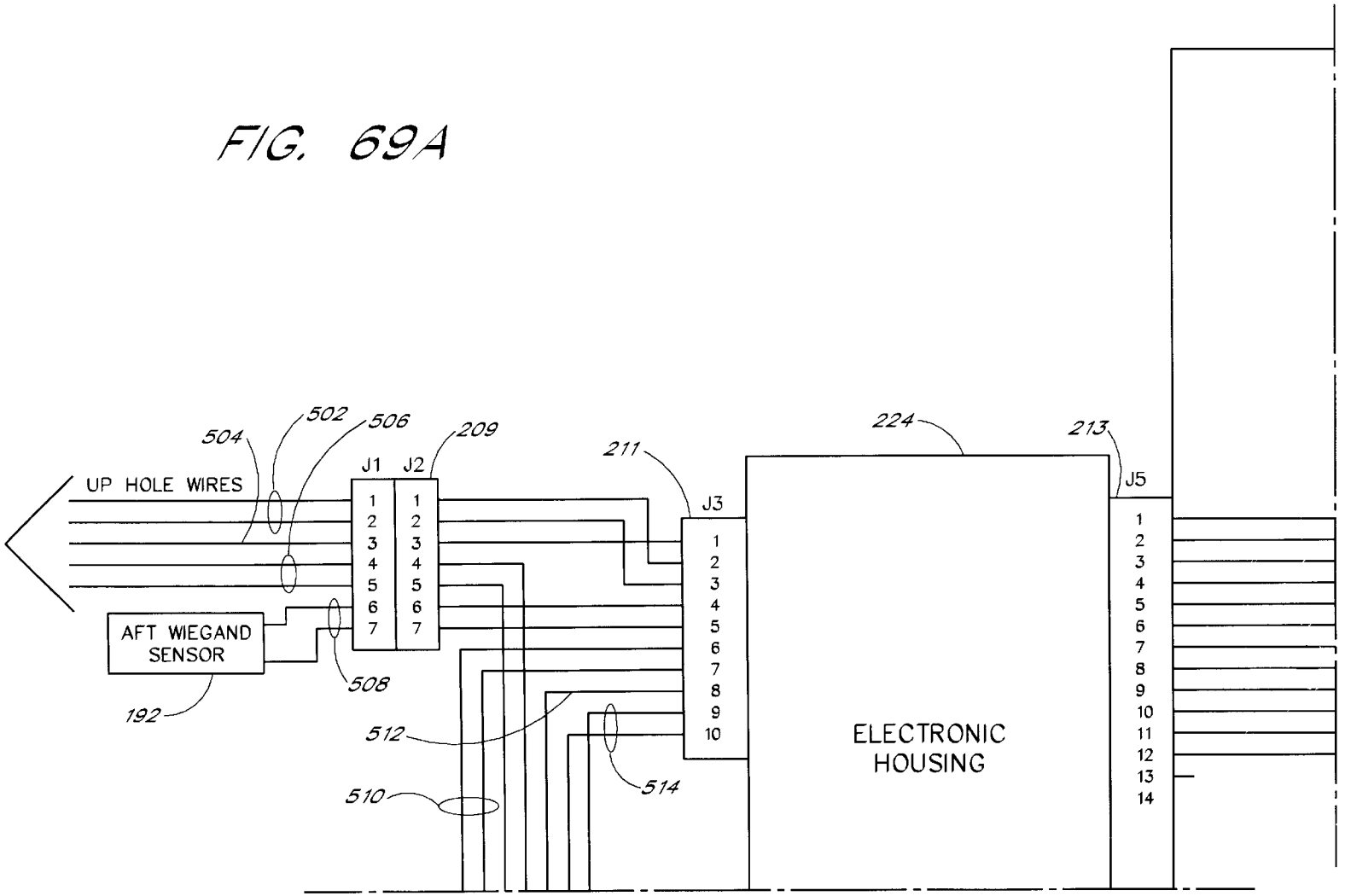
FIGS. 69A–D are a schematic diagram of one embodiment of the electronic configuration of the EST.
Figure 69B:
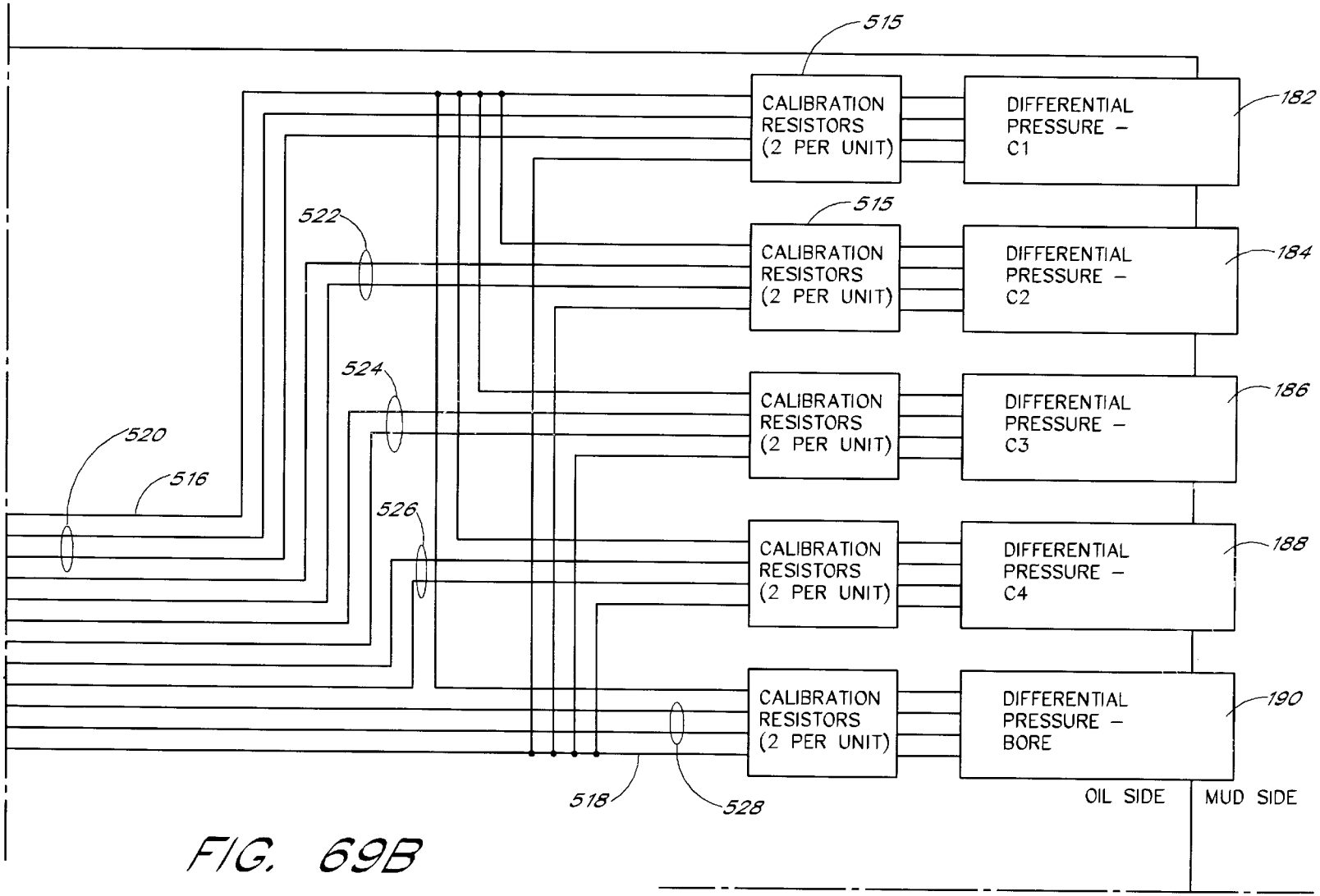
Figure 69C:
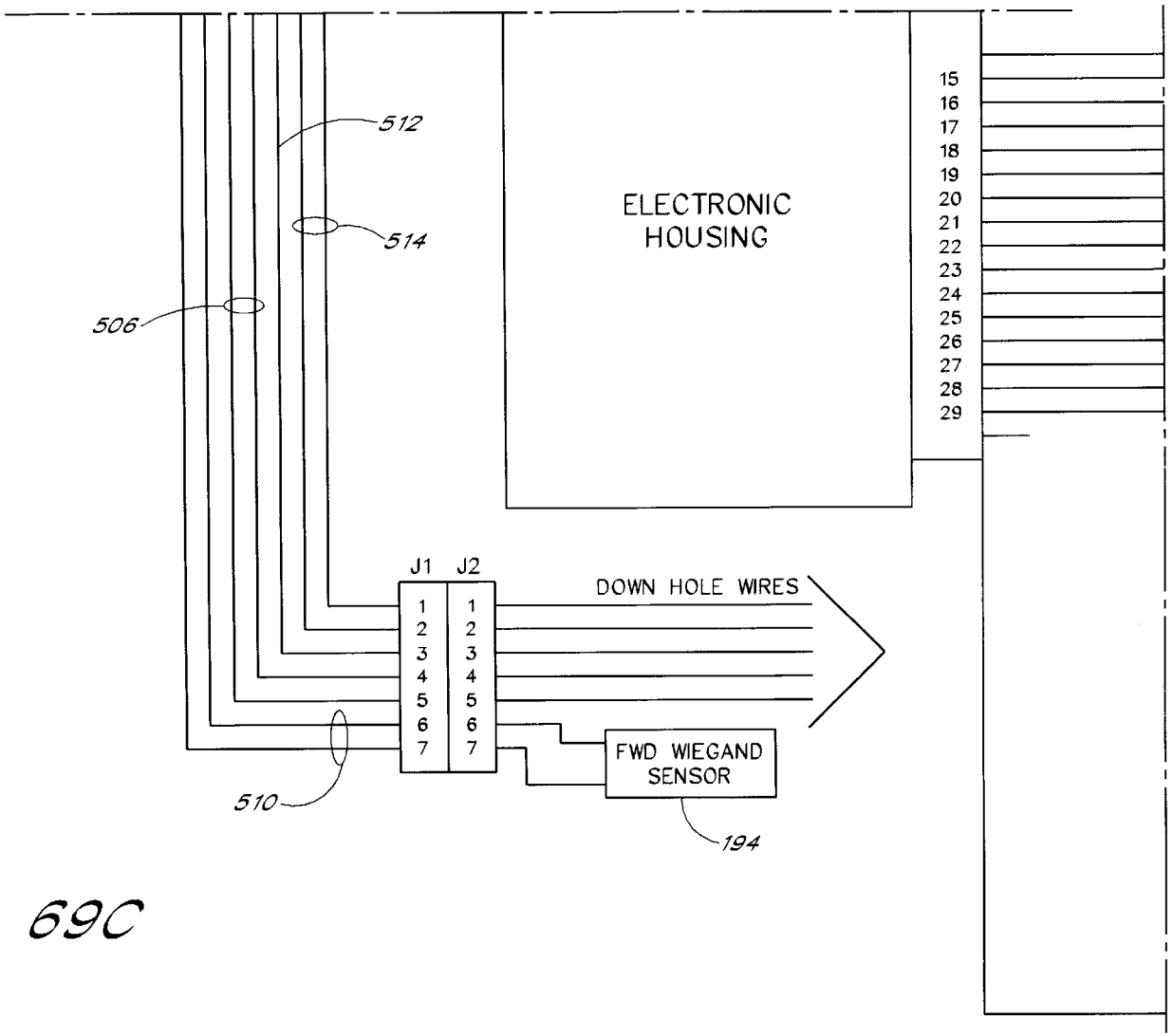
Figure 69D:
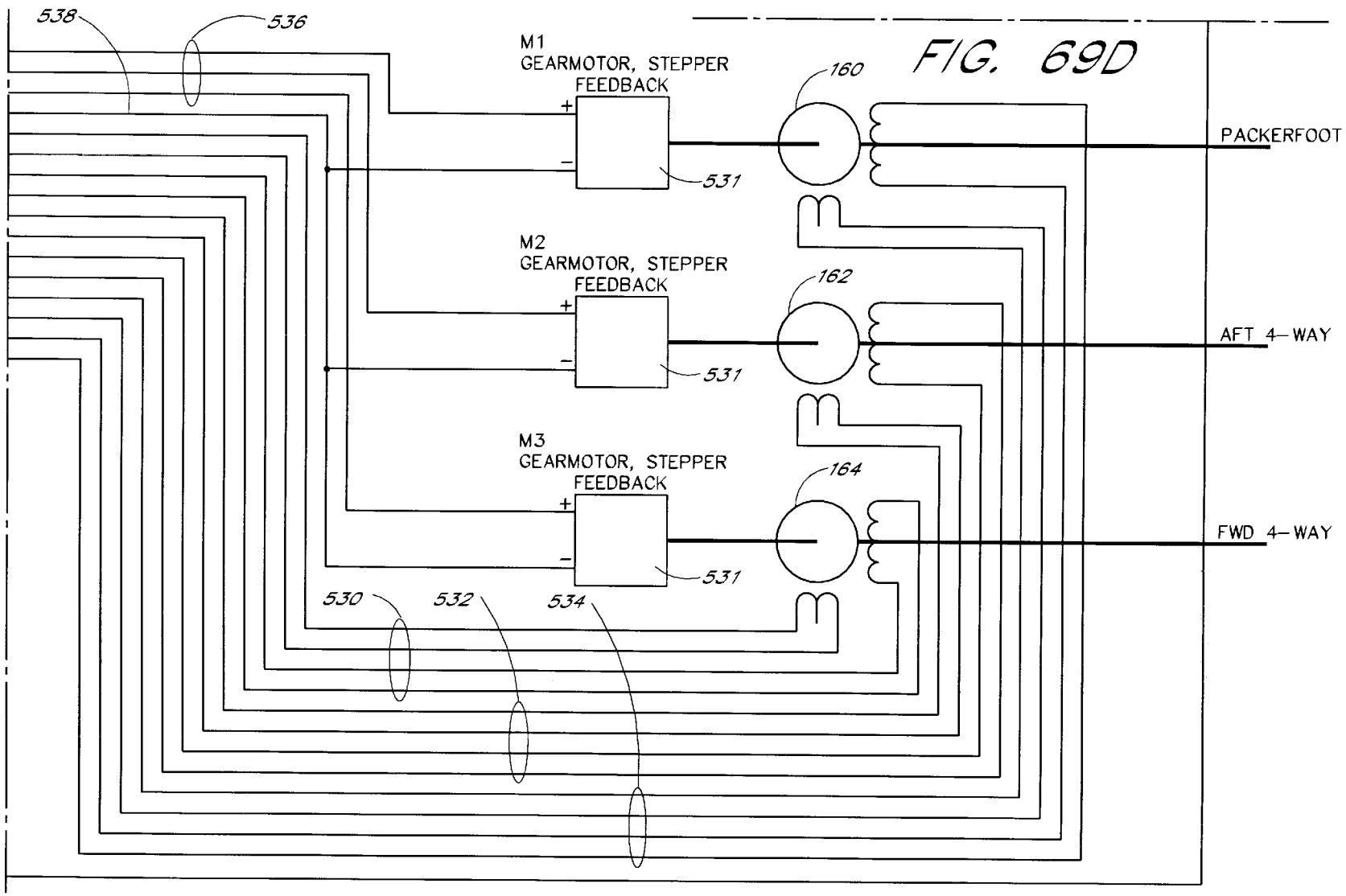

Thus, it can be seen that torque output from the motors is converted into axial translation of the valve spools via leadscrew assemblies as described above. The displacement of the valve spools is monitored by constantly measuring the rotation of the motors. Preferably, rotary accelerometers or potentiometers are built into the motor cartridges to measure the rotation of the motors, as known in the art. The electrical signals from the accelerometers or potentiometers can be transmitted back to logic component 224 via electrical wires 536 and 538 (FIG. 69).

Preferably, motors 160, 162, and 164 are stepper motors, which require fewer wires. Advantageously, stepper motors are brushless. If, in contrast, brush-type motors are used, filaments from the breakdown of the metal brushes may render the oil electrically conductive. Importantly, stepper motors can be instructed to rotate a given number of steps, facilitating precise control of the valves. Each motor cartridge may include a gearbox to generate enough torque and angular velocity to turn the leadscrew at the desired rate. The motor gear box assembly should be able to generate desirably at least 5 pounds, more desirably at least 10 pounds, and even more desirably at least 50 pounds of force and angular velocity of at least 75–180 rpm output. The motors are preferably configured to rotate 12 steps for every complete revolution of the motor output shafts. Further, for an EST having a diameter of 3.375 inches, the motor, gear box, and accelerometer assembly desirably has a diameter no greater than 0.875 inches (and preferably 0.75 inches) and a length no longer than 3.05 inches. A suitable motor is product no. DF7-A sold by CD Astro Intercorp, Inc. of Deerfield, Fla.

In order to optimally control the speed and thrust of the EST, it is desirable to know the relationships between the angular positions of the motor shafts and the flowrates through the valves to the propulsion cylinders. Such relationships depend upon the cross-sectional areas of the flow restrictions acting on the fluid flows through the valves, and thus upon the dimensions of the spools, valve bodies, and fluid ports of the valve bodies. Such relationships also depend upon the thread pitch of the leadscrews. In a preferred embodiment, the leadscrews have about 8–32 threads per inch.

Inside motor housing 132, bores 240, 242, and 244 contain the motors as well as electrical wires extending rearward to electronics unit 92. For optimal performance, these bores are preferably filled with an electrically nonconductive fluid, to reduce the risk of ineffective electrical transmission through the wires. Also, since the pressure of the motor chambers is preferably equalized to the pressure of annulus 40 via a pressure compensation piston (as described below), such fluid preferably has a relatively low compressibility, to minimize the longitudinal travel of the compensation piston. A preferred fluid is oil, since the compressibility of oil is much less than that of air. At the aft end of motor housing 132, these bores are fluidly open to the space surrounding pressure transducer manifold 222. Thus, the outer ends of pressure transducers 182, 184, 186, 188, and 190 are also exposed to oil.

Figure 45:
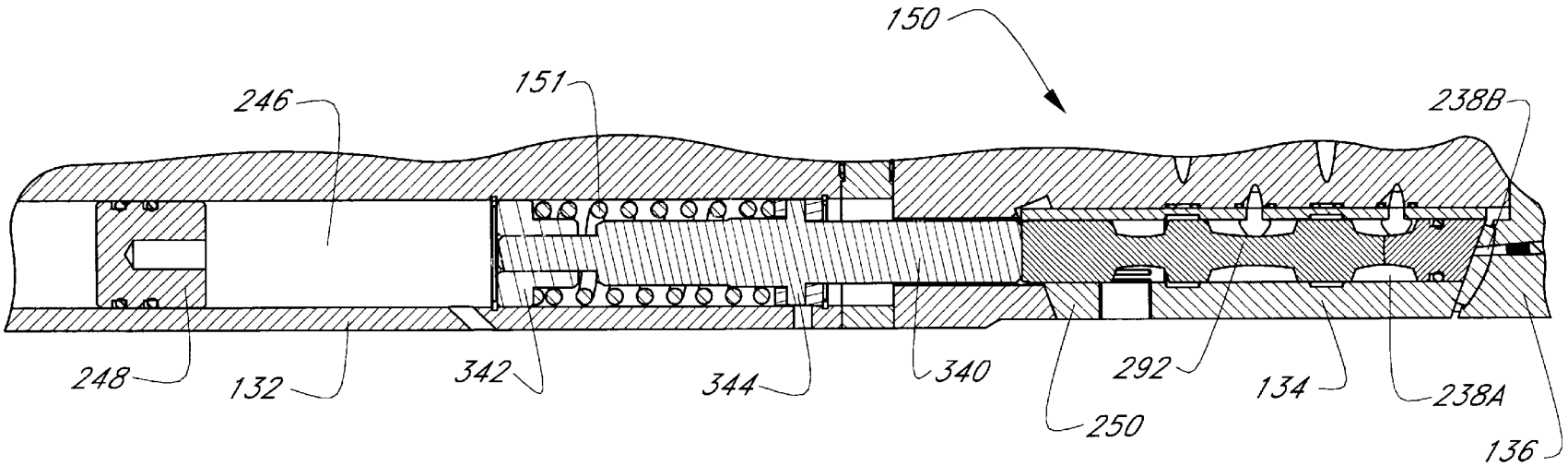
FIG. 45 is a longitudinal partially sectional view of the EST, showing the failsafe valve spring and pressure compensation piston.

FIG. 45 illustrates the assembly and operation of failsafe valve 150. The aft end of failsafe valve spool 292 abuts a spring guide 340 that slides inside passage 246 within motor housing 132, motor mount plate 250, and valve housing 134. Inside motor housing 132 passage 246 has an annular spring stop 342 which is fixed with respect to housing 132. Guide 340 has an annular flange 344. Failsafe valve spring 151, preferably a coil spring, resides within passage 246 so that its ends abut stop 342 and flange 344. Fluid within passage 238A (from the exit of diffuser 148) exerts an axial force on the forward end of spool 292, which is countered by spring 151. As shown, a spacer having a passage 238B may be provided to absorb tolerances between the mating surfaces of valve housing 134 and forward transition housing 136. Passage 238B fluidly communicates with passage 238A and with spool passage 298 of failsafe valve body 294. When the fluid pressure in passage 238A exceeds a particular threshold, the spring force is overcome to open failsafe valve 150 as shown in FIG. 37. Spring 151 can be carefully chosen to compress at a desired threshold fluid pressure in passage 238A.

When the EST is removed from a borehole, drilling fluid residue is likely to remain within passage 246 of motor housing 132. As shown in FIGS. 17–18, a pair of cleaning holes 554 may be provided which extend into passage 246. Such holes permit passage 246 to be cleaned by spraying water through the passage, so that spring 153 operates properly during use. During use, holes 554 may be plugged so that the drilling fluid does not escape to annulus 40.

Figure 44B:
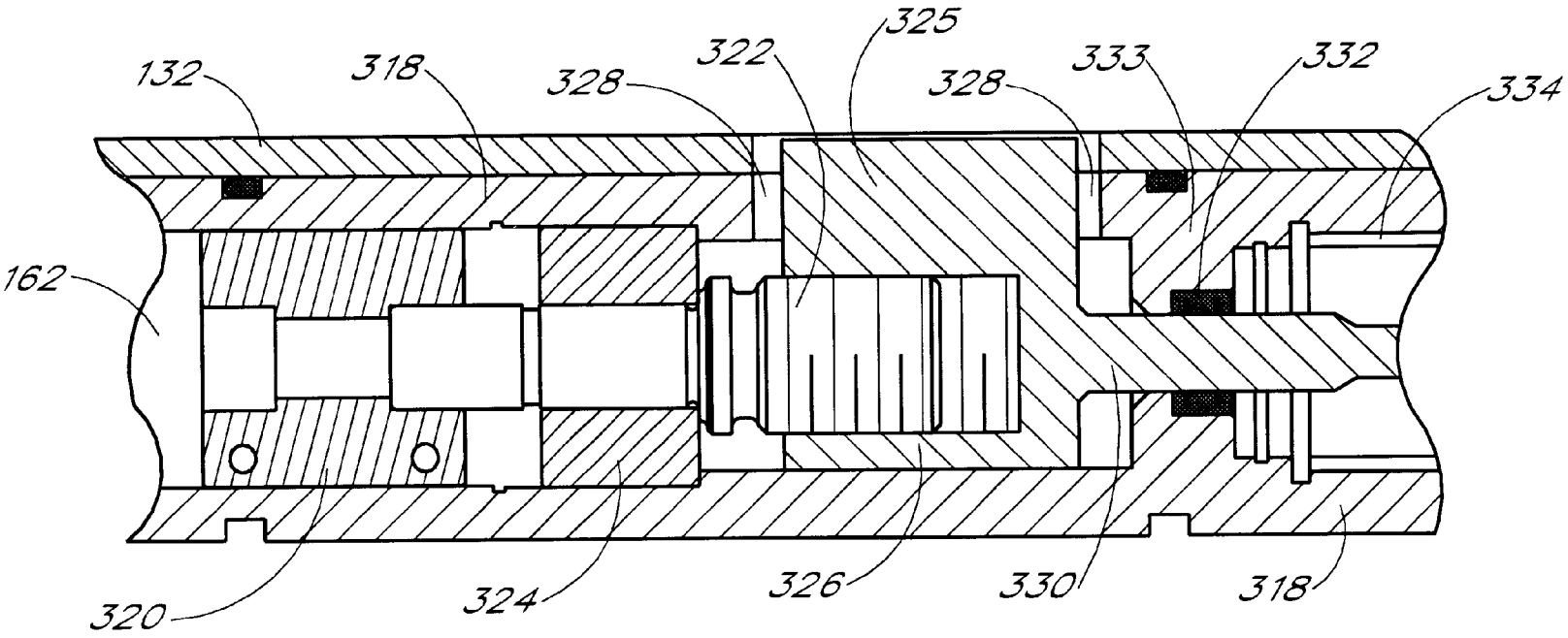

Referring to FIGS. 44A–B, the leadscrew assemblies for the motorized valves contain drilling fluid from annulus 40. Such fluid enters the leadscrew assemblies via the exhaust vents in the valve bodies, and surrounds portions of the valve spools and stems 330 forward of annular restrictions 333. As mentioned above, the chambers rearward of restrictions 333 are filled with oil. In order to move the valve spools, the motors must produce sufficient torque to overcome (1) the pressure difference between the drilling fluid and the oil, and (2) the seal friction caused by tee seals 332. Since the fluid pressure in annulus 40 can be as high as 16,000 psi, the oil pressure is preferably equalized with the fluid pressure in annulus 40 so that the pressure difference across seals 332 is zero. Absent such oil pressure compensation, the motors would have to work extremely hard to advance the spools against the high pressure drilling fluid. A significant pressure difference can cause the motors to stall. Further, if the pressure difference across seals 332 is sufficiently high, the seals would have to be very tight to prevent fluid flow across the seals. However, if the seals were very tight they would hinder and, probably, prevent movement of the stems 330 and hence the valve spools.

With reference to FIG. 45, a pressure compensation piston 248 is preferably provided to avoid the above-mentioned problems. Preferably, piston 248 resides in passage 246 of motor housing 132. Piston 248 seals drilling fluid on its forward end from oil on its aft end, and is configured to slide axially within passage 246. As the pressure in annulus 40 increases, piston 248 slides rearward to equalize the oil pressure with the drilling fluid pressure. Conversely, as the pressure in annulus 40 decreases, piston 248 slides forward. Advantageously, piston 248 effectively neutralizes the net longitudinal fluid pressure force acting on each of the valve spools by the drilling fluid and oil. Piston 248 also creates a zero pressure difference across seals 332 of the leadscrew assemblies of the valves.

Figure 46:
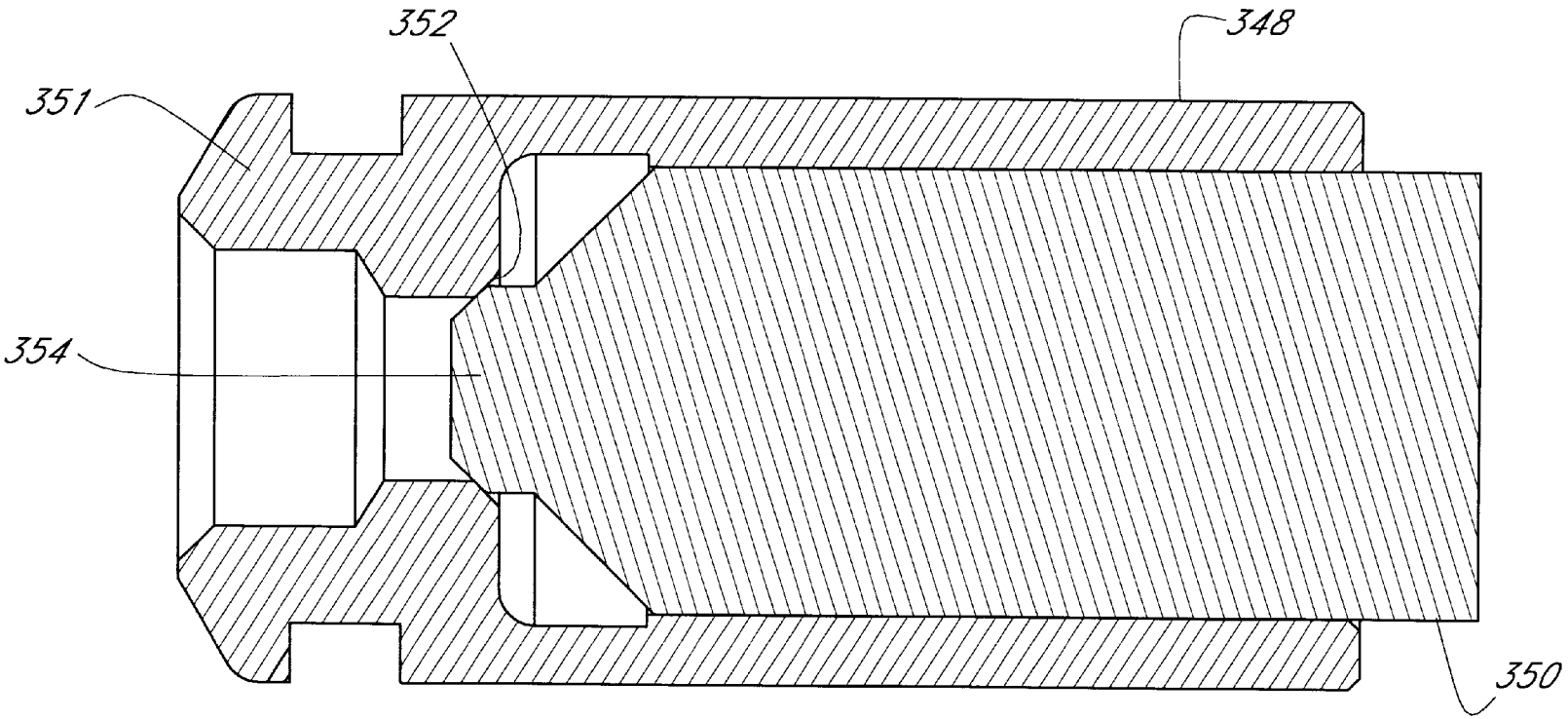
FIG. 46 is a longitudinal sectional view of the relief valve poppet and relief valve body of the EST.
Figure 47:
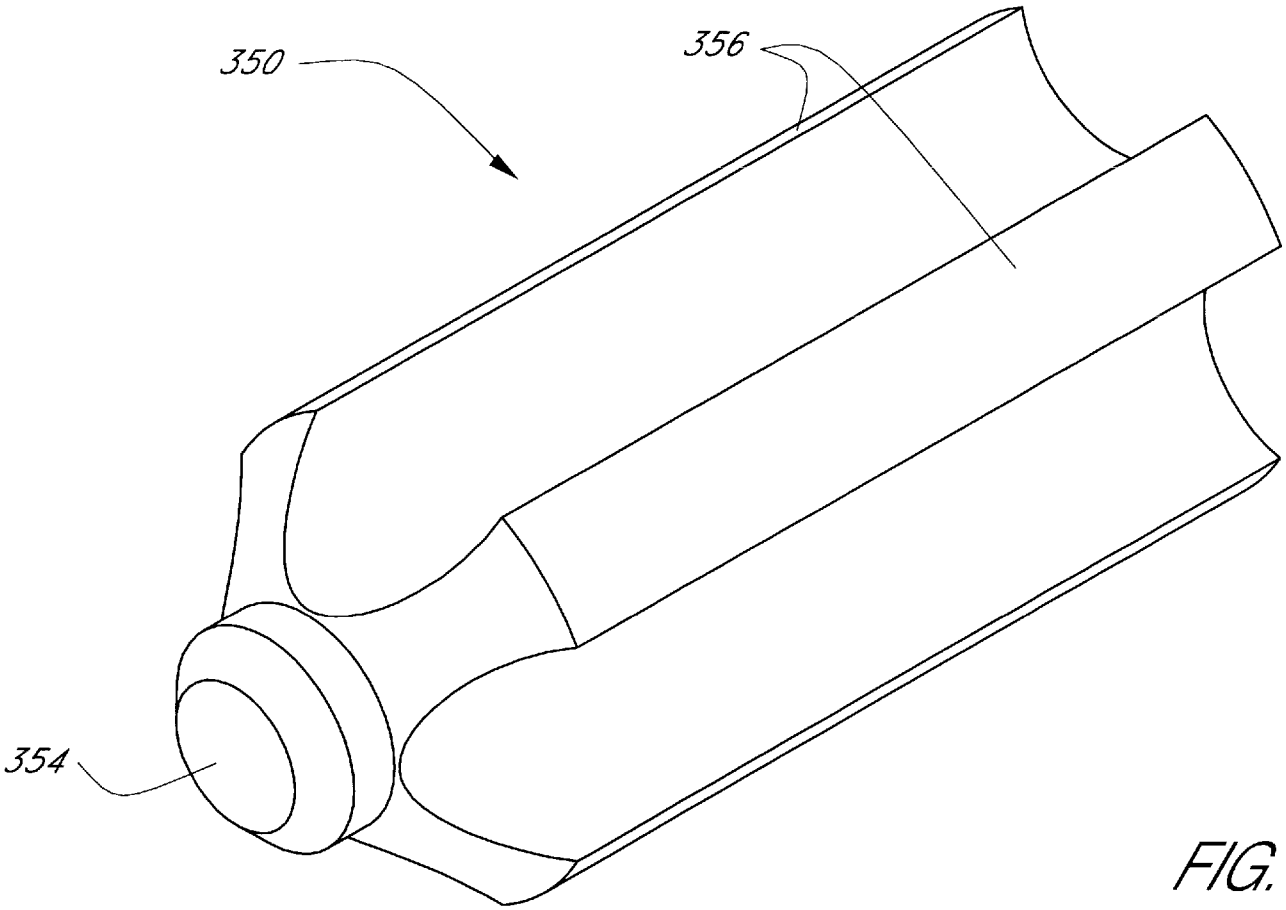
FIG. 47 is a rear perspective view of the relief valve poppet of FIG. 46.
Figure 48:
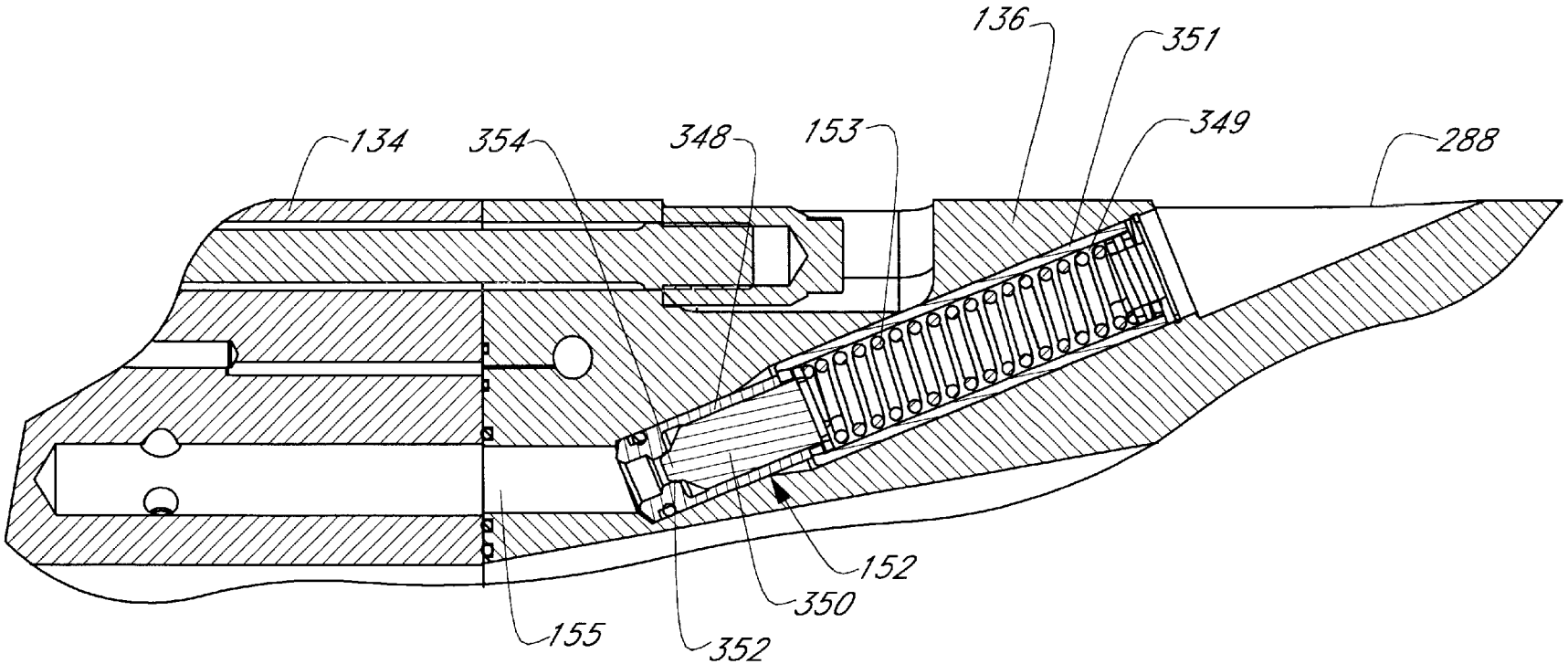
FIG. 48 is a longitudinal sectional view of the EST, showing the relief valve assembly.

FIGS. 46–48 illustrate the configuration and operation of relief valve 152. Relief valve 152 comprises a valve body 348, poppet 350, and coil spring 153. Body 348 is generally tubular and has a nose 351 and an internal valve seat 352. Poppet 350 has a rounded end 354 configured to abut valve seat 352 to close the valve. Poppet 350 also has a plurality of longitudinal ribs 356 between which fluid may flow out to annulus 40. Inside forward transition housing 136, relief valve body 348 resides within a diagonal portion 349 of galley 155 which extends to orifice 288 and out to annulus 40. Body 348 is tightly and securely received within the aft end of diagonal bore 349. A tube 351 resides forward of body 348. Tube 351 houses relief valve spring 153. Poppet 350 is slidably received within body 348. The forward end of poppet 350 abuts the aft end of spring 153. The forward end of spring 153 is held by an internal annular flange of tube 351. In operation, the drilling fluid inside galley 155 exerts a force on rounded end 354 of poppet 350, which is countered by spring 153. As the fluid pressure rises, the force on end 354 also rises. If the fluid pressure in galley 155 exceeds a threshold pressure, the spring force is overcome, forcing end 354 to unseat from valve seat 352. This permits fluid from galley 155 to exhaust out to annulus 40 through bore 349 and between the ribs 356 of poppet 350.

In a preferred embodiment, control assembly 102 is substantially cylindrical with a diameter of about 3.375 inches and a length of about 46.7 inches. Housings 130, 131, 132, 134, and 136 are preferably constructed of a high strength material, to prevent erosion caused by exposure to harsh drilling fluids such as calcium bromide or cesium formate muds. In general, the severity and rate of erosion depends on the velocity of the drilling fluid to which the material is exposed, the solid material within the fluid, and the angle at which the fluid strikes a surface. In operation, the control assembly housings are exposed to drilling mud velocities of 0 to 55 feet per second, with typical mean operating speeds of less than 30 feet per second (except within the valves). Under these conditions, a suitable material for the control assembly housings is Stabaloy, particularly Stabaloy AG 17. In the valves, mud flow velocities can be as high as 150 feet per second. Thus, the valves and valve bodies are preferably formed from an even more erosion-resistant material, such as tungsten carbide, Ferro-Tec (a proprietary steel formed of titanium carbide and available from Alloy Technologies International, Inc. of West Nyack, N.Y.), or similar materials. The housings and valves may be constructed from other materials, giving due consideration to the goal of resisting erosion.

Shaft Assemblies

In a preferred embodiment, the aft and forward shaft assemblies are structurally similar. Thus, only the aft shaft assembly is herein described in detail. FIG. 49 shows the configuration of the aft shaft assembly. Aft packerfoot 104, flexible connector 120, cylinder 108, flexible connector 122, and cylinder 110 are connected together end to end and are collectively slidably engaged on aft shaft 118. Annular pistons 140 and 142 are attached to shaft 118 via bolts secured into bolt holes 360 and 362, respectively. O-rings or specialized elastomeric seals may be provided between the pistons and the shaft to prevent flow of fluid under the pistons. Cylinders 108 and 110 enclose pistons 140 and 142, respectively. The forward and aft ends of each propulsion cylinder are sealed, via tee-seals, O-rings, or otherwise, to prevent the escape of fluid from within the cylinders to annulus 40. Also, seals are provided between the outer surface of the pistons 140 and 142 and the inner surface of the cylinders 108 and 110 to prevent fluid from flowing between the front and rear chambers of the cylinders.

Connectors 120 and 122 may be attached to packerfoot 104 and cylinders 108 and 110 via threaded engagement, to provide high-pressure integrity and avoid using a multiplicity of bolts or screws. Tapers may be provided on the leading edges of connectors 120 and 122 and seal cap 123 attached to the forward end of cylinder 110. Such tapers help prevent the assembly from getting caught against sharp surfaces such as milled casing passages.

A plurality of elongated rotation restraints 364 are preferably attached onto shaft 118, which prevent packerfoot 104 from rotating with respect to the shaft. Restraints 364 are preferably equally spaced about the circumference of shaft 118, and can be attached via bolts as shown. Preferably four restraints 364 are provided. Packerfoot 104 is configured to engage the restraints 364 so as to prevent rotation of the packerfoot with respect to the shaft, as described in greater detail below.

Figures 50, 51, 52, 53, 54:
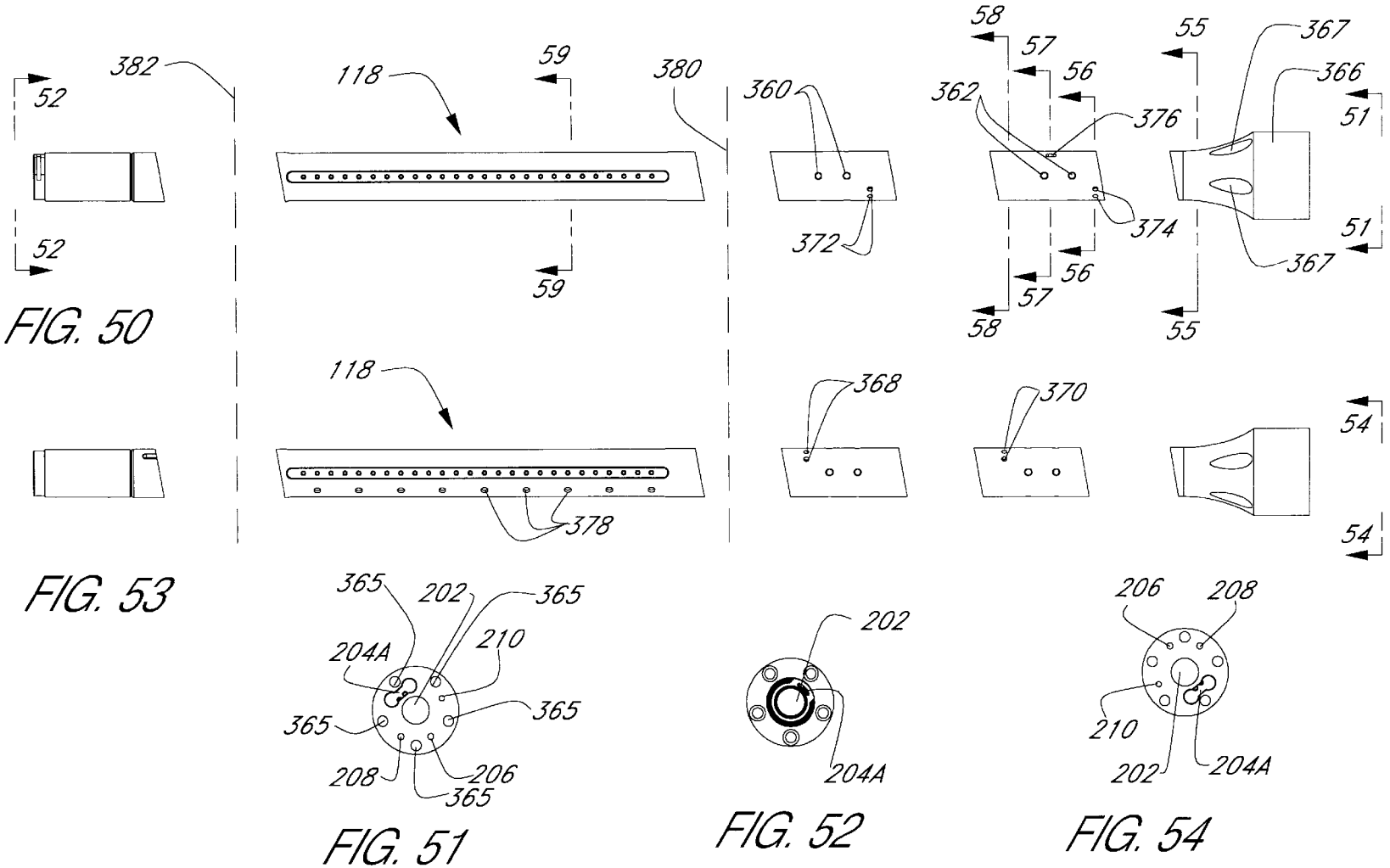
FIG. 50 is a side view of the aft shaft of the EST.
FIG. 51 is a front view of the aft shaft of FIG. 50.
FIG. 52 is a rear view of the aft shaft of FIG. 50.
FIG. 53 is a side view of the aft shaft of FIG. 50, shown rotated 180° about its longitudinal axis.
FIG. 54 is a front view of the aft shaft of FIG. 53.

FIGS. 50–59 illustrate in greater detail the configuration of shaft 118. At its forward end, shaft 118 has a flange 366 which is curved for more even stress distribution. Flange 366 includes bores for fluid passages 202, 206, 208, and 210, which align with corresponding bores in aft transition housing 131. Note that the sizes of these passages may be varied to provide different flowrate and speed capacities of the EST. In addition, a pair of wire passages 204A is provided, one or both of the passages aligning with wire bore 204 of housing 131. Electrical wires 502, 504, 506, and 508 (FIG. 69), which run up to the surface and, in one embodiment, to a position sensor on piston 142, reside in passages 204A. As shown in FIG. 52, only wire passages 204A and supply passage 202 extend to the aft end of shaft 118.

Figure 56:
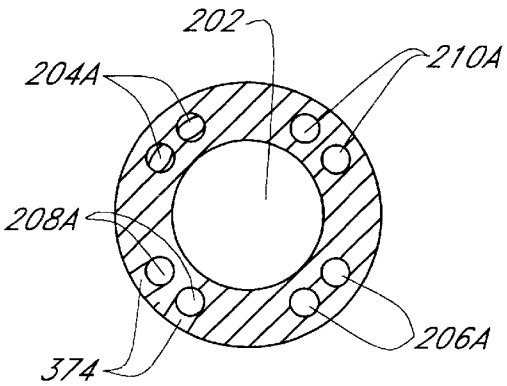
FIG. 56 is a cross-sectional view of the aft shaft, taken along line 56—56 shown in FIGS. 49 and 50.
Figure 55:
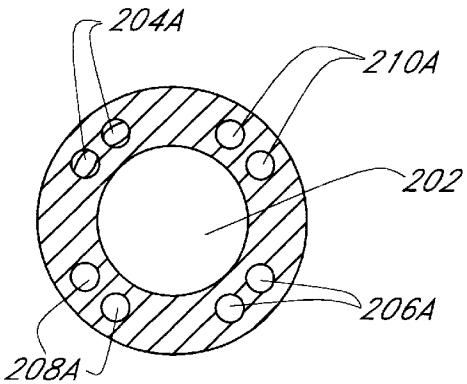
FIG. 55 is a cross-sectional view of the aft shaft, taken along line 55—55 shown in FIGS. 49 and 50.
Figure 58:
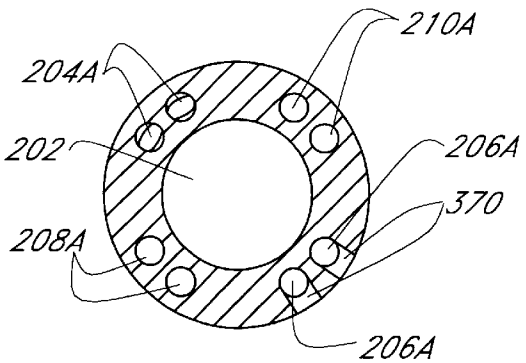
FIG. 58 is a cross-sectional view of the aft shaft, taken along line 58—58 shown in FIGS. 49 and 50.

As shown in FIG. 55, within shaft 118 fluid passages 206, 208, and 210 each comprise a pair of passages 206A, 208A, and 210A, respectively. Preferably, the passages split into pairs inside of flange 366. In the illustrated embodiment, pairs of gun-drilled passages are provided instead of single larger passages because larger diameter passages could jeopardize the structural integrity of the shaft. With reference to FIG. 53, passages 206A deliver fluid to rear chambers 166 and 170 of propulsion cylinders 108 and 110 via fluid ports 368 and 370, respectively. FIG. 58 shows ports 370 which communicate with rear chamber 170 of cylinder 110. These ports are transverse to the longitudinal axis of shaft 118. Ports 368 are configured similarly to ports 370. With reference to FIG. 50, passages 208A deliver fluid to front chambers 168 and 172 of cylinders 108 and 110 via fluid ports 372 and 374, respectively. Ports 374 are shown in FIG. 56. Ports 372 are configured similarly to ports 374. Passages 206A and 208A are provided for the purpose of delivering fluid to the propulsion cylinders. Hence, passages 206A and 208A do not extend rearwardly beyond longitudinal position 380.

Figure 59:
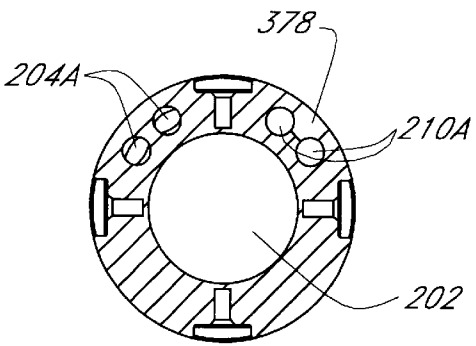
FIG. 59 is a cross-sectional view of the aft shaft, taken along line 59—59 shown in FIGS. 49 and 50.

With reference to FIG. 53, passages 210A deliver fluid to aft packerfoot 104, via a plurality of fluid ports 378. Ports 378 are preferably arranged linearly along shaft 118 to provide fluid throughout the interior space of packerfoot 104. In the preferred embodiment, nine ports 378 are provided. FIG. 59 shows one of the ports 378, which fluidly communicates with each of passages 210A. Since passages 210A are provided for the purpose of delivering fluid to aft packerfoot 104, such passages do not extend rearwardly beyond longitudinal position 382.

Figure 57:
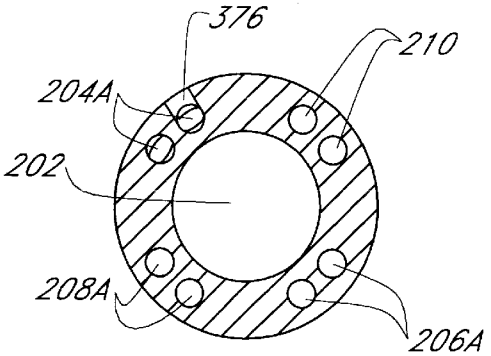
FIG. 57 is a cross-sectional view of the aft shaft, taken along line 57—57 shown in FIGS. 49 and 50.

With reference to FIG. 50, a wire port 376 is provided in shaft 118. Port 376 permits electrical communication between control assembly 102 and position sensor 192 (FIGS. 4A–F) on piston 142. For example, a Wiegand sensor or magnetometer device (described below) may be located on piston 142. Port 376 is also shown in FIG. 57.

In a preferred embodiment, some of the components of the EST are formed from a flexible material, so that the overall flexibility of the tool is increased. Also, the components of the tool are preferably non-magnetic, since magnetic materials can interfere with the performance of magnetic displacement sensors. Of course, if magnetic displacement sensors are not used, then magnetic materials are not problematic. A preferred material is copper-beryllium (CuBe) or CuBe alloy, which has trace amounts of nickel and iron. This material is non-magnetic and has high strength and a low tensile modulus. With reference to FIG. 2, shafts 118 and 124, propulsion cylinders 108, 110, 112, and 114, and connectors 120, 122, 126, and 128 may be formed from CuBe. Pistons 140 and 142 may also be formed from CuBe or CuBe alloy. The cylinders are preferably chrome-plated for maximum life of the seals therein.

Figure 73A:
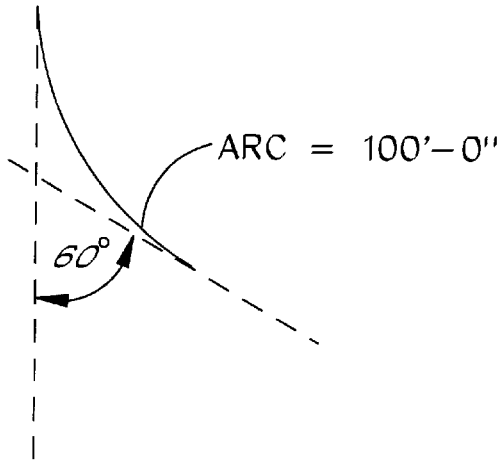
FIG. 73A is a chord illustrating the turning ability of the EST.
Figure 73B:
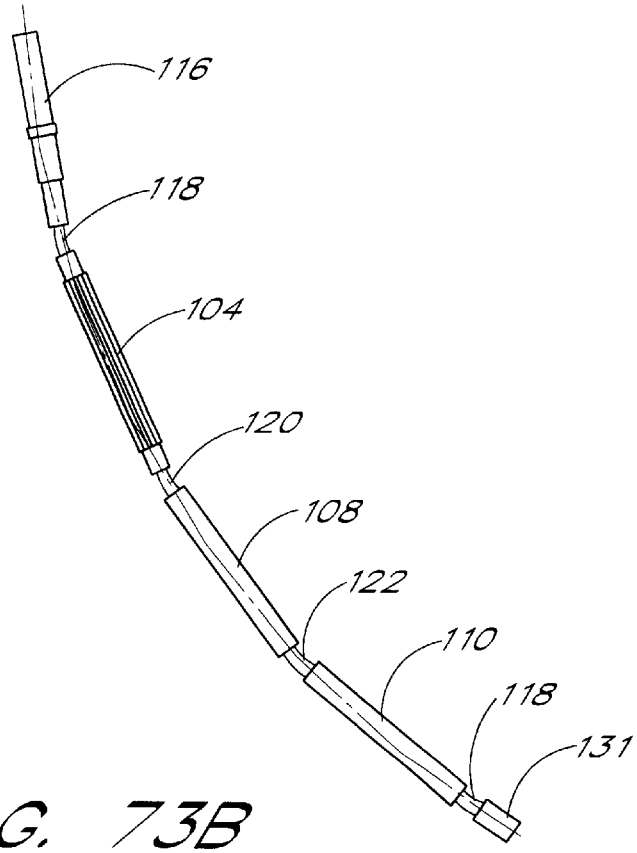
FIG. 73B is a schematic view illustrating the flexing characteristics of the aft shaft assembly of the EST.

In a preferred embodiment, each shaft is about 12 feet long, and the total length of the EST is about 32 feet. Preferably, the propulsion cylinders are about 25.7 inches long and 3.13 inches in diameter. Connectors 120, 122, 126, and 128 are preferably smaller in diameter than the propulsion cylinders and packerfeet at their center. The connectors desirably have a diameter of no more than 2.75 inches and, preferably, no more than 2.05 inches. This results in regions of the EST that are more flexible than the propulsion cylinders and control assembly 102. Consequently, most of the flexing of the EST occurs within the connectors and shafts. In one embodiment, the EST can turn up to 60° per 100 feet of drilled arc. FIG. 73A shows an arc curved to schematically illustrate the turning capability of the tool. FIG. 73B schematically shows the flexing of the aft shaft assembly of the EST. The degree of flexing is somewhat exaggerated for clarity. As shown, the flexing is concentrated in aft shaft 118 and connectors 120 and 122.

Figure 68:
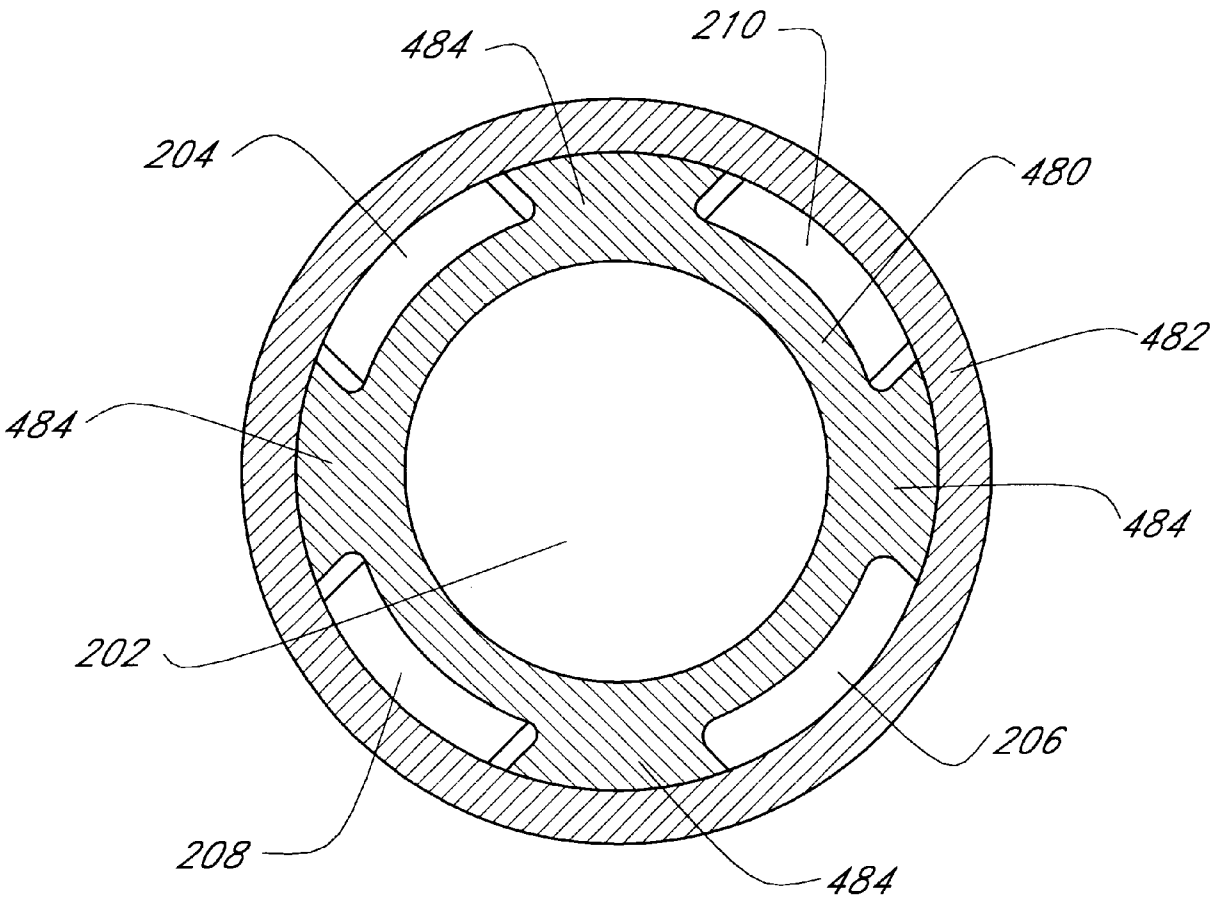
FIG. 68 is a cross-sectional view of a shaft of the EST, formed by diffusion-bonding.

Shafts 118 and 124 can be constructed according to several different methods. One method is diffusion bonding, wherein each shaft comprises an inner shaft and an outer shaft, as shown in FIG. 68. Inner shaft 480 includes a central bore for fluid supply passage 202, and ribs 484 along its length. The outer diameter of inner shaft 480 at the ribs 484 is equal to the inner diameter of outer shaft 482, so that inner shaft 480 fits tightly into outer shaft 482. Substantially the entire outer surface of ribs 484 mates with the inner surface of shaft 482. Longitudinal passages are formed between the shafts. In aft shaft 118, these are passages 204 (wires), 206 (fluid to rear chambers of aft propulsion cylinders), 208 (fluid to front chambers of aft propulsion cylinders), and 210 (fluid to aft packerfoot).

The inner and outer shafts 480 and 482 may be formed by a co-extrusion process. Shafts 480 and 482 are preferably made from CuBe alloy and annealed with a "drill string" temper process (annealing temper and thermal aging) that provides excellent mechanical properties (tensile modulus of 110,000–130,000 psi, and elongation of 8–10% at room temperature). The inner and outer shafts are then diffusion bonded together. Accordingly, the shafts are coated with silver, and the inner shaft is placed inside the outer shaft. The assembly is internally pressurized, externally constrained, and heated to approximately 1500° F. The CuBe shafts expand under heat to form a tight fit. Heat also causes the silver to diffuse into the CuBe material, forming the diffusion bond. Experiments on short pieces of diffusion-bonded shafts have demonstrated pressure integrity within the several passages. Also, experiments with short pieces have demonstrated diffusion bond shear strengths of 42,000 to 49,000 psi.

After the shafts are bonded together, the assembly is electrolitically chrome-plated to increase the life of the seals on the shaft. Special care is made to minimize the thickness of the chrome to allow both long life and shaft flexibility. The use of diffusion bonding permits the unique geometry shown in FIG. 68, which maximizes fluid flow channel area and simultaneously maximizes the torsional rigidity of the shaft. In a similar diffusion bonding process, the flange portion 366 (FIGS. 49A–B) can be bonded to the end of the shaft.

Alternatively, other materials and constructions can be used. For example, Monel or titanium alloys can be used with appropriate welding methods. Monel is an acceptable material because of its non-magnetic characteristics. However, Monel's high modulus of elasticity or Young's Modulus tends to restrict turning radius of the tractor to less than 40° per 100 feet of drilled arc. Titanium is an acceptable material because of its non-magnetic characteristics, such as high tensile strength and low Young's modulus (compared to steel). However, titanium welds are known to have relatively short fatigue life when subjected to drilling environments.

In another method of constructing shafts 118 and 124, the longitudinal wire and fluid passages are formed by "gun-drilling," a well-known process used for drilling long holes. Advantages of gun-drilling include moderately lower torsional and bending stiffness than the diffusion-bonded embodiment, and lower cost since gun-drilling is a more developed art. When gun-drilling a hole, the maximum length and accuracy of the hole depends upon the hole diameter. The larger the hole diameter, the longer and more accurately the hole can be gun-drilled. However, since the shafts have a relatively small diameter and have numerous internal passages, too great a hole diameter may result in inability of the shafts to withstand operational bending and torsion loads. Thus, in selecting an appropriate hole diameter, the strength of the shaft must be balanced against the ability to gun-drill long, accurate holes.

The shaft desirably has a diameter of 1–3.5 inches and a fluid supply passage of preferably 0.6–1.75 inches in diameter, and more preferably at least 0.99 inches in diameter. In a preferred embodiment of the EST, the shaft diameter is 1.746–1.748 inches, and the diameter of fluid supply passage 202 is 1 inch. For an EST having a diameter of 3.375 inches, the shafts are designed to survive the stresses resulting from the combined loads of 1000 ft-lbs of torque, pulling-thrusting load up to 6500 pounds, and bending of 60° per 100 feet of travel. Under these constraints, a suitable configuration is shown in FIG. 55, which shows aft shaft 118. Passages 204A, 206A, 208A, and 210A comprise pairs of holes substantially equally distanced between the inner surface of passage 202 and the outer surface of shaft 118. For each passage, a pair of holes is provided so that the passages have sufficient capacity to accommodate required operational drilling fluid flowrates. This configuration is chosen instead of a single larger hole, because a larger hole may undesirably weaken the shaft. Each hole has a diameter of 0.188 inch. The holes of each individual pair are spaced apart by approximately one hole diameter. For a hole diameter of 0.188 inch, it may not be possible to gun-drill through the entire length of each shaft 118 and 124. In that case, each shaft can be made by gun-drilling the holes into two or more shorter shafts and then electron beam (EB) welding them together end to end.

The welded shaft is then preferably thermally annealed to have desired physical properties, which include a tensile modulus of approximately 19,000,000 psi, tensile strength of approximately 110,000–130,000 psi, and elongation of about 8–12%. The shaft can be baked at 1430° F. for 1–8 hours depending upon the desired characteristics. Details of post-weld annealing methods are found in literature about CuBe. After the thermal annealing step, the welded shaft is then finished, machined, ground, and chrome-plated.

Packerfeet

Figure 49A:
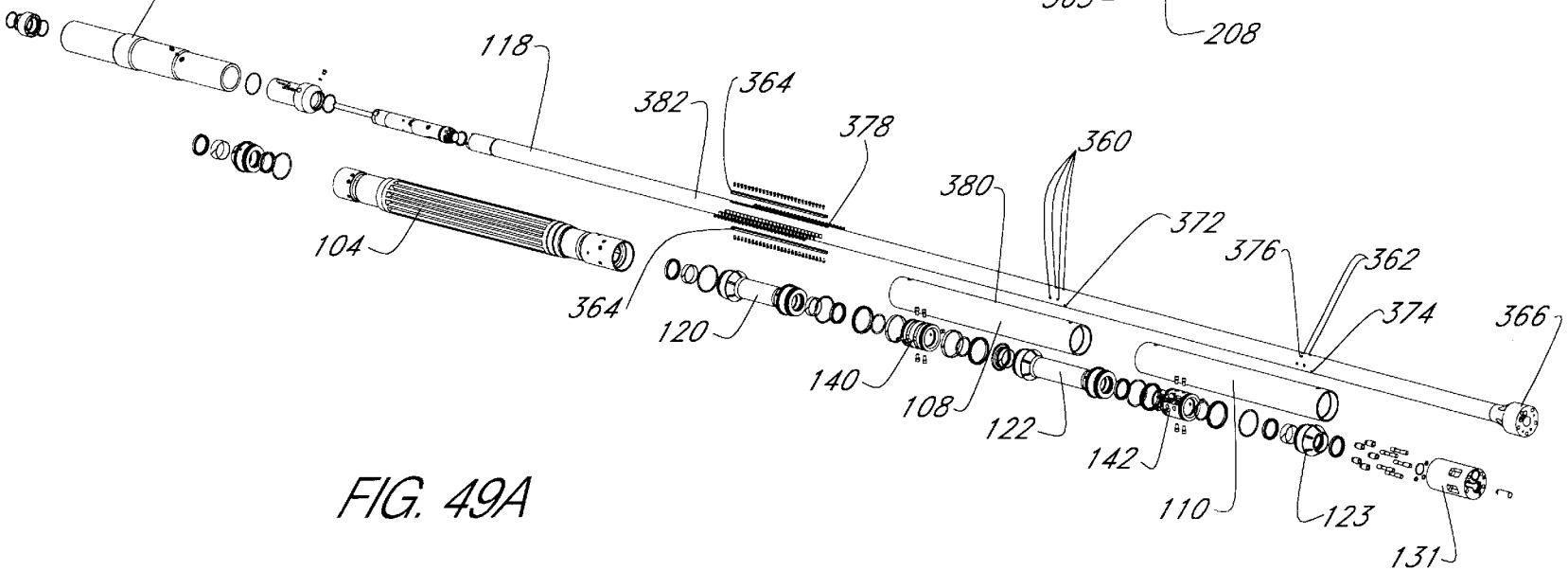
FIG. 49A is a front perspective view of the aft section of the EST, shown disassembled.

FIGS. 60–64 and 74–75 show one embodiment of aft packerfoot 104. The major components of packerfoot 104 comprise a mandrel 400, bladder assembly 404, end clamp 414, and connector 420. Mandrel 400 is generally tubular and has internal grooves 402 sized and configured to slidably engage rotation restraints 364 on aft shaft 118 (FIG. 49A). Thus, mandrel 400 can slide longitudinally, but cannot rotate, with respect to shaft 118. Bladder assembly 404 comprises generally rigid tube portions 416 and 417 attached to each end of a substantially tubular inflatable engagement bladder 406. Assembly 404 generally encloses mandrel 400. On the aft end of packerfoot 104, assembly 404 is secured to mandrel 400 via eight bolts 408 received within bolt holes 410 and 412 in assembly 404 and mandrel 400, respectively. An end clamp 414 is used as armor to protect the leading edge of the bladder 406 and is secured via bolts onto end 417 of assembly 404. If desired, an additional end clamp can be secured onto end 416 of assembly 404 as well. Connector 420 is secured to mandrel 400 via eight bolts 422 received within bolt holes 424 and 426. Connector 420 provides a connection between packerfoot 104 and flexible connector 120 (FIG. 49A).

The ends of bladder assembly 404 are preferably configured to move longitudinally toward each other to enhance radial expansion of bladder 406 as it is inflated. In the illustrated embodiment, aft end 416 of assembly 404 is fixed to mandrel 400, and forward end 417 is slidably engaged with segment 418 of mandrel 400. This permits forward end 417 to slide toward aft end 416 as the packerfoot is inflated, thereby increasing the radial expansion of bladder 406. The EST's packerfeet are designed to traverse holes up to 10% larger than the drill bit without losing traction. For example, a typical drill bit size, and the associated drilled hole, is 3.75 inches in diameter. A correspondingly sized packerfoot can traverse a 4.1 inch diameter hole. Similarly, a 4.5-inch diameter hole will be traversed with a packerfoot that has an expansion capability to a minimum of 5.0 inches. Further, the slidable connection of bladder assembly 404 with segment 418 tends to prevent the fibers in bladder 406 from overstraining, since the bladder tends not to stretch as much. Alternatively, the bladder assembly can be configured so that its forward end is fixed to the mandrel and its aft can slide toward the forward end. However, this may cause the bladder to undesirably expand when pulling the tractor upward out of a borehole, which can cause the tractor to "stick" to the borehole walls. Splines 419 on the forward end of assembly 404 engage grooves inside connector 420 so that end 417 cannot rotate with respect to mandrel 400.

One or more fluid ports 428 are provided along a length of mandrel 400, which communicate with the interior of bladder 406. Ports 428 are preferably arranged about the circumference of mandrel 400, so that fluid is introduced uniformly throughout the bladder interior. Fluid from aft packerfoot passage 210 reaches bladder 406 by flowing through ports 378 in shaft 118 (FIGS. 53 and 59) to the interior of mandrel 400, and then through ports 428 to the interior of bladder 406. Suitable fluid seals, such as O-rings, are provided at the ends of packerfoot 104 between mandrel 400 and bladder assembly 404 to prevent fluid within the bladder from leaking out to annulus 40.

In a preferred embodiment, bladder 406 is constructed of high strength fibers and rubber in a special orientation that maximizes strength, radial expansion, and fatigue life. The rubber component may be nitrile butadiene rubber (NBR) or a tetra-fluor-ethylene (TFE) rubber, such as the rubber sold under the trade name AFLAS. NBR is preferred for use with invert muds (muds that have greater diesel oil content by volume than water). AFLAS material is preferred for use with some specialized drilling fluids, such as calcium formate muds. Other additives may be added to the rubber to improve abrasion resistance or reduce hysterisis, such as carbon, oil, plasticizers, and various coatings including bonded Teflon type materials.

High strength fibers are included within the bladder, such as S-glass, E-glass, Kevlar (polyamides), and various graphites. The preferred material is S-glass because of its high strength (530,000 psi) and high elongation (5–6%), resulting in greatly improved fatigue life compared to previous designs. For instance, if the fatigue life criterion for the bladders is that the working strain will remain below approximately 25–35% of the ultimate strain of the fibers, previous designs were able to achieve about 7400 cycles of inflation. In contrast, the expected life of the bladders of the present invention under combined loading is estimated to be over 25,000 cycles. Advantageously, more inflation cycles results in increased operational downhole time and lower rig costs.

The fibers are advantageously arranged in multiple layers, a cross-ply pattern. The fibers are preferably oriented at angles of $\pm\alpha$ relative to the longitudinal axis of the tractor, where a is preferably between 0° and 45°, more preferably between 7° and 30°, even more preferably between 15° and 20°, and most preferably about 15°. This allows maximal radial expansion without excessive bulging of the bladder into the regions between the packerfoot toes, described below. It also allows optimal fatigue life by the criterion described above.

Figure 60:
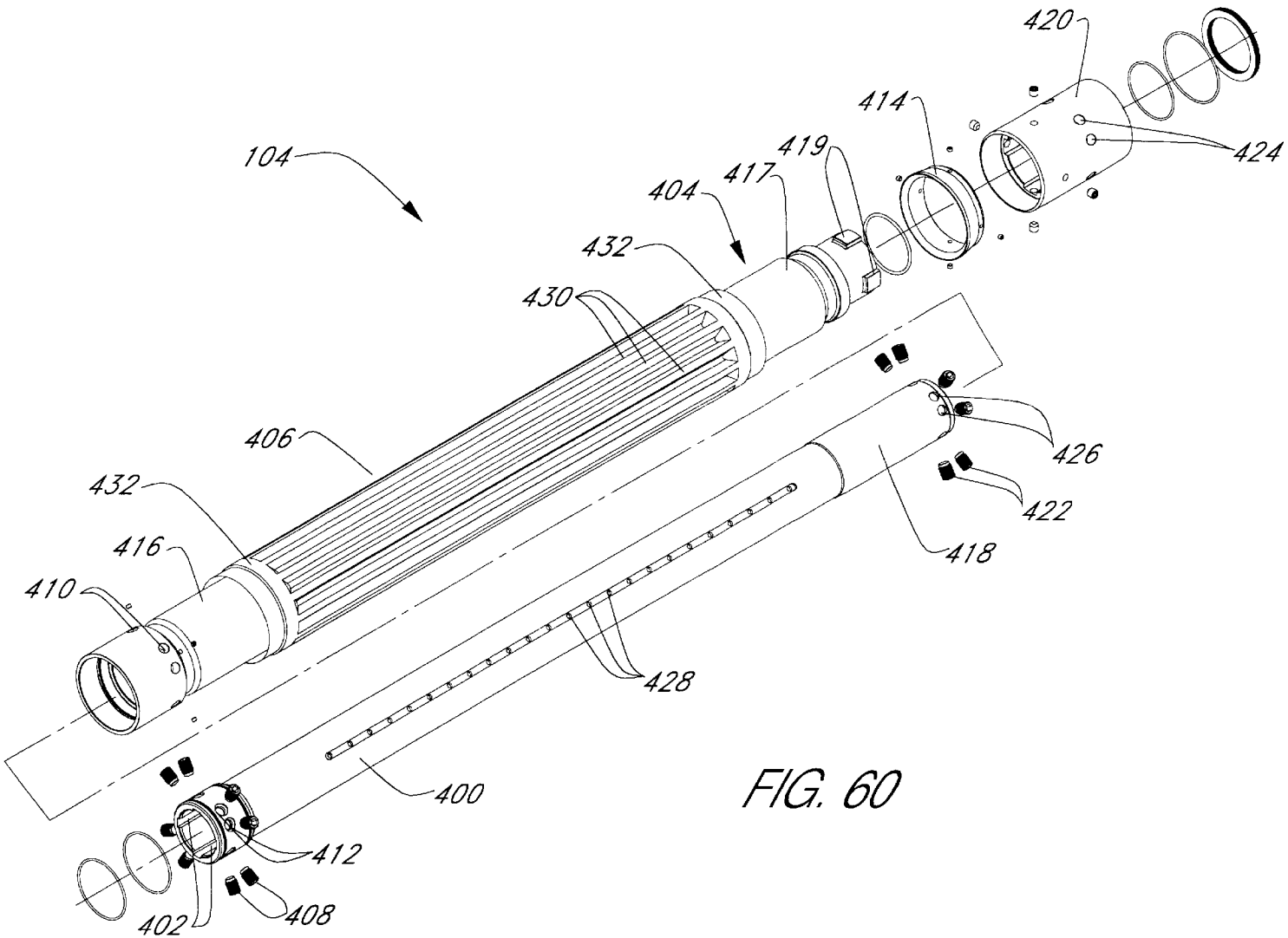
FIG. 60 is a rear perspective view of the aft packerfoot of the EST, shown disassembled.
Figure 61:
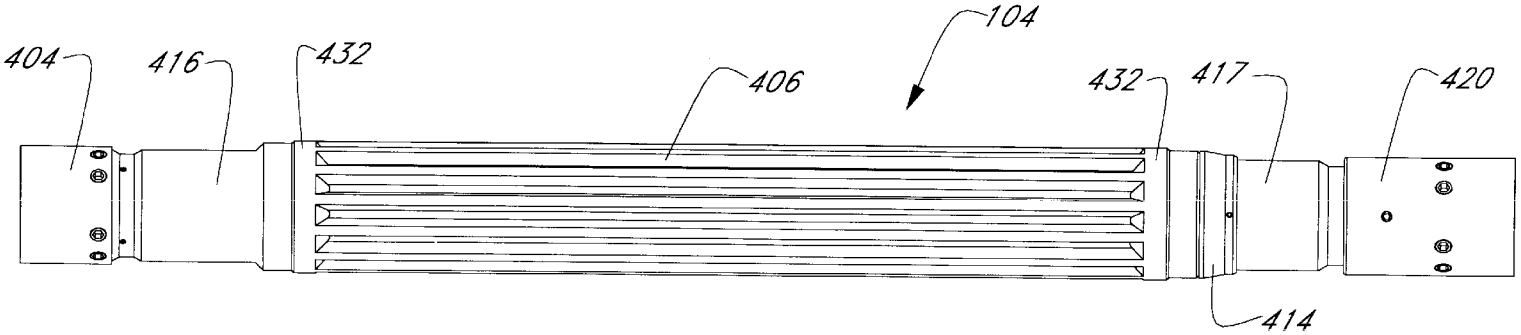
FIG. 61 is a side view of the aft packerfoot of the EST.
Figure 62:
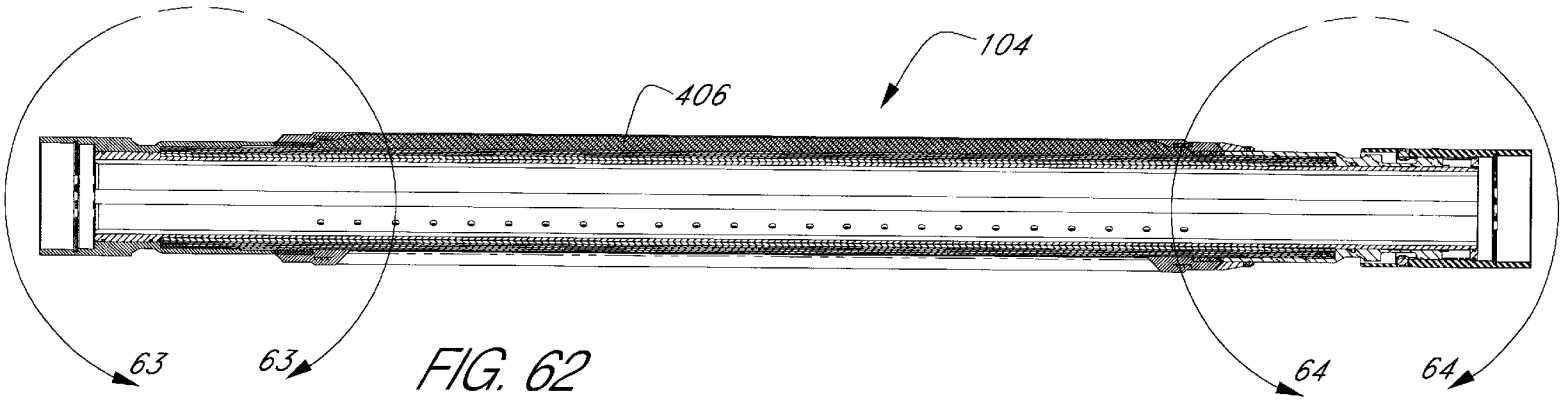
FIG. 62 is a longitudinal sectional view of the aft packerfoot of FIG. 61.
Figure 63:
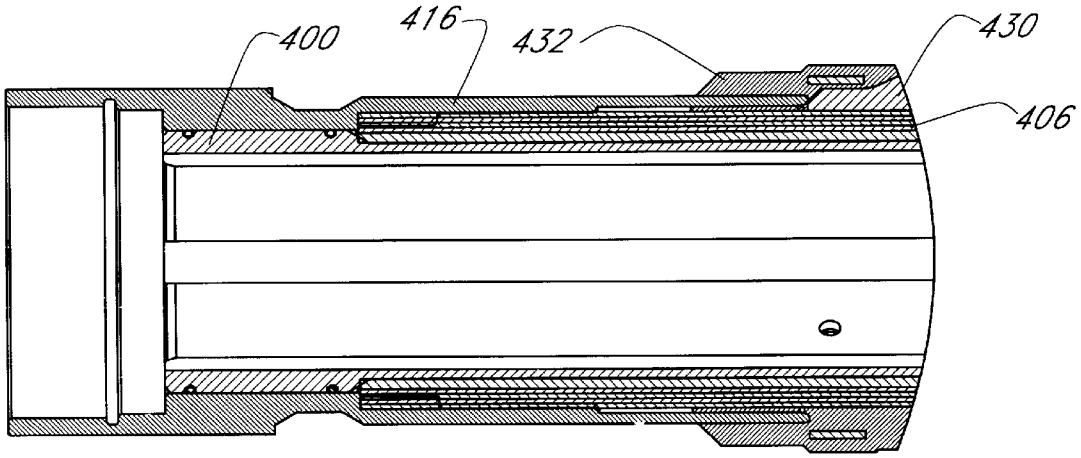
FIG. 63 is an exploded view of the aft end of the aft packerfoot of FIG. 62.
Figure 64:
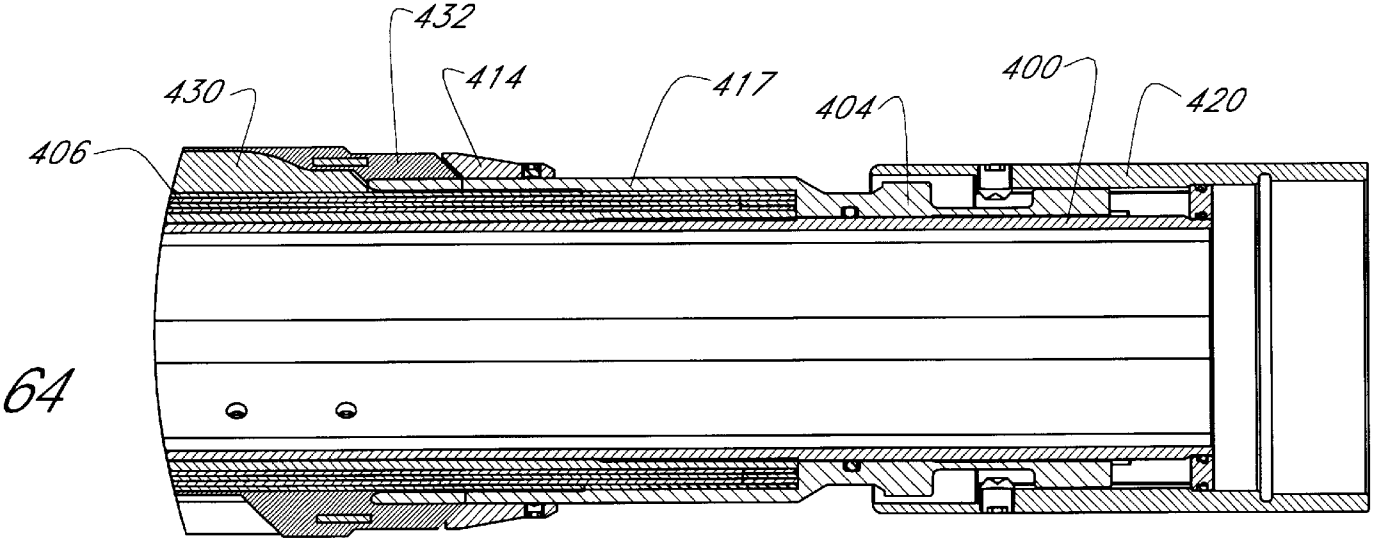
FIG. 64 is an exploded view of the forward end of the aft packerfoot of FIG. 62.
Figure 74:
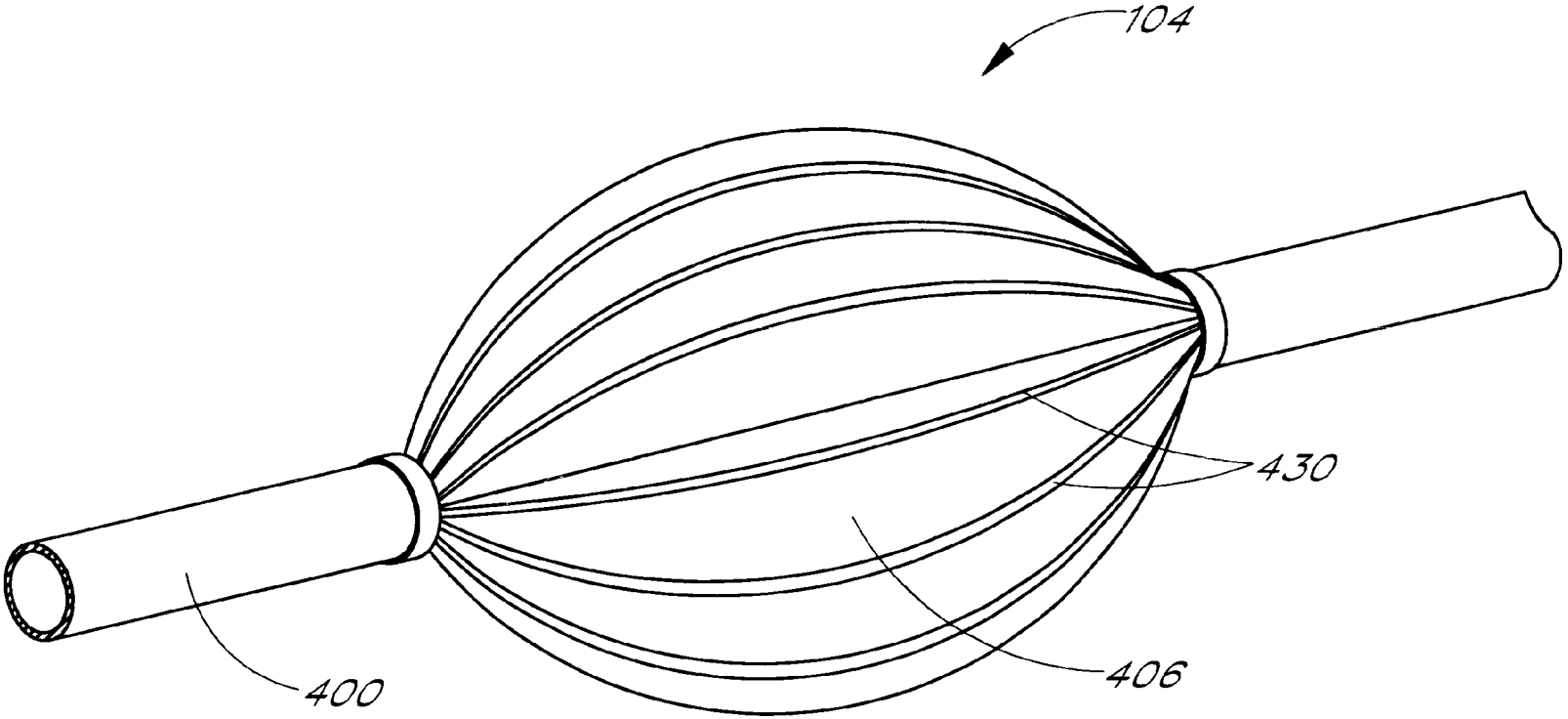
FIG. 74 is a rear perspective view of an inflated packerfoot of the present invention.
Figure 75:
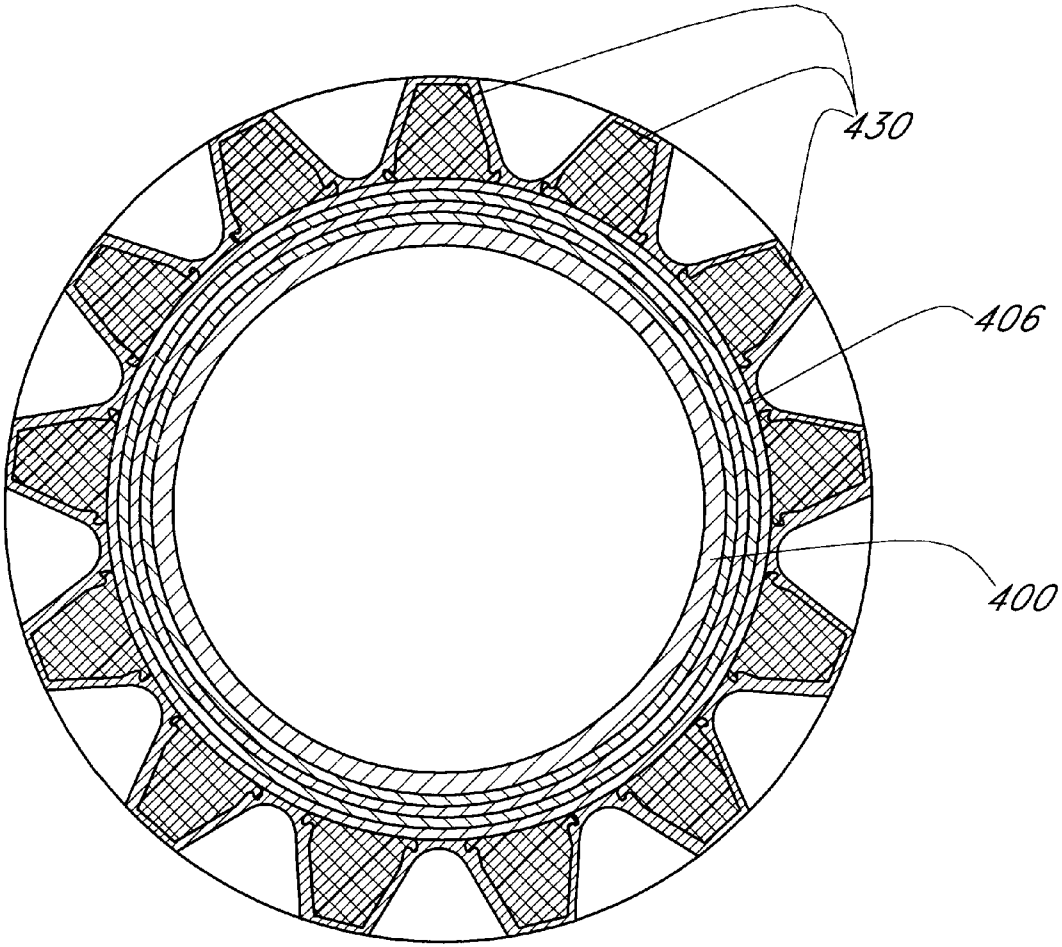
FIG. 75 is a cross-sectional view of a packerfoot of the present invention.

When bladder 406 is inflated to engage a borehole wall 42, it is desirable that the bladder not block the uphole return flow of drilling fluid and drill cuttings in annulus 40. To prevent this, elongated toes 430 are bonded or otherwise attached to the outer surface of the rubber bladder 406, as shown in FIGS. 60 and 75. Toes 430 may have a triangular or trapezoidal cross-section and are preferably arranged in a rib-like manner. When the bladder engages the borehole wall, crevices are formed between the toes 430 and the wall, permitting the flow of drilling fluid and drill cuttings past the packerfoot. Toes 430 are preferably designed to be (1) sufficiently large to provide traction against the hole wall, (2) sufficiently small in cross-section to maximize uphole return flow of drilling fluid past the packerfoot in annulus 40, (3) appropriately flexible to deform during the inflation of the bladder, and (4) elastic to assist in the expulsion of drilling fluid from the packerfoot during deflation. Preferably, each toe has an outer radial width of 0.1–0.6 inches, and a modulus of elasticity of about 19,000,000. Toes 430 may be constructed of CuBe alloy. The ends of toes 430 are secured onto ends 416 and 417 of bladder assembly 404 by bands of material 432, preferably a high-strength non-magnetic material such as Stabaloy. Bands 432 prevent toes 430 from separating from the bladder during unconstrained expansion, thereby preventing formation of "fish-hooks" which could undesirably restrict the extraction of the EST from the borehole. FIG. 74 shows packerfoot 104 inflated.

A protective shield of plastic or metal may be placed in front of the leading edge of the packerfoot, to channel the annulus fluid flow up onto the inflated packerfoot and thereby protect the leading edge of the bladder from erosion by the fluid and its particulate contents.

FIGS. 65–67 and 76 illustrate an alternative embodiment of an aft packerfoot, referred to herein as a "flextoe packerfoot." Aft and forward flextoe packerfeet can be provided in place of the previously described packerfeet 104 and 106. Unlike prior art bladder-type anchors, the flextoe packerfoot of the invention utilizes separate components for radial expansion force and torque transmission of the anchors. In particular, bladders provide force for radial expansion to grip a borehole wall, while "flextoes" transmit torque from the EST body to the borehole. The flextoes comprise beams which elastically bend within a plane parallel to the tractor body the tractor body. Advantageously, the flextoes substantially resist rotation of the body while the packerfoot is engaged with the borehole wall. Other advantages of the flextoe packerfoot include longer fatigue life, greater expansion capability, shorter length, and less operational costs.

The figures show one embodiment of an aft flextoe packerfoot 440. Since the forward flextoe packerfoot is structurally similar to aft flextoe packerfoot 440, it is not described herein. The major components of aft flextoe packerfoot 440 comprise a mandrel 434, fixed endpiece 436, two dowel pin assemblies 438, two jam nuts 442, shuttle 444, spline endpiece 446, spacer tube 448, connector 450, four bladders 452, four bladder covers 454, and four flextoes 456.

Figure 66:
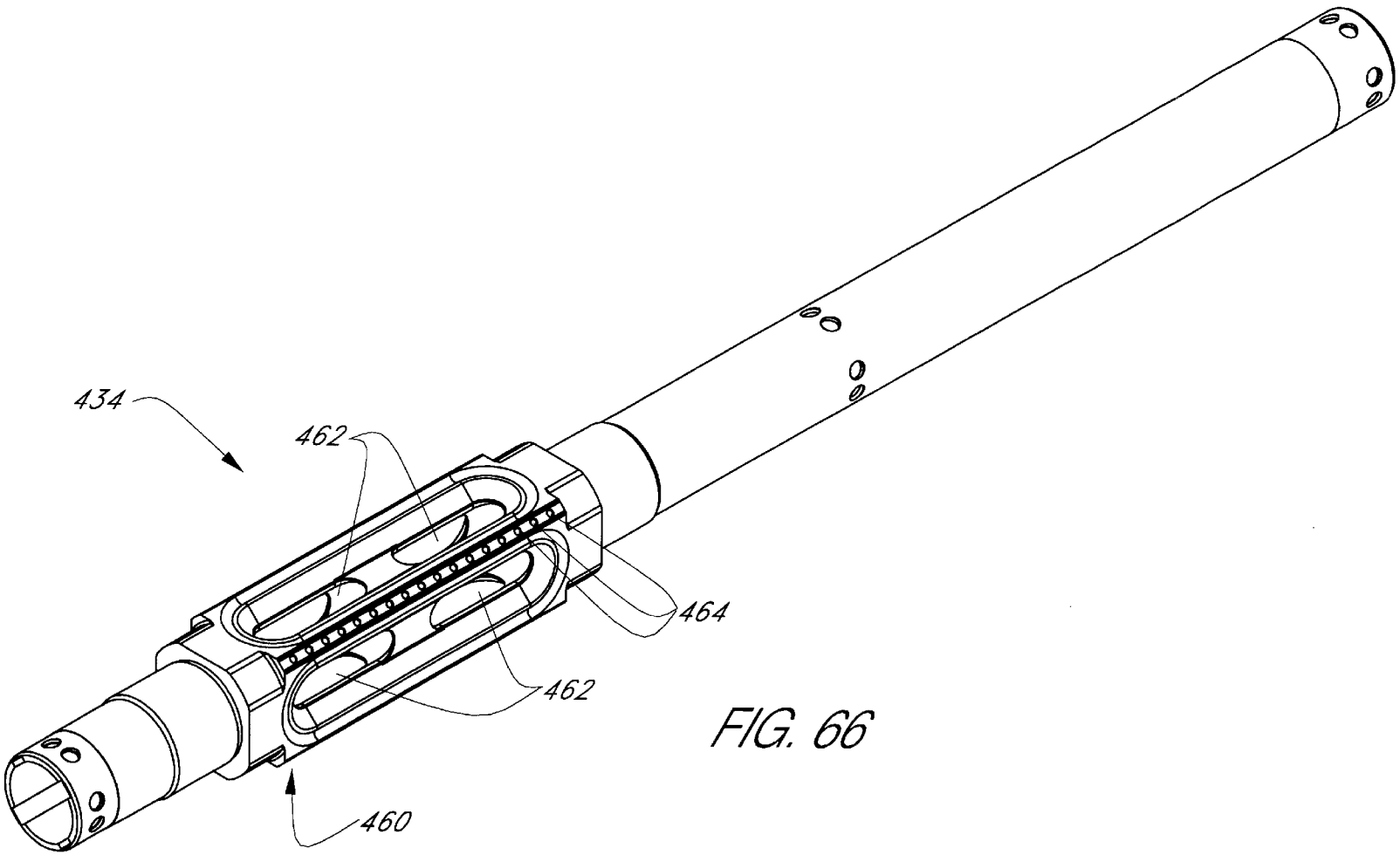
FIG. 66 is a rear perspective view of the mandrel of the flextoe packerfoot of FIG. 65.

With reference to FIG. 66, mandrel 434 is substantially tubular but has a generally rectangular bladder mounting segment 460 which includes a plurality of elongated openings 462 arranged about the sides of segment 460. In the EST, bladders 452 are clamped by bladder covers 454 onto segment 460 so as to cover and seal shut openings 462. In operation, fluid is delivered to the interior space of mandrel 434 via ports 378 in shaft 118 (FIGS. 53 and 59) to inflate the bladders. Although four bladders are shown in the drawings, any number of bladders can be provided. In an alternative embodiment, shown in FIG. 76, one continuous bladder 452 is used. This configuration prevents stress concentrations at the edges of the multiple bladders and allows greater fatigue life of the bladder.

Figure 65:
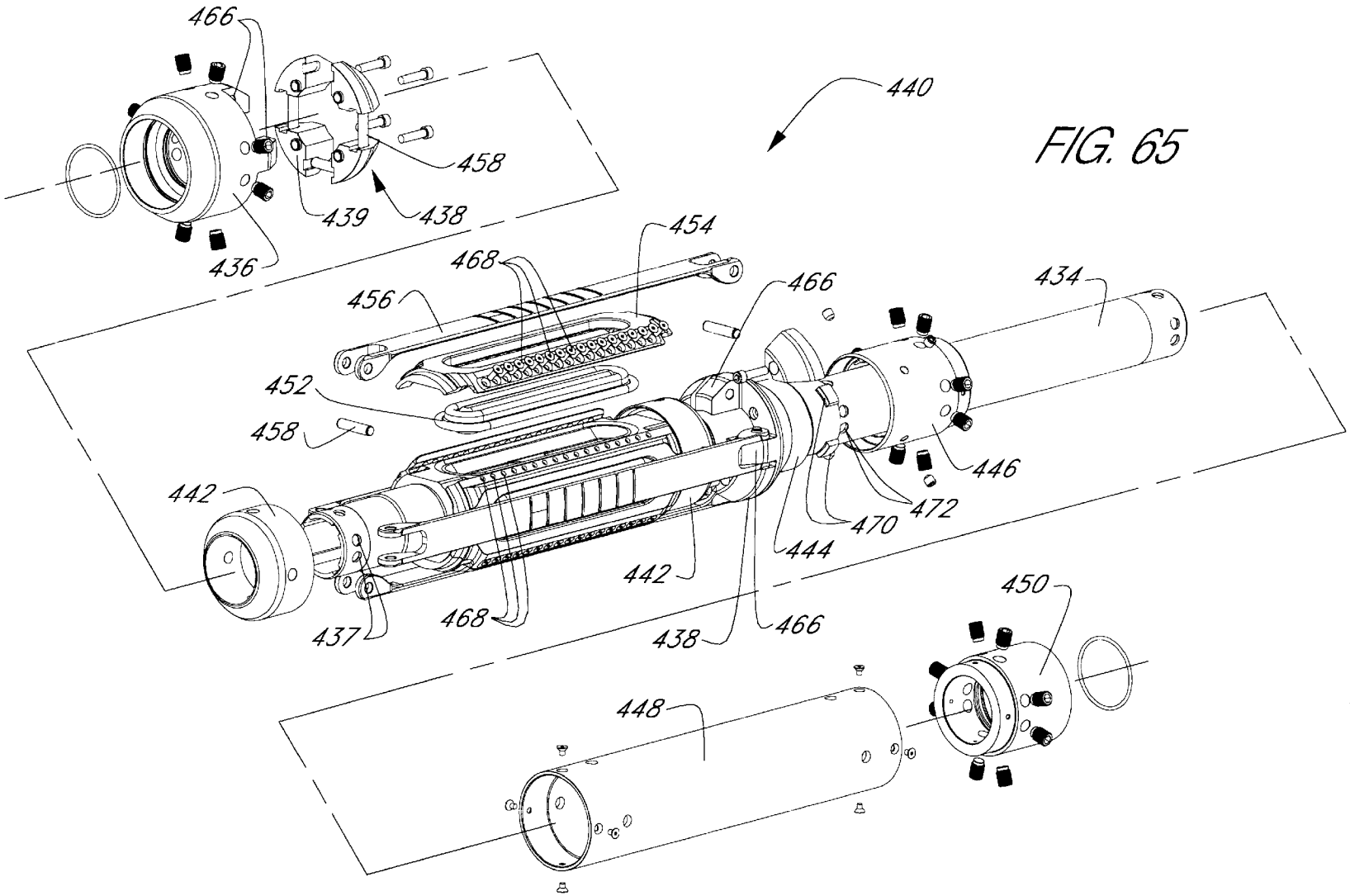
FIG. 65 is a rear perspective view of an aft flextoe packerfoot of the present invention, shown disassembled.

Referring to FIG. 65, bladder covers 454 are mounted onto mandrel 434 via bolts 468 which pass through holes on the side edges of covers 454 and extend into threaded holes 464 in mandrel 434. Bolts 468 fluidly seal bladders 452 against mandrel 434, and prevent the bladders from separating from mandrel 434 due to the fluid pressure inside the bladders. Since the pressure inside the bladders can be as high as 2400 psi, a large number of bolts 468 are preferably provided to enhance the strength of the seal. In the illustrated embodiment, 17 bolts 468 are arranged linearly on each side of the covers 454. Jam nuts 442 clamp the aft and forward ends of bladder covers 454 onto mandrel 434, to fluidly seal the aft and forward ends of the bladders. The individual bladders can easily be replaced by removal of the associated bladder cover 454, substantially reducing replacement costs and time compared to prior art configurations. Bladder covers 454 are preferably constructed of CuBe or CuBe alloy.

Figure 76:
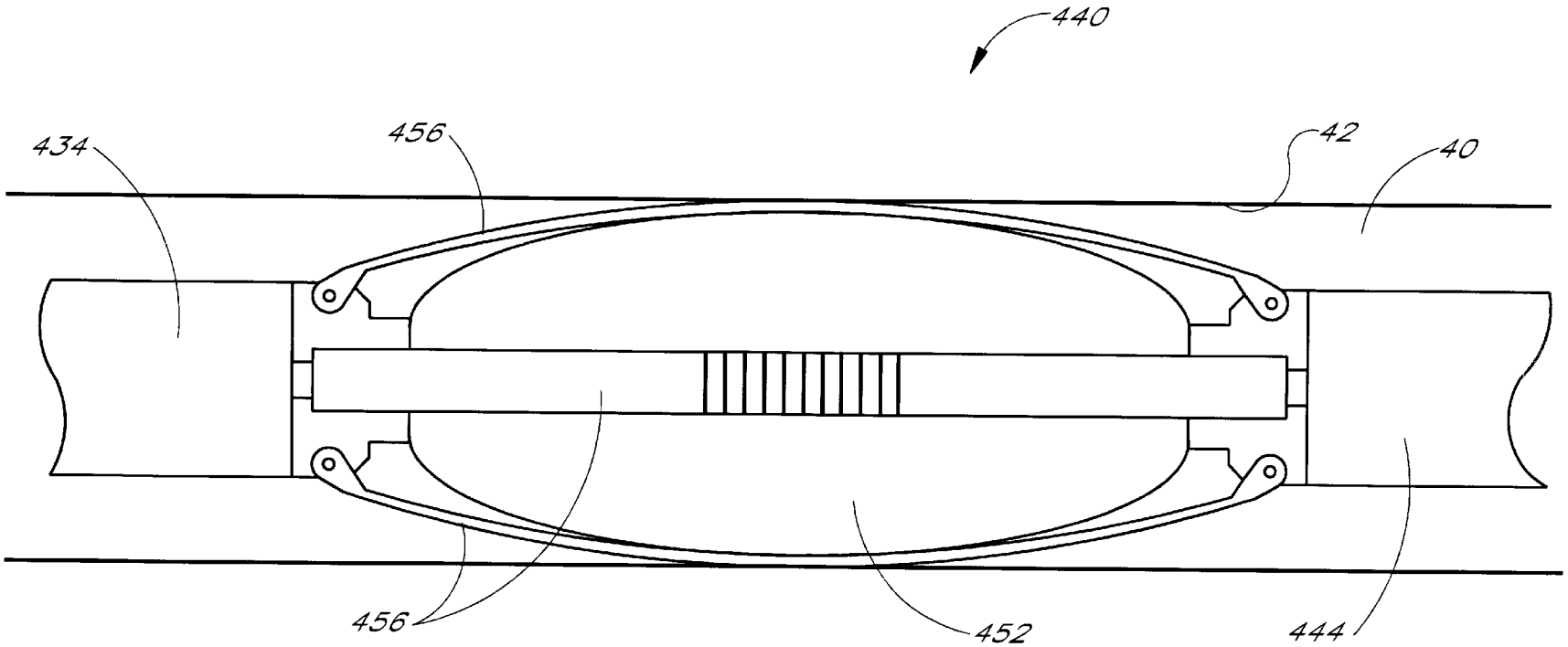
FIG. 76 is a side view of an inflated flextoe packerfoot of the present invention.

Referring to FIG. 65, fixed endpiece 436 is attached to the aft end of mandrel 434 via bolts extending into holes 437. Forward of the bladders, shuttle 444 is slidably engaged on mandrel 434. One dowel pin assembly 438 is mounted onto endpiece 436, and another assembly 438 is mounted onto shuttle 444. In the illustrated embodiment, assemblies 438 each comprise four dowel pin supports 439 which support the ends of the dowel pins 458. The dowel pins hingedly support the ends of flextoes 456. Endpiece 436 and shuttle 444 each have four hinge portions 466 which have holes that receive the dowel pins 458. During operation, inflation of the bladders 452 causes bladder covers 454 to expand radially. This causes the flextoes 456 to hinge at pins 458 and bow outward to engage the borehole wall. FIG. 76 shows an inflated flextoe packerfoot (having a single continuous bladder), with flextoes 456 gripping borehole wall 42. Shuttle 444 is free to slide axially toward fixed endpiece 436, thereby enhancing radial expansion of the flextoes. Those skilled in the art will understand that either end of the flextoes 456 can be permitted to slide along mandrel 434. However, it is preferred that the forward ends of the flextoes be permitted to slide, while the aft ends are fixed to the mandrel. This prevents the slidable end of the flextoes from being axially displaced by the borehole wall during tool removal, which could cause the flextoes to flex outwardly and interfere with removal of the tractor.

Spline end piece 446 is secured to mandrel 434 via bolts extending into threaded holes 472. At the point of attachment, the inner diameter of end piece 446 is approximately equal to the outer diameter of mandrel 434. Rear of the point of attachment, the inner diameter of end piece 446 is slightly larger, so that shuttle 444 can slide within end piece 446. End piece 446 also has longitudinal grooves in its inner diameter, which receive splines 470 on the outer surface of shuttle 444. This prevents shuttle 470, and hence the forward ends of the flextoes 456, from rotating with respect to mandrel 434. Thus, since both the forward and aft ends of flextoes 456 are prevented from rotating with respect to mandrel 434, the flextoes substantially prevent the tool from rotating or twisting when the packerfoot is engaged with the borehole wall.

In the same manner as described above with regard to mandrel 400 of packerfoot 104, mandrel 434 of flextoe packerfoot 440 has grooves on its internal surface to slidably engage rotation restraints 364 on aft shaft 118. Thus, mandrel 434 can slide longitudinally, but cannot rotate, with respect to shaft 118. Restraints 364 transmit torque from shaft 118 to a borehole wall 42. The components of packerfoot 440 are preferably constructed of a flexible, non-magnetic material such as CuBe. Flextoes 456 may include roughened outer surfaces for improved traction against a borehole wall.

The spacer tube 448 is used as an adapter to allow interchangeability of the Flextoe packerfoot 440 and the previous described packerfoot 104 (FIG. 60). The connector 450 is connected to the mandrel via the set screws. Connector 450 connects packerfoot 440 with flexible connector 120 (FIG. 49A) of the EST.

Figure 67:
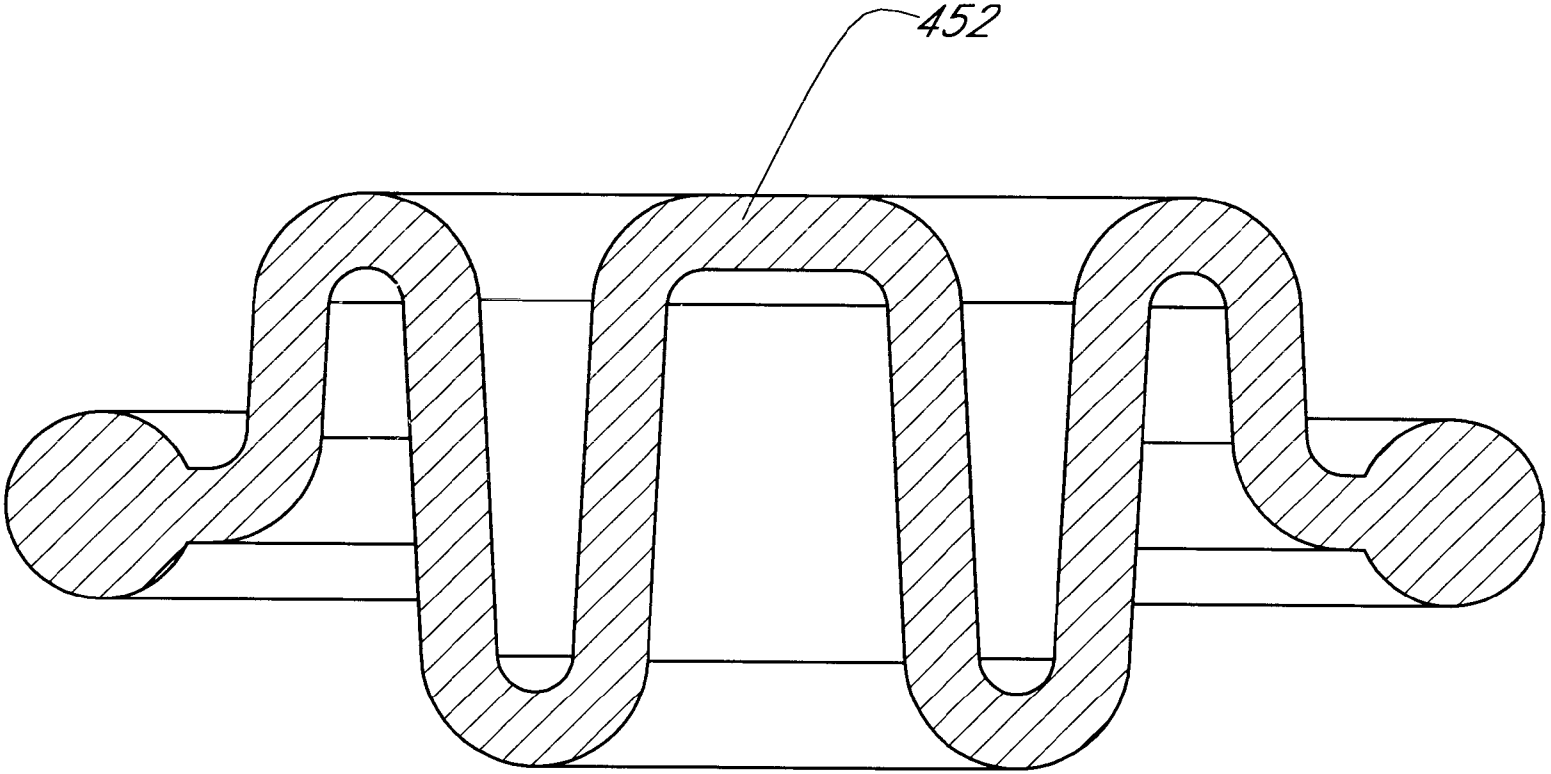
FIG. 67 is a cross-sectional view of the bladder of the flextoe packerfoot of FIG. 65.

FIG. 67 shows the cross-sectional configuration of one of the bladders 452 utilized in flextoe packerfoot 440. In its uninflated state, bladder 452 has a multi-folded configuration as shown. This allows for greater radial expansion when the bladder is inflated, caused by the unfolding of the bladder. Also, the bladders do not stretch as much during use, compared to prior bladders. This results in longer life of the bladders. The bladders are made from fabric reinforced rubber, and may be constructed in several configurations. From the inside to the outside of the bladder, a typical construction is rubber/fiber/rubber/fiber/rubber. Rubber is necessary on the inside to maintain pressure. Rubber is necessary on the outside to prevent fabric damage by cuttings passing the bladder. The rubber may be NBR or AFLAS (TFE rubber). Suitable fabrics include S-glass, E-glass, Kevlar 29, Kevlar 49, steel fabric (for ESTs not having magnetic sensors), various types of graphite, polyester-polarylate fiber, or metallic fibers. Different fiber reinforcement designs and fabric weights are acceptable. For the illustrated embodiment, the bladder can withstand inflation pressure up to 1500 psi. This inflation strength is achieved with a 400 denier 4-tow by 4-tow basket weave Kevlar 29 fabric. The design includes consideration for fatigue by a maximum strain criterion of 25% of the maximum elongation of the fibers. It has been experimentally determined that a minimum thickness of 0.090 inches of rubber is required on the inner surface to assure pressure integrity.

For both the non-flextoe and flextoe embodiments, the packerfeet are preferably positioned near the extreme ends of the EST, to enhance the tool's ability to traverse underground voids. The packerfeet are preferably about 39 inches long. The metallic parts of the packerfeet are preferably made of CuBe alloy, but other non-magnetic materials can be used.

During use, the packerfeet (all of the above-described embodiments, i.e., FIGS. 60 and 65) can desirably grip an open or cased borehole so as to prevent slippage at high longitudinal and torsional loads. In other words, the normal force of the borehole against each packerfoot must be high enough to prevent slippage, giving due consideration to the coefficient of friction (typically about 0.3). The normal force depends upon the surface area of contact between the packerfoot and the borehole and the pressure inside the packerfoot bladder, which will normally be between 500–1600 psi, and can be as high as 2400 psi. When inflated, the surface area of contact between each packerfoot and the borehole is preferably at least 6 $in^2$, more preferably at least 9 $in^2$, even more preferably at least 13 $in^2$, and most preferably at least 18 $in^2$.

Those in the art will understand that fluid seals are preferably provided throughout the EST, to prevent drilling fluid leakage that could render the tool inoperable. For example, the propulsion cylinders and packerfeet are preferably sealed to prevent leakage to annulus 40. Annular pistons 140, 142, 144, and 146 are preferably sealed to prevent fluid flow between the rear and front chambers of the propulsion cylinders. The interfaces between the various housings of control assembly 102 and the flanges of shafts 118 and 124 are preferably sealed to prevent leakage. Compensation piston 248 is sealed to fluidly separate the oil in electronics housing 130 and motor housing 132 from drilling fluid in annulus 40. Various other seals are also provided throughout the tractor. Suitable seals include rubber O-rings, tee seals, or specialized elastomeric seals. Suitable seal materials include AFLAS or NBR rubber.

Sensors

As mentioned above, the control algorithm for controlling motorized valves 154, 156, and 158 is preferably based at least in part upon (1) pressure signals from pressure transducers 182, 184, 186, 188, and 190 (FIGS. 3 and 4A–F), (2)

position signals from displacement sensors 192 and 194 (FIGS. 4A–F) on the annular pistons inside the aft and forward propulsion cylinders, or (3) both.

The pressure transducers measure differential pressure between the various fluid passages and annulus 40. When pressure information from the above-listed pressure transducers is combined with the differential pressure across the differential pressure sub for the downhole motor, the speed can be controlled between 0.25–2000 feet per hour. That is, the tractor can maintain speeds of 0.25 feet per hour, 2000 feet per hour, and intermediate speeds as well. In a preferred embodiment, such speeds can be maintained for as long as required and, essentially, indefinitely so long as the tractor does not encounter an obstruction which will not permit the tractor to move at such speeds. Differential pressure information is especially useful for control of relatively higher speeds such as those used while tripping into and out of a borehole (250–1000 feet per hour), fast controlled drilling (5–150 feet per hour), and short trips (30–1000 feet per hour). The EST can sustain speeds within all of these ranges. Suitable pressure transducers for the EST are Product No. 095A201 A, manufactured and sold by Industrial Sensors and Instruments Incorporated, located in Roundrock, Tex. These pressure transducers are rated for 15000 psi operating pressure and 2500 psid differential pressure.

The position of the annular pistons of the propulsion cylinders can be measured using any of a variety of suitable sensors, including Hall Effect transducers, MIDIM (mirror image differential induction-amplitude magnetometer, sold by Dinsmore Instrument Co., Flint, Mich.) devices, conventional magnetometers, Wiegand sensors, and other magnetic and distance-sensitive devices. If magnetic displacement sensors are used, then the components of the EST are preferably constructed of non-magnetic materials which will not interfere with sensor performance. Suitable materials are CuBe and Stabaloy. Magnetic materials can be used if non-magnetic sensors are utilized.

For example, displacement of aft piston 142 can be measured by locating a MIDIM in connector 122 and a small magnetic source in piston 142. The MIDIM transmits an electrical signal to logic component 224 which is inversely proportional to the distance between the MIDIM and the magnetic source. As piston 142 moves toward the MIDIM, the signal increases, thus providing an indication of the relative longitudinal positions of piston 142 and the MIDIM. Of course, this provides an indication of the relative longitudinal positions of aft packerfoot 104 and the tractor body, i.e., the shafts and control assembly 102. In addition, displacement information is easily converted into speed information by measuring displacement at different time intervals.

Another type of displacement sensor which can be used is a Wiegand sensor. In one embodiment, a wheel is provided on one of the annular pistons in a manner such that the wheel rotates as the piston moves axially within one of the propulsion cylinders. The wheel includes two small oppositely charged magnets positioned on opposite sides of the wheel's outer circumference. In other words, the magnets are separated by 180°. The Wiegand sensor senses reversals in polarity of the two magnets, which occurs every time the wheel rotates 180°. For every reversal in polarity, the sensor sends an electric pulse signal to logic component 224. When piston 142 moves axially within cylinder 110, causing the wheel to rotate, the Wiegand sensor transmits a stream of electric pulses for every 180° rotation of the wheel. The position of the piston 142 with respect to the propulsion cylinder can be determined by monitoring the number of pulses and the direction of piston travel. The position can be calculated from the wheel diameter, since each pulse corresponds to one half of the wheel circumference.

Figure 77A:
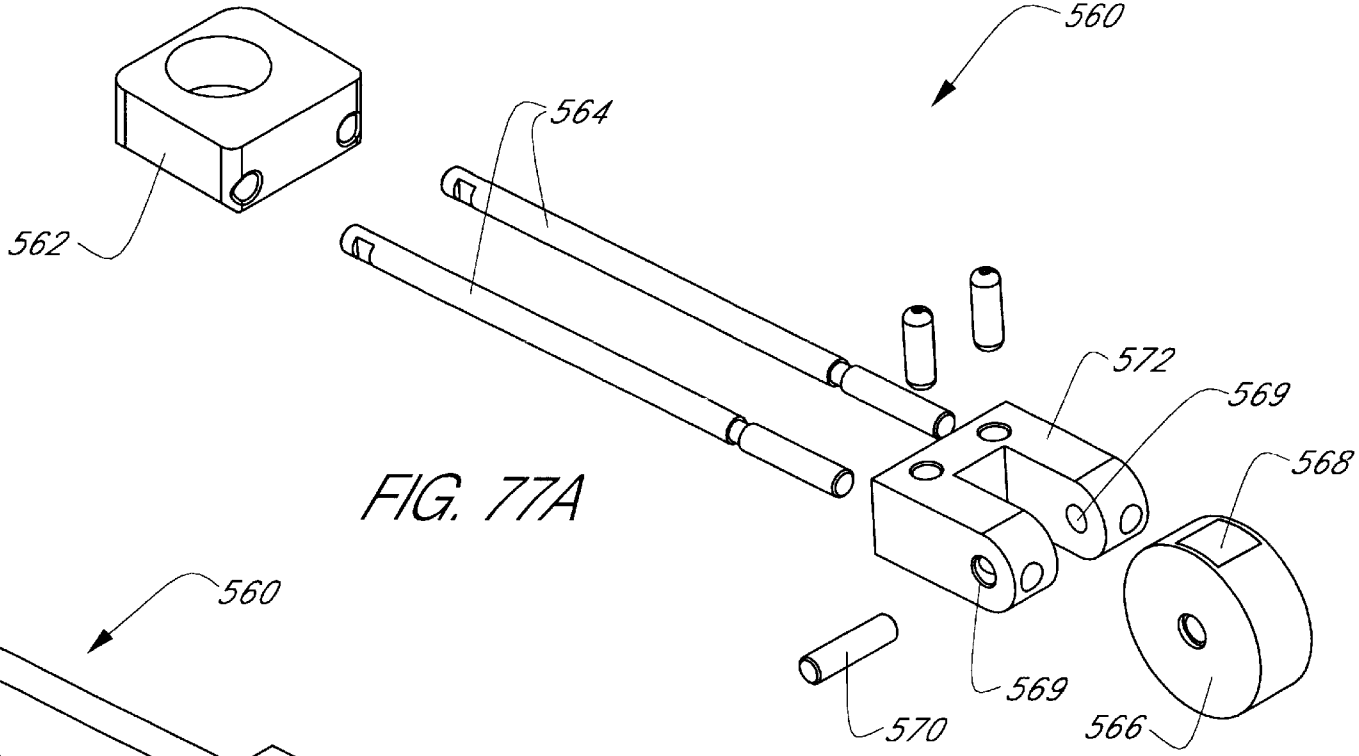
FIG. 77A is a front perspective view of a Wiegand wheel assembly, shown disassembled.
Figure 77B:
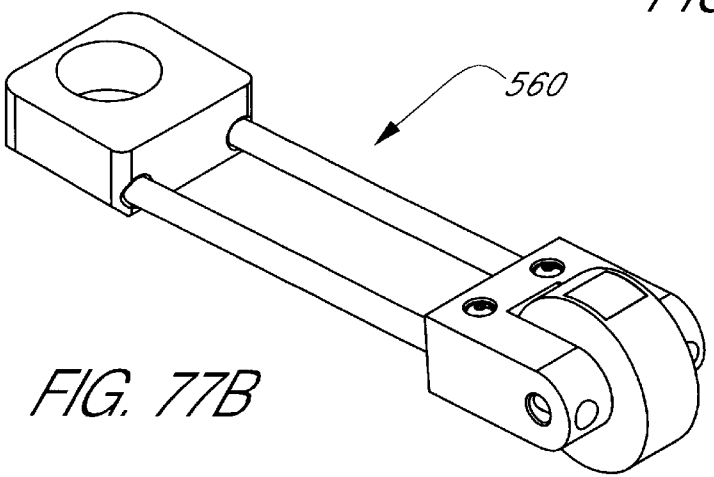
FIG. 77B is a front perspective view of the Wiegand wheel assembly of FIG. 77A, shown assembled.
Figure 77C:
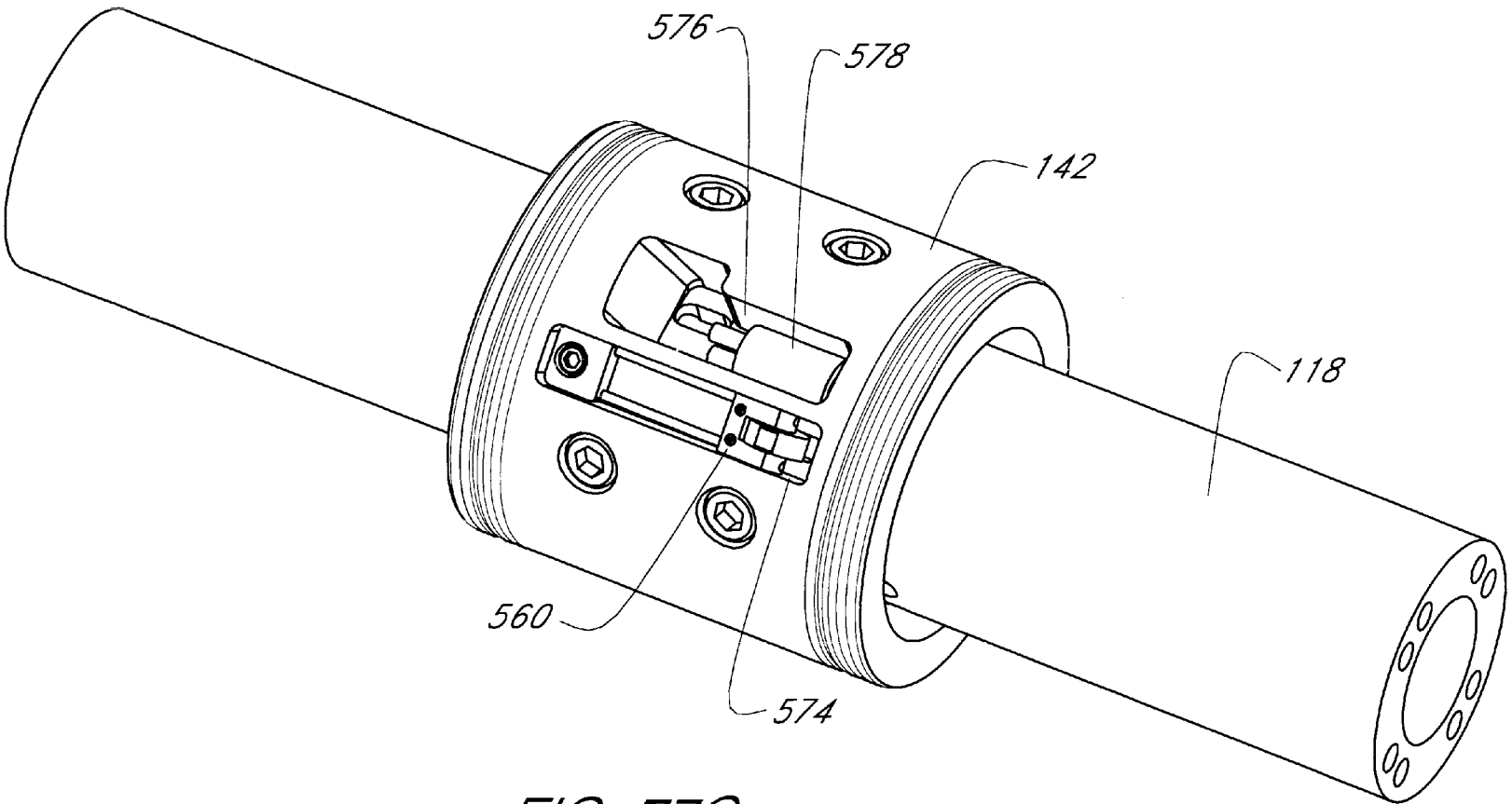
FIG. 77C is front perspective view of a piston having a Wiegand displacement sensor.

FIGS. 77A–C illustrate one embodiment of a Wiegand sensor assembly. As shown, annular piston 142 includes recesses 574 and 576 in its outer surface. Recess 574 is sized and configured to receive a wheel assembly 560, shown in FIGS. 77A and 77B. Wheel assembly 560 comprises a piston attachment member 562, arms 564, a wheel holding member 572, axle 570, and wheel 566. Wheel 566 rotates on axle 570 which is received within holes 569 in wheel holding member 572. Members 562 and 572 have holes for receiving arms 564. Wheel assembly 560 can be secured within recess 574 via a screw received within a hole in piston attachment member 562. Arms 564 are preferably somewhat flexible to bias wheel 566 against the inner surface of propulsion cylinder 110, so that the wheel rotates as piston 142 moves within cylinder 110. Wheel 566 has oppositely charged magnets 568 separated by 180° about the center of the wheel. Recess 576 is sized and configured to receive a Wiegand sensor 578 which senses reversals of polarity of magnets 568, as described above. The figures do not show the electric wires through which the electric signals flow. Preferably, the wires are twisted to prevent electrical interference from the motors or other components of the EST.

Those skilled in the art will understand that the relevant displacement information can be obtained by measuring the displacement of any desired location on the EST body (shafts 118, 124, control assembly 102) with respect to each of the packerfeet 104 and 106. A convenient method is to measure the displacement of the annular pistons (which are fixed to shafts 118 and 124) with respect to the propulsion cylinders or connectors (which are fixed with respect to the packerfeet). In one embodiment, the displacement of piston 142 is measured with respect to connector 122. Alternatively, the displacement of piston 142 can be measured with respect to an internal wall of propulsion cylinder 110 or to control assembly 102. The same information is obtained by measuring the displacement of piston 140. Those skilled in the art will understand that it is sufficient to measure the position of only one of pistons 140 and 142, and only one of pistons 144 and 146, relative to packerfeet 104 and 106, respectively.

Electronics Configuration

FIGS. 69 illustrates one embodiment of the electronic configuration of the EST. All of the wires shown reside within wire passages described above. As shown, five wires extend uphole to the surface, including two 30 volt power wires 502, an RS 232 bus wire 504, and two 1553 bus wires 506 (MIL-STD-1553). Wires 502 provide power to the EST for controlling the motors, and electrically communicate with a 10-pin connector that plugs into electronics package 224 of electronics housing 130. Wire 504 also communicates with electronics package 224. Desired EST parameters, such as speed, thrust, position, etc., may be sent from the surface to the EST via wire 504. Wires 506 transmit signals downhole to the bottom hole assembly. Commands can be sent from the surface to the bottom hole assembly via wires 506, such as commands to the motor controlling the drill bit.

A pair of wires 508 permits electrical communication between electronics package 224 and the aft displacement sensor, such as a Wiegand sensor as shown. Similarly, a pair of wires 510 permits communication between package 224 and the forward displacement sensor as well. Wires 508 and 510 transmit position signals from the sensors to package 224. Another RS 232 bus 512 extends from package 224 downhole to communicate with the bottom hole assembly. Wire 512 transmits signals from downhole sensors, such as weight on bit and differential pressure across the drill bit, to package 224. Another pair of 30 volt wires 514 extend from package 224 downhole to communicate with and provide power to the bottom hole assembly.

A 29-pin connector 213 is provided for communication between electronics package 224 and the motors and pressure transducers of control assembly 102. The signals from the five pressure transducers may be calibrated by calibration resistors 515. Alternatively, the calibration resistors may be omitted. Wires 516 and 518 and wire pairs 520, 522, 524, 526, and 528 are provided for reading electronic pressure signals from the pressure transducers, in a manner known in the art. Wires 516 and 518 extend to each of the resistors 515, each of which is connected via four wires to one pressure transducer. Wire pairs 520, 522, 524, 526, and 528 extend to the resistors 515 and pressure transducers.

Wire foursomes 530, 532, and 534 extend to motors 164, 162, and 160, respectively, which are controlled in a manner known to those skilled in the art. Three wires 536 and a wire 538 extend to the rotary accelerometers 531 of the motors for transmitting motor feedback to electronics package 224 in a manner known to those skilled in the art. In particular, each wire 536 extends to one accelerometer, for a positive signal. Wire 538 is a common ground and is connected to all of the accelerometers. In an alternative embodiment, potentiometers may be provided in place of the rotary accelerometers. Note that potentiometers measure the rotary displacement of the motor output.

EST Performance

A particular advantage of the EST is that it can sustain both high and low speeds. Thus, the EST can be used for a variety of different activities, such as drilling, milling into a casing, tripping into a hole, and tagging bottom (all described below). The EST can sustain any speed preferably within a range of 0.25–2000 feet per hour, more preferably within a range of 10–750 feet per hour, and even more preferably within a range of 35–700 feet per hour. More importantly, the EST can sustain both fast and slow speeds, desirably less than 0.25 feet per hour and more than 2000 feet per hour. The table below lists pairs of speeds (in feet per hour), wherein a single EST or a "string" of connected ESTs (any number of which may be operating) can desirably sustain speeds less than the smaller speed of the pair and can desirably sustain speeds greater than the larger speed of the pair.

| Less than | Greater than |
|---|---|
| 0.25 | 2000 |
| 0.25 | 750 |
| 0.25 | 250 |
| 0.25 | 150 |
| 0.25 | 100 |
| 0.25 | 75 |
| 0.25 | 50 |
| 0.5 | 75 |
| 2 | 1500 |
| 2 | 2000 |
| 15 | 75 |
| 15 | 100 |
| 25 | 75 |
| 25 | 100 |
| 5 | 100 |
| 5 | 250 |
| 5 | 500 |
| 5 | 750 |

-continued

| Less than | Greater than |
|---|---|
| 5 | 1500 |
| 5 | 2000 |
| 10 | 100 |
| 10 | 125 |
| 10 | 250 |
| 10 | 500 |
| 10 | 750 |
| 10 | 1500 |
| 10 | 2000 |
| 30 | 100 |
| 30 | 250 |
| 30 | 750 |
| 30 | 1500 |
| 30 | 2000 |
| 50 | 100 |
| 50 | 250 |
| 50 | 500 |
| 50 | 750 |
| 50 | 1500 |
| 50 | 2000 |

Movement of a tractor into and out of an open hole (non-cased section) at high speeds is referred to in the art as "tripping" into the hole. Tripping speeds tend to have a significant effect on the overall costs of the drill process. Faster speeds result in less operational time and less costs. Tripping speeds generally depend upon the amount of load that the tractor carries. The higher the load, the slower the maximum speed of the tractor. For example, one embodiment of an EST has a diameter of 3.375 inches and, while carrying a 9,000 pound load, can travel up to speeds preferably within a range of 0–180 feet per hour, and more preferably within a range of 120–150 feet per hour. While carrying a 3,700 pound load the same EST can travel up to speeds preferably within a range of 450–575 feet per hour, and more preferably within a range of 500–525 feet per hour. These speeds constitute a significant improvement over prior art tractors.

As mentioned above, a string of multiple tractors can be connected end to end to provide greater overall capability. For example, one tractor may be more suited for tripping, another for drilling, and another for milling. Any number and combination of tractors may be provided. Any number of the tractors may be operating, while others are deactivated. In one embodiment, a set of tractors includes a first tractor configured to move at speeds within 600–2000 feet per hour, a second tractor configured to move at speeds within 10–250 feet per hour, and a third tractor configured to move at speeds within 1–10 feet per hour. On the other hand, by providing multiple processors or a processor capable of processing the motors in parallel, a single tractor of the illustrated EST can move at speeds roughly between 10–750 feet per hour.

Figure 70:
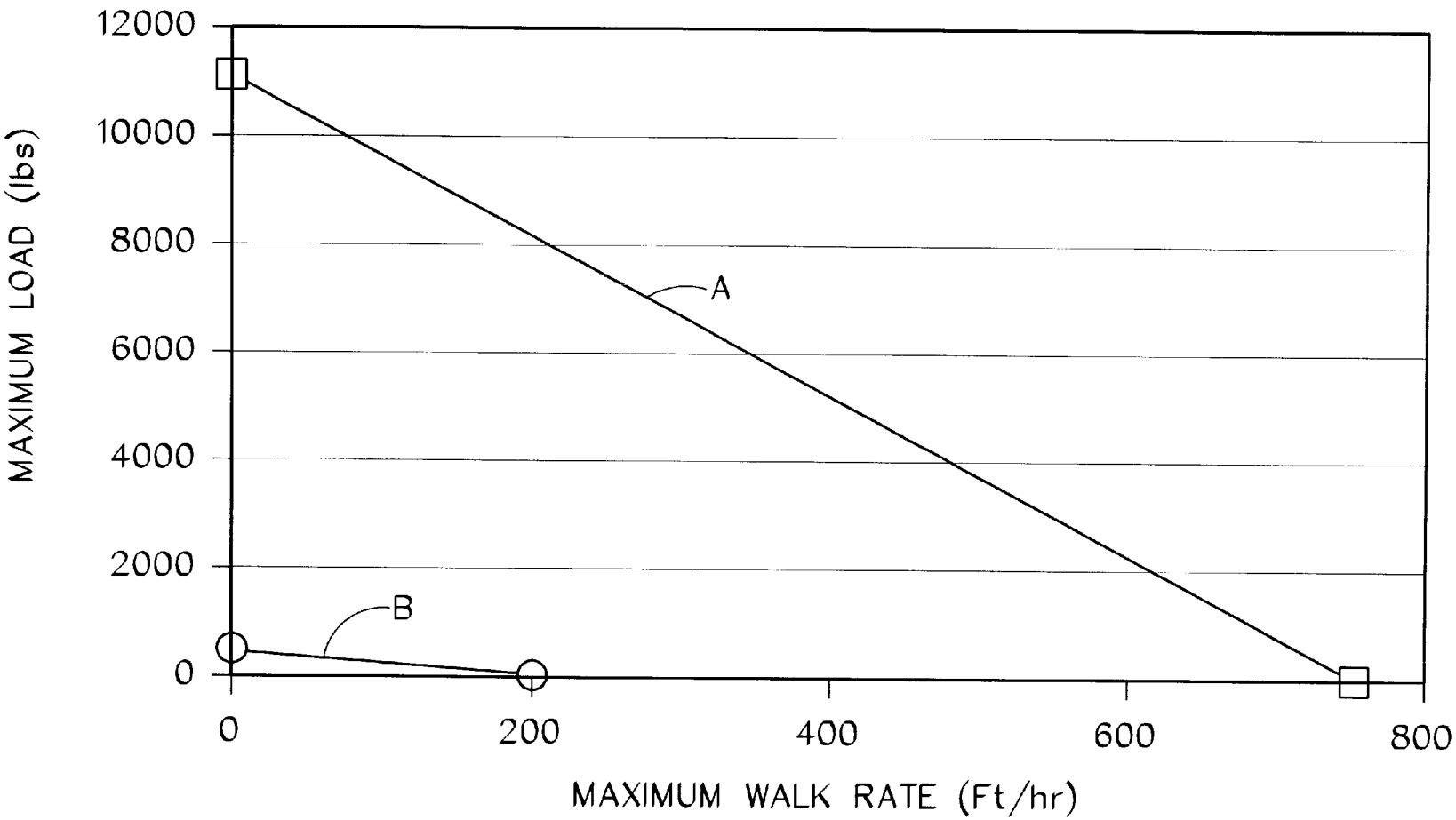
FIG. 70 is a graph illustrating the speed and load-carrying capability range of the EST.

FIG. 70 shows the speed performance envelope, as a function of load, of one embodiment of the EST, having a diameter of 3.375 inches. Curve B indicates the performance limits imposed by failsafe valve 150, and curve A indicates the performance limits imposed by relief valve 152. Failsafe valve 150 sets a minimum supply pressure, and hence speed, for tractor operation. Relief valve 152 sets a maximum supply pressure, and hence speed.

The EST is capable of moving continuously, due to having independently controllable propulsion cylinders and independently inflatable packerfeet.

When drilling a hole, it is desirable to drill continuously as opposed to periodically. Continuous drilling increases bit life and maximizes drilling penetration rates, thus lower drilling costs. It is also desirable to maintain a constant load on the bit. However, the physical mechanics of the drilling process make it difficult to maintain a constant load on the bit. The drill string (coiled tubing) behind the tractor tends to get caught against the hole wall in some portions of the well and then suddenly release, causing large fluctuations in load. Also, the bit may encounter variations in the hardness of the formation through which it is drilling. These and other factors may contribute to create a time-varying load on the tractor. Prior art tractors are not equipped to respond effectively to such load variations, often causing the drill bit to become damaged. This is partly because prior art tractors have their control systems located at the surface. Thus, sensor signals must travel from the tool up to the surface to be processed, and control signals must travel from the surface back down to the tool.

For example, suppose a prior art drilling tool is located 15,000 feet underground. While drilling, the tool may encounter a load variation due to a downhole obstruction such as a hard rock. In order to prevent damage to the drill bit, the tool needs to reduce drilling thrust to an acceptable level or perhaps stop entirely. With the tool control system at the surface, the time required for the tool to communicate the load variation to the control system and for the control system to process the load variation and transmit tool command signals back to the tool would likely be too long to prevent damage to the drill bit.

In contrast, the unique design of the EST permits the tractor to respond very quickly to load variations. This is partly because the EST includes electronic logic components on the tool instead of at the surface, reducing communication time between the logic, sensors, and valves. Thus, the feedback control loop is considerably faster than in prior art tools. The EST can respond to a change of weight on the bit of 100 pounds preferably within 2 seconds, more preferably within 1 second, even more preferably within 0.5 seconds, even more preferably within 0.2 seconds, and most preferably within 0.1 seconds. That is, the weight on the drill bit can preferably be changed at a rate of 100 pounds within 0.1 seconds. If that change is insufficient, the EST can continue to change the weight on the bit at a rate of 100 pounds per 0.1 seconds until a desired control setting is achieved (the differential pressure from the drilling motor is reduced, thus preventing a motor stall). For example, if the weight on the drill bit suddenly surges from 2000 lbs to 3000 lbs due to external conditions, the EST can compensate, i.e. reduce the load on the bit from 3000 lbs to 2000 lbs, in one second.

Typically, the drilling process involves placing casings in boreholes. It is often desirable to mill a hole in the casing to initiate a borehole having a horizontal component. It is also desirable to mill at extremely slow speeds, such as 0.25–4 feet per hour, to prevent sharp ends from forming in the milled casing which can damage drill string components or cause the string to get caught in the milled hole. The unique design of propulsion valves 156 and 158 coupled with the use of displacement sensors allows a single EST to mill at speeds less than 1 foot per hour, and more preferably as low as or even less than 0.25 feet per hour. Thus, appropriate milling ranges for an EST are 0.25–25 feet per hour, 0.25–10 feet per hour, and 0.25–6 feet per hour with appropriate non-barite drilling fluids.

After milling a hole in the casing, it is frequently desirable to exit the hole at a high angle turn. The EST is equipped with flexible connectors 120, 122, 126, and 128 between the packerfeet and the propulsion cylinders, and flexible shafts 118 and 124. These components have a smaller diameter than the packerfeet, propulsion cylinders, and control assembly, and are formed from a flexible material such as CuBe. Desirably, the connectors and shafts are formed from a material having a modulus of elasticity of preferably at least 29,000,000 psi, and more preferably at least 19,000,000 psi. This results in higher flexibility regions of the EST that act as hinges to allow the tractor to perform high angle turns. In one embodiment, the EST can turn at an angle up to 60° per 100 feet of drilled arc, and can then traverse horizontal distances of up 25,000–50,000 feet.

The tractor design balances such flexibility against the desirability of having relatively long propulsion cylinders and packerfeet. It is desirable to have longer propulsion cylinders so that the stroke length of the pistons is greater. The stroke length of pistons of an EST having a diameter of 3.375 inches is preferably at least 10–20 inches, and more preferably at least 12 inches. In other embodiments, the stroke length can be as high as 60 inches. It is also desirable to have packerfeet of an appropriate length so that the tool can more effectively engage the inner surface of the borehole. The length of each packerfoot is preferably at least 15 inches, and more preferably at least 40 inches depending upon design type. As the length of the propulsion cylinders and packerfeet increase, the ability of the tool to turn at high angles decreases. The EST achieves the above-described turning capability in a design in which the total length of the propulsion chambers, control assembly, and packerfeet comprises preferably at least 50% of the total length of the EST and, in other design variations, 50%–80%, and more preferably at least 80% of the total length of the EST. Despite such flexibility, a 3.375 inch diameter EST is sufficiently strong to push or pull longitudinal loads preferably as high as 10,500 pounds.

Advantageously, one aspect of the invention is that a single EST can generate a thrust to push and/or pull various loads. The desired thrust capabilities of various sizes of the EST are summarized in the following table:

| EST Diameter (in) | Desired Thrust (lbs) | Preferred Thrust (lbs) |
|---|---|---|
| 2.125 | 1000 | 2000 |
| 3.375 | 5250 | 10,500 |
| 4.75 | 13,000 | 26,000 |
| 6.0 | 22,500 | 45,000 |

Additionally, the EST resists torsional compliance, i.e. twisting, about its longitudinal axis. During drilling, the formation exerts a reaction torque through the drill bit and into the EST body. When the aft packerfoot is engaged with the borehole and the forward packerfoot is retracted, the portion of the body forward of the aft packerfoot twists slightly. Subsequently, when the forward packerfoot becomes engaged with the borehole and the aft packerfoot is deflated, the portion of the body to the aft of the forward packerfoot tends to untwist. This causes the drill string to gradually become twisted. This also causes the body to gradually rotate about its longitudinal axis. The tool direction sensors must continuously account for such rotation. Compared to prior art tractors, the EST body is advantageously configured to significantly limit such twisting. Preferably, the shaft diameter is at least 1.75 inches and the control assembly diameter is at least 3.375 inches, for this configuration. When such an EST is subjected to a torsional load as high as 500 ft-lbs about its longitudinal axis, the shafts and control assembly twist preferably less than 5° per step of the tractor. Advantageously, the above-mentioned problems are substantially prevented or minimized. Further, the EST design includes a non-rotational engagement of the packerfeet and shafts, via rotation restraints 364 (FIG. 49A). This prevents torque from being transferred to the drill string, which would cause the drill string to rotate. Also, the flextoe packerfeet of the EST provide improved transmission of torque to the borehole wall, via the flextoes.

When initiating further drilling at the bottom of a borehole, it is desirable to "tag bottom," before drilling. Tagging bottom involves moving at an extremely slow speed when approaching the end of the borehole, and reducing the speed to zero at the moment the drill bit reaches the end of the formation. This facilitates smooth starting of the drill bit, resulting in longer bit life, fewer trips to replace the bit, and hence lower drilling costs. The EST has superior speed control and can reverse direction to allow efficient tagging of the bottom and starting the bit. Typically, the EST will move at near maximum speed up to the last 50 feet before the bottom of the hole. Once within 50 feet, the EST speed is desirably reduced to about 12 feet per hour until within about 10 feet of the bottom. Then the speed is reduced to minimum. The tractor is then reversed and moved backward 1–2 feet, and then slowly moved forward.

When drilling horizontal holes, the cuttings from the bit can settle on the bottom of the hole. Such cuttings must be periodically be swept out by circulating drilling fluid close to the cutting beds. The EST has the capability of reversing direction and walking backward, dragging the bit whose nozzles sweep the cuttings back out.

As fluid moves through a hole, the hole wall tends to deteriorate and become larger. The EST's packerfeet are designed to traverse holes up to 10% larger than the drill bit without losing traction.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications thereof. Thus, it is intended that the scope of the present invention herein disclosed should not be limited by the particular disclosed embodiments described above, but should be determined only by a fair reading of the claims that follow.

What is claimed is:

1. An apparatus for determining the travel of a piston within a cylinder, comprising:

a sensor disposed on the piston; and a transmitter disposed on the piston without contacting the sensor and transmitting signals indicative of the distance of travel of the piston within the cylinder;

the sensor receiving the signals from the transmitter to determine the travel of the piston.

2. The apparatus of claim 1 wherein said sensor is a Wiegand sensor.

3. The apparatus of claim 1 wherein said transmitter includes at least one magnet emitting an electric field to be sensed by said sensor.

4. The apparatus of claim 1 wherein said transmitter includes at least one magnet disposed on a wheel rotatably mounted on the piston.

5. The apparatus of claim 4 wherein said wheel is mounted on arms having one end affixed to the piston.

6. The apparatus of claim 4 wherein said wheel includes two oppositely charged magnets on opposite sides of said wheel's outer circumference.

7. The apparatus of claim 6 wherein said sensor senses the magnetic field of said magnets upon rotation of said wheel and emits electric pulse signals indicative thereof.

8. The apparatus of claim 7 wherein said sensor sends said electric pulse signals to a logic member which determines the direction and distance of travel of the piston.

9. The apparatus of claim 1 further including a logic member receiving signals from said sensor to determine the displacement of the piston within the cylinder.

10. The apparatus of claim 1 wherein the signals from the transmitter are magnetic signals.

11. An assembly comprising:

a cylinder;

a piston disposed within said cylinder;

said piston including a sensor and a transmitting wheel;

said transmitting wheel including oppositely charged magnets positioned on opposite sides of said wheel's outer circumference; and said sensor sensing the reversals in polarity of said magnets every time said wheel rotates 180°.

12. The apparatus of claim 11 wherein said sensor sends an electric pulse signal to a logic member which determines the position of said piston within said cylinder.

13. The assembly of claim 12 wherein said sensor is a Weigand sensor.

14. The assembly of claim 12 wherein said sensor transmits a stream of electric pulses for every 180° rotation of said wheel and a position of said piston within said cylinder being calculated from a diameter of said wheel with each pulse corresponding to one-half of said wheel circumference.

15. A method of determining the position of a piston within a cylinder, comprising:

rotating a wheel as the piston travels within the cylinder;

transmitting a signal from a location on the circumference of the wheel;

sensing the signal as the wheel rotates to count the number of rotations; and determining the distance of travel of the piston from the wheel's circumference and the number of rotations of the wheel.

16. The method of claim 15 further including sending the number of rotations of the wheel to a logic member to calculate the position of the piston.

17. An apparatus for determining the travel of a piston within a cylinder, comprising:

a sensor disposed on the piston; and a transmitter axially fixed to the piston and transmitting signals indicative of the distance of travel of the piston within the cylinder;

the sensor receiving the signals from the transmitter to determine the travel of the piston.

18. The apparatus of claim 17, wherein the signals from the transmitter are magnetic signals.

19. An apparatus for determining the travel of a piston within a cylinder, comprising:

a sensor disposed on the piston; and a transmitter including at least one magnet disposed on a wheel rotatably mounted on the piston;

the sensor receiving the signals from the transmitter to determine the travel of the piston.

20. An apparatus for determining the travel of a piston within a cylinder, comprising:

a sensor disposed on the piston; and a transmitter disposed on the piston without contacting the sensor, the transmitter transmitting magnetic signals indicative of the distance of travel of the piston within the cylinder;

the sensor receiving the signals from the transmitter to determine the travel of the piston.

21. An apparatus for determining the travel of a piston within a cylinder, comprising:

a sensor disposed on the piston; and a transmitter axially fixed to the piston, the transmitter transmitting magnetic signals indicative of the distance of travel of the piston within the cylinder;

the sensor receiving the signals from the transmitter to determine the travel of the piston.

* * * * *